US012163413B1

(12) United States Patent
Rasmus et al.

(10) Patent No.: US 12,163,413 B1
(45) Date of Patent: Dec. 10, 2024

(54) DIELECTRIC-BASED GEOSTEERING

(71) Applicant: Schlumberger Technology Corporation, Sugar Land, TX (US)

(72) Inventors: John Rasmus, Richmond, TX (US); Dean Homan, Damon, TX (US); Gong Li Wang, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/443,386

(22) Filed: Feb. 16, 2024

(51) Int. Cl.
*E21B 44/00* (2006.01)
*E21B 7/04* (2006.01)
*E21B 49/00* (2006.01)

(52) U.S. Cl.
CPC ..... *E21B 44/00* (2013.01); *E21B 7/04* (2013.01); *E21B 49/00* (2013.01)

(58) Field of Classification Search
CPC ... E21B 7/04; E21B 7/06; E21B 44/00; E21B 49/00
See application file for complete search history.

(56) References Cited

U.S. PATENT DOCUMENTS 8,598,895 B2 * 12/2013 Comparon ..... G01V 3/30 324/338
10,781,681 B2 9/2020 Santos
10,822,878 B2 11/2020 DiFoggio
11,150,373 B2 10/2021 Wang
2010/0089645 A1 * 4/2010 Trinh ..... E21B 10/00 175/50
2012/0192640 A1 * 8/2012 Minh ..... E21B 47/017 73/152.16
2017/0306743 A1 * 10/2017 Difoggio ..... E21B 47/022
2019/0153859 A1 5/2019 Neale
2019/0353819 A1 * 11/2019 Wang ..... G01V 3/38
2022/0049554 A1 * 2/2022 Groover ..... E21B 47/013

FOREIGN PATENT DOCUMENTS

WO 2024039985 A1 2/2024

OTHER PUBLICATIONS

Knight et al., The Dielectric Constant of Sandstones, 60 KHz to 4 MHZ, Geophysics, vol. 52, No. 5, May 1987, pp. 644-654.
Wu et al., Dielectric-Independent 2-MHz Propagation Resistivities SPE-56448, 1999 SPE Annual Technical Conference and Exhibition, Houston, Texas, Oct. 3-6, 1999, 19 pages.
Rasmus et al., Observations of Induction Dielectric Measurements and Their Role in Determining Thermal Maturity of Organic Mudrocks, URTeC: 2901940, Unconventional Resources Technology Conference, Houston, TX, Jul. 23-25, 2018, 20 pages.
(Continued)

*Primary Examiner* — Dany E Akakpo
(74) *Attorney, Agent, or Firm* — Dayo Aladeniyi

(57) ABSTRACT

A method can include receiving dielectric data from a downhole dielectric tool of a drillstring disposed in a borehole in a target material that includes a target material boundary between the target material and one or more other materials; generating a geosteering command, based at least in part on the dielectric data, that calls for orienting a drill bit of the drillstring with respect to the target material boundary; and issuing the geosteering command to a geosteering actuator of the drillstring.

20 Claims, 39 Drawing Sheets

(56) References Cited

OTHER PUBLICATIONS

Taherian et al., Measurement of dielectric response of water-saturated rocks, Geophysics, vol. 55, No. 12, pp. 1530-1541, 1990.
Clavier et al., "Theoretical and Experimental Bases for the Dual-Water Model for Interpretation of Shaly Sands." SPE J. 24, 1984: 153-168.
Waxman et al., "Electrical Conductivities in Oil-Bearing Shaly Sands", SPE Annual Fall Meeting, Houston TX., Oct. 1-4, 1967, SPE Transactions vol. 243, 1968, pp. 107-122.
Wang et al., Model-Based Correction for Dip and Shoulder Bed Effects on Lwd Propagation Dielectric Constant and Resistivity Logs, SPWLA 62nd Annual Logging Symposium held online from May 17-20, 2021, 18 pages.
Revil, A., Spectral induced polarization of shaly sands: Influence of the electrical double layer, Water Resources Research, vol. 48, W02517, 2012, 23 pages.
Mnegar et al., Induced polarization of shaly sands, Geophysics 1984; 49 (8): 1267-1287.

* cited by examiner

510

520

1100

(A) Typical $C_w$ @ FT= 25 S/m
SAV*$C_w$/100 = 4 x $10^6$*25/100 = 1.0 x $10^6$
(1/cm)(S/m)(1m/100cm) = S/cm$^2$
Predicted Epsilon ~ 700
$\sigma_{imaginary}$ = 0.078 S/m (B) Typical $C_w$ @ FT= 25 S/m
SAV*$C_w$/100 ~ 1 x $10^3$*20/100 = 2 x $10^2$
(1/cm)(S/m)(1m/100cm) = S/cm$^2$
Predicted Epsilon ~ 15
$\sigma_{imaginary}$ = 0.0017 S/m

1200

(A) Typical $C_w$ @ FT= 25 S/m
SAV*$C_w$/100 = 4 x $10^6$*25/100 = 1.0 x $10^6$
(1/cm)(S/m)(1m/100cm) = S/cm$^2$
Predicted Epsilon ~ 10000
$\sigma_{imaginary}$ = 0.055 S/m (B) Typical $C_w$ @ FT= 25 S/m
SAV*$C_w$/100 ~ 1 x $10^3$*20/100 = 2 x $10^2$
(1/cm)(S/m)(1m/100cm) = S/cm$^2$
Predicted Epsilon ~ 15
$\sigma_{imaginary}$ = 0.000083 S/m

1310

1320

1700

DIELECTRIC-BASED GEOSTEERING

BACKGROUND

Geosteering can provide for directional control of a drill bit of a drillstring using downhole geological logging measurements, for example, to keep a directional wellbore within a pay zone. In various scenarios, geosteering may be used to keep a wellbore in a particular section of a reservoir to minimize gas or water breakthrough and maximize hydrocarbon production.

SUMMARY

A method can include receiving dielectric data from a downhole dielectric tool of a drillstring disposed in a borehole in a target material that includes a target material boundary between the target material and one or more other materials; generating a geosteering command, based at least in part on the dielectric data, that calls for orienting a drill bit of the drillstring with respect to the target material boundary; and issuing the geosteering command to a geosteering actuator of the drillstring.

A system can include a processor; memory accessible to the processor; processor-executable instructions stored in the memory and executable by the processor to instruct the system to: receive dielectric data from a downhole dielectric tool of a drillstring disposed in a borehole in a target material that includes a target material boundary between the target material and one or more other materials; generate a geosteering command, based at least in part on the dielectric data, that calls for orienting a drill bit of the drillstring with respect to the target material boundary; and issue the geosteering command to a geosteering actuator of the drillstring.

One or more non-transitory computer-readable storage media can include processor-executable instructions executable to instruct a processor to: receive dielectric data from a downhole dielectric tool of a drillstring disposed in a borehole in a target material that includes a target material boundary between the target material and one or more other materials; generate a geosteering command, based at least in part on the dielectric data, that calls for orienting a drill bit of the drillstring with respect to the target material boundary; and issue the geosteering command to a geosteering actuator of the drillstring.

Various other apparatuses, systems, methods, etc., are also disclosed. This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

The following description includes embodiments of the best mode presently contemplated for practicing the described implementations. This description is not to be taken in a limiting sense, but rather is made merely for the purpose of describing the general principles of the implementations. The scope of the described implementations should be ascertained with reference to the issued claims.

As mentioned, geosteering can provide for directional control of a drill bit of a drillstring using downhole geological logging measurements, for example, to keep a directional wellbore within a pay zone where, in various scenarios, geosteering may be used to keep a wellbore in a particular section of a reservoir to minimize gas or water breakthrough and maximize hydrocarbon production.

A borehole may be referred to as a wellbore and can include an openhole portion or an uncased portion and/or may include a cased portion. A borehole may be defined by a bore wall that is composed of rock that bounds the borehole. As to a well or a borehole, whether for one or more of exploration, sensing, production, injection or other operation(s), it can be planned. Such a process may be referred to generally as well planning, a process by which a path can be mapped in a geologic environment. Such a path may be referred to as a trajectory, which can include coordinates in a three-dimensional coordinate system where a measure along the trajectory may be a measured depth (MD), a total vertical depth (TVD) or another type of measure.

As an example, drilling can include using one or more logging tools that can perform one or more logging operations while drilling or otherwise with a drillstring (e.g., while stationary, while tripping in, tripping out, etc.). As an example, drilling or one or more other operations may occur responsive to measurements. For example, a logging while drilling operation may acquire measurements and adjust drilling based at least in part on such measurements. In such an example, adjustments may be made by actuating one or more geosteering actuators that can provide for orienting a drill bit of a drillstring.

Figure 1:
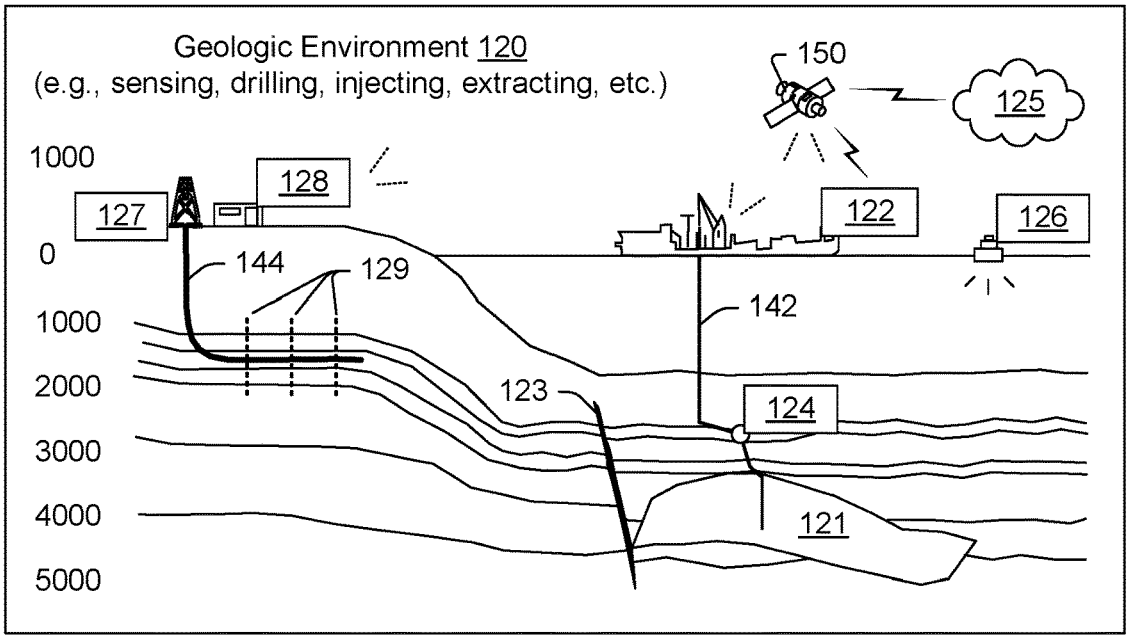
FIG. 1 illustrates examples of equipment in a geologic environment.
Figure 1:
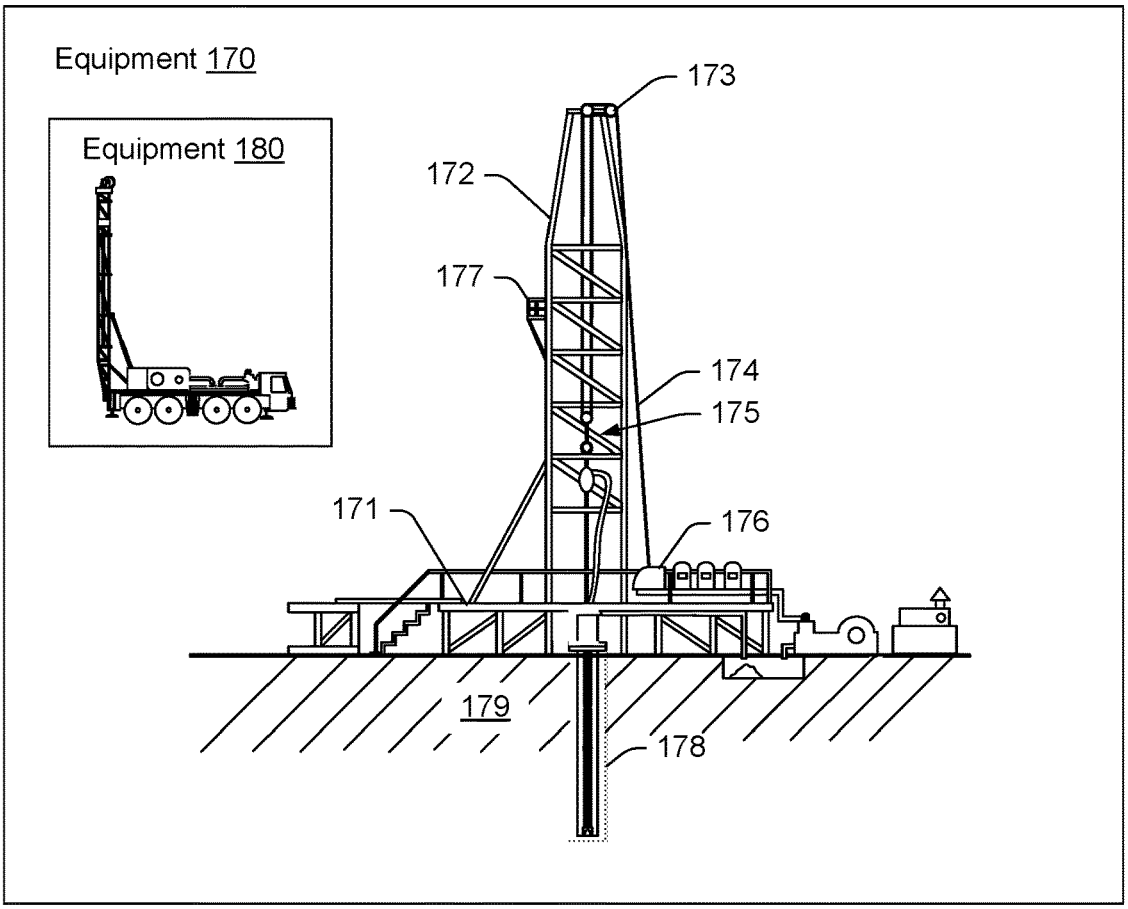

FIG. 1 shows an example of a geologic environment 120. In FIG. 1, the geologic environment 120 may be a sedimentary basin that includes layers (e.g., stratification) that include a reservoir 121 and that may be, for example, intersected by a fault 123 (e.g., or faults). As an example, the geologic environment 120 may be outfitted with a variety of sensors, detectors, actuators, etc. For example, equipment 122 may include communication circuitry to receive and/or to transmit information with respect to one or more networks 125. Such information may include information associated with downhole equipment 124, which may be equipment to acquire information, to assist with resource recovery, etc. For example, the downhole equipment 124 can be disposed in a bore 142 that is formed by a borewall of one or more types of rock. Other equipment 126 may be located remote from a well site and include sensing, detecting, emitting or other circuitry. Such equipment may include storage and communication circuitry to store and to communicate data, instructions, etc. As an example, one or more pieces of equipment may provide for measurement, collection, communication, storage, analysis, etc. of data (e.g., for one or more produced resources, etc.). As an example, one or more satellites may be provided for purposes of communications, data acquisition, geolocation, etc. For example, FIG. 1 shows a satellite 150 in communication with the network 125 that may be configured for communications, noting that the satellite 150 may additionally or alternatively include circuitry for imagery (e.g., spatial, spectral, temporal, radiometric, etc.).

FIG. 1 also shows the geologic environment 120 as optionally including equipment 127 and 128 associated with a well 144 that includes a substantially horizontal portion that may intersect with one or more fractures 129. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop the reservoir (e.g., via fracturing, injecting, extracting, etc.). As an example, the equipment 127 and/or 128 may include components, a system, systems, etc. for fracturing, seismic sensing, analysis of seismic data, NMR logging, assessment of one or more fractures, injection, production, etc. As an example, the equipment 127 and/or 128 may provide for measurement, collection, communication, storage, analysis, etc. of data such as, for example, formation data, fluid data, production data (e.g., for one or more produced resources), etc. As an example, one or more satellites such as the satellite 150 may be provided for purposes of communications, data acquisition, etc.

FIG. 1 also shows an example of equipment 170 and an example of equipment 180. Such equipment, which may be systems of components, may be suitable for use in the geologic environment 120. While the equipment 170 and 180 are illustrated as land-based, various components may be suitable for use in an offshore system. As shown in FIG. 1, the equipment 180 can be mobile as carried by a vehicle; noting that the equipment 170 can be assembled, disassembled, transported and re-assembled, etc.

The equipment 170 includes a platform 171, a derrick 172, a crown block 173, a line 174, a traveling block assembly 175, drawworks 176 and a landing 177 (e.g., a monkeyboard). As an example, the line 174 may be controlled at least in part via the drawworks 176 such that the traveling block assembly 175 travels in a vertical direction with respect to the platform 171. For example, by drawing the line 174 in, the drawworks 176 may cause the line 174 to run through the crown block 173 and lift the traveling block assembly 175 skyward away from the platform 171; whereas, by allowing the line 174 out, the drawworks 176 may cause the line 174 to run through the crown block 173 and lower the traveling block assembly 175 toward the platform 171. Where the traveling block assembly 175 carries pipe (e.g., casing, etc.), tracking of movement of the traveling block 175 may provide an indication as to how much pipe has been deployed. As shown, movement of the traveling block assembly 175 can provide for movement of equipment into and out of a bore 178 in a formation 179.

A derrick can be a structure used to support a crown block and a traveling block operatively coupled to the crown block at least in part via line. A derrick may be pyramidal in shape and offer a suitable strength-to-weight ratio. A derrick may be movable as a unit or in a piece-by-piece manner (e.g., to be assembled and disassembled).

As an example, drawworks may include a spool, brakes, a power source and assorted auxiliary devices. Drawworks may controllably reel out and reel in line. Line may be reeled over a crown block and coupled to a traveling block to gain mechanical advantage in a "block and tackle" or "pulley" fashion. Reeling out and in of line can cause a traveling block (e.g., and whatever may be hanging underneath it), to be lowered into or raised out of a bore. Reeling out of line may be powered by gravity and reeling in by a motor, an engine, etc. (e.g., an electric motor, a diesel engine, etc.).

As an example, a crown block can include a set of pulleys (e.g., sheaves) that can be located at or near a top of a derrick or a mast, over which line is threaded. A traveling block can include a set of sheaves that can be moved up and down in a derrick or a mast via line threaded in the set of sheaves of the traveling block and in the set of sheaves of a crown block. A crown block, a traveling block and a line can form a pulley system of a derrick or a mast, which may enable handling of heavy loads (e.g., drillstring, pipe, casing, liners, etc.) to be lifted out of or lowered into a bore. As an example, line may be about a centimeter to about five centimeters in diameter as, for example, steel cable. Through use of a set of sheaves, such line may carry loads heavier than the line could support as a single strand.

As an example, a derrick person may be a rig crew member that works on a platform attached to a derrick or a mast. A derrick can include a landing on which a derrick person may stand. As an example, such a landing may be about 10 meters or more above a rig floor. In an operation referred to as trip out of the hole (TOH or pull out of hole (POOH)), a derrick person may wear a safety harness that enables leaning out from the work landing (e.g., monkeyboard) to reach pipe in located at or near the center of a derrick or a mast and to throw a line around the pipe and pull it back into its storage location (e.g., fingerboards), for example, until it a time at which it may be desirable to run the pipe back into the bore. As an example, a rig may include automated pipe-handling equipment such that the derrick person controls the machinery rather than physically handling the pipe.

As an example, a trip may refer to the act of pulling equipment from a bore (POOH) and/or placing equipment in a bore (e.g., run in hole (RIH)). As an example, equipment may include a drillstring that can be pulled out of the hole and/or place or replaced in the hole. As an example, a pipe trip may be performed where a drill bit has dulled or has otherwise ceased to drill efficiently and is to be replaced. As an example, a trip may be performed when changing section diameter, for example, upon finishing a larger bore diameter section changing equipment to drill a smaller bore diameter section.

Figure 2:
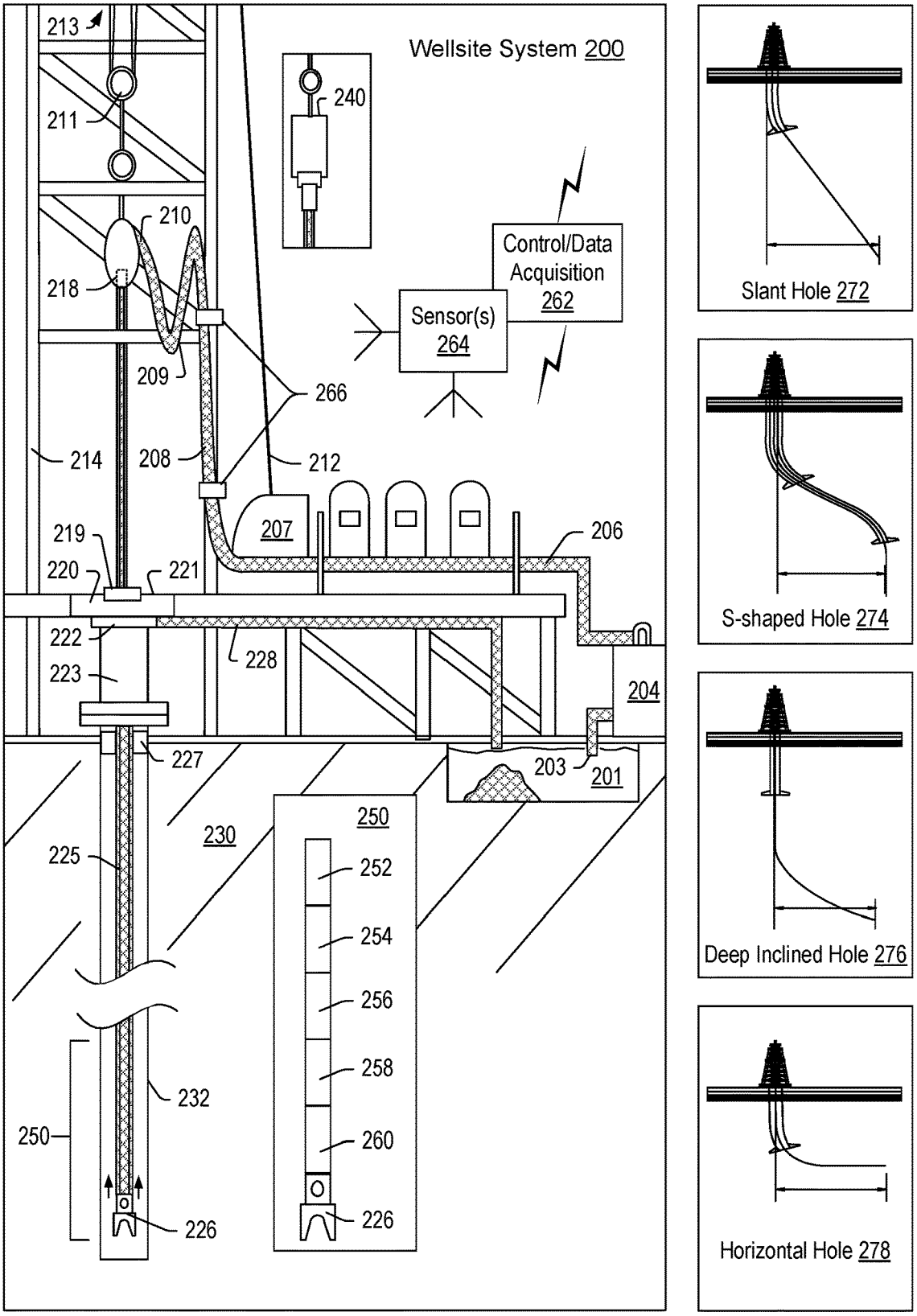
FIG. 2 illustrates an example of a system and examples of types of holes.

FIG. 2 shows an example of a wellsite system 200 (e.g., at a wellsite that may be onshore or offshore). As shown, the wellsite system 200 can include a mud tank 201 for holding mud and other material (e.g., where mud can be a drilling fluid that may help to transport cuttings, etc.), a suction line 203 that serves as an inlet to a mud pump 204 for pumping mud from the mud tank 201 such that mud flows to a vibrating hose 206, a drawworks 207 for winching drill line or drill lines 212, a standpipe 208 that receives mud from the vibrating hose 206, a kelly hose 209 that receives mud from the standpipe 208, a gooseneck or goosenecks 210, a traveling block 211, a crown block 213 for carrying the traveling block 211 via the drill line or drill lines 212 (see, e.g., the crown block 173 of FIG. 1), a derrick 214 (see, e.g., the derrick 172 of FIG. 1), a kelly 218 or a top drive 240, a kelly drive bushing 219, a rotary table 220, a drill floor 221, a bell nipple 222, one or more blowout preventors (BOPs) 223, a drillstring 225, a drill bit 226, a casing head 227 and a flow pipe 228 that carries mud and other material to, for example, the mud tank 201.

In the example system of FIG. 2, a borehole 232 is formed in subsurface formations 230 by rotary drilling; noting that various example embodiments may also use directional drilling or one or more other types of drilling.

As shown in the example of FIG. 2, the drillstring 225 is suspended within the borehole 232 and has a drillstring assembly 250 that includes the drill bit 226 at its lower end. As an example, the drillstring assembly 250 may be a bottom hole assembly (BHA).

The wellsite system 200 can provide for operation of the drillstring 225 and other operations. As shown, the wellsite system 200 includes the platform 215 and the derrick 214 positioned over the borehole 232. As mentioned, the wellsite system 200 can include the rotary table 220 where the drillstring 225 passes through an opening in the rotary table 220.

As shown in the example of FIG. 2, the wellsite system 200 can include the kelly 218 and associated components, etc., or a top drive 240 and associated components. As to a kelly example, the kelly 218 may be a square or hexagonal metal/alloy bar with a hole drilled therein that serves as a mud flow path. The kelly 218 can be used to transmit rotary motion from the rotary table 220 via the kelly drive bushing 219 to the drillstring 225, while allowing the drillstring 225 to be lowered or raised during rotation. The kelly 218 can pass through the kelly drive bushing 219, which can be driven by the rotary table 220. As an example, the rotary table 220 can include a master bushing that operatively couples to the kelly drive bushing 219 such that rotation of the rotary table 220 can turn the kelly drive bushing 219 and hence the kelly 218. The kelly drive bushing 219 can include an inside profile matching an outside profile (e.g., square, hexagonal, etc.) of the kelly 218; however, with slightly larger dimensions so that the kelly 218 can freely move up and down inside the kelly drive bushing 219.

As to a top drive example, the top drive 240 can provide functions performed by a kelly and a rotary table. The top drive 240 can turn the drillstring 225. As an example, the top drive 240 can include one or more motors (e.g., electric and/or hydraulic) connected with appropriate gearing to a short section of pipe called a quill, that in turn may be screwed into a saver sub or the drillstring 225 itself. The top drive 240 can be suspended from the traveling block 211, so the rotary mechanism is free to travel up and down the derrick 214. As an example, a top drive 240 may allow for drilling to be performed with more joint stands than a kelly/rotary table approach.

In the example of FIG. 2, the mud tank 201 can hold mud, which can be one or more types of drilling fluids. As an example, a wellbore may be drilled to produce fluid, inject fluid or both (e.g., hydrocarbons, minerals, water, etc.).

In the example of FIG. 2, the drillstring 225 (e.g., including one or more downhole tools) may be composed of a series of pipes threadably connected together to form a long tube with the drill bit 226 at the lower end thereof. As the drillstring 225 is advanced into a wellbore for drilling, at some point in time prior to or coincident with drilling, the mud may be pumped by the pump 204 from the mud tank 201 (e.g., or other source) via the lines 206, 208 and 209 to a port of the kelly 218 or, for example, to a port of the top drive 240. The mud can then flow via a passage (e.g., or passages) in the drillstring 225 and out of ports located on the drill bit 226 (see, e.g., a directional arrow). As the mud exits the drillstring 225 via ports in the drill bit 226, it can then circulate upwardly through an annular region between an outer surface(s) of the drillstring 225 and surrounding wall(s) (e.g., open borehole, casing, etc.), as indicated by directional arrows. In such a manner, the mud lubricates the drill bit 226 and carries heat energy (e.g., frictional or other energy) and formation cuttings to the surface where the mud (e.g., and cuttings) may be returned to the mud tank 201, for example, for recirculation (e.g., with processing to remove cuttings, etc.).

The mud pumped by the pump 204 into the drillstring 225 may, after exiting the drillstring 225, form a mudcake that lines the wellbore which, among other functions, may reduce friction between the drillstring 225 and surrounding wall(s) (e.g., borehole, casing, etc.). A reduction in friction may facilitate advancing or retracting the drillstring 225. During a drilling operation, the entire drillstring 225 may be pulled from a wellbore and optionally replaced, for example, with a new or sharpened drill bit, a smaller diameter drillstring, etc. As mentioned, the act of pulling a drillstring out of a hole or replacing it in a hole is referred to as tripping. A trip may be referred to as an upward trip or an outward trip or as a downward trip or an inward trip depending on trip direction.

As an example, consider a downward trip where upon arrival of the drill bit 226 of the drillstring 225 at a bottom of a wellbore, pumping of the mud commences to lubricate the drill bit 226 for purposes of drilling to enlarge the wellbore. As mentioned, the mud can be pumped by the pump 204 into a passage of the drillstring 225 and, upon filling of the passage, the mud may be used as a transmission medium to transmit energy, for example, energy that may encode information as in mud-pulse telemetry.

As an example, mud-pulse telemetry equipment may include a downhole device configured to effect changes in pressure in the mud to create an acoustic wave or waves upon which information may modulated. In such an example, information from downhole equipment (e.g., one or more components of the drillstring 225) may be transmitted uphole to an uphole device, which may relay such information to other equipment for processing, control, etc.

As an example, telemetry equipment may operate via transmission of energy via the drillstring 225 itself. For example, consider a signal generator that imparts coded energy signals to the drillstring 225 and repeaters that may receive such energy and repeat it to further transmit the coded energy signals (e.g., information, etc.).

As an example, the drillstring 225 may be fitted with telemetry equipment 252 that includes a rotatable drive shaft, a turbine impeller mechanically coupled to the drive shaft such that the mud can cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such example, an alternator may be coupled to the aforementioned drive shaft where the alternator includes at least one stator winding electrically coupled to a control circuit to selectively short the at least one stator winding to electromagnetically brake the alternator and thereby selectively brake rotation of the modulator rotor to modulate the pressure pulses in the mud.

In the example of FIG. 2, an uphole control and/or data acquisition system 262 may include circuitry to sense pressure pulses generated by telemetry equipment 252 and, for example, communicate sensed pressure pulses or information derived therefrom for process, control, etc.

The assembly 250 of the illustrated example includes a logging-while-drilling (LWD) module 254, a measurement-while-drilling (MWD) module 256, an optional module 258, a rotary-steerable system (RSS) and/or motor 260, and the drill bit 226. Such components or modules may be referred to as tools where a drillstring can include a plurality of tools.

As to an RSS, it involves technology utilized for direction drilling. Directional drilling involves drilling into the Earth to form a deviated bore such that the trajectory of the bore is not vertical; rather, the trajectory deviates from vertical along one or more portions of the bore. As an example, consider a target that is located at a lateral distance from a surface location where a rig may be stationed. In such an example, drilling can commence with a vertical portion and then deviate from vertical such that the bore is aimed at the target and, eventually, reaches the target. Directional drilling may be implemented where a target may be inaccessible from a vertical location at the surface of the Earth, where material exists in the Earth that may impede drilling or otherwise be detrimental (e.g., consider a salt dome, etc.), where a formation is laterally extensive (e.g., consider a relatively thin yet laterally extensive reservoir), where multiple bores are to be drilled from a single surface bore, where a relief well is desired, etc.

One approach to directional drilling involves a mud motor; noting that a mud motor can present some challenges depending on factors such as rate of penetration (ROP), transferring weight to a bit (e.g., weight on bit, WOB) due to friction, etc. A mud motor can be a positive displacement motor (PDM) that operates to drive a bit during directional drilling. A PDM operates as drilling fluid is pumped through it where the PDM converts hydraulic power of the drilling fluid into mechanical power to cause the bit to rotate. A PDM can operate in a so-called sliding mode, when the drillstring is not rotated from the surface.

An RSS can drill directionally where there is continuous rotation from surface equipment, which can alleviate the sliding of a steerable motor (e.g., a PDM). An RSS may be deployed when drilling directionally (e.g., deviated, horizontal, or extended-reach wells). An RSS can aim to minimize interaction with a borehole wall, which can help to preserve borehole quality. An RSS can aim to exert a relatively consistent side force akin to stabilizers that rotate with the drillstring or orient the bit in the desired direction while continuously rotating at the same number of rotations per minute as the drillstring.

The LWD module 254 may be housed in a suitable type of drill collar and can contain one or a plurality of selected types of logging tools (e.g., NMR unit or units, etc.). It will also be understood that more than one LWD and/or MWD module can be employed. An LWD module can include capabilities for measuring, processing, and storing information, as well as for communicating with the surface equipment. In the illustrated example, the LWD module 254 may include a seismic measuring device, an NMR measuring device, etc.

The MWD module 256 may be housed in a suitable type of drill collar and can contain one or more devices for measuring characteristics of the drillstring 225 and the drill bit 226. As an example, the MWD module 256 may include equipment for generating electrical power, for example, to power various components of the drillstring 225. As an example, the MWD module 256 may include the telemetry equipment 252, for example, where the turbine impeller can generate power by flow of the mud; it being understood that other power and/or battery systems may be employed for purposes of powering various components. As an example, the MWD module 256 may include one or more of the following types of measuring devices: a weight-on-bit measuring device, a torque measuring device, a vibration measuring device, a shock measuring device, a stick slip measuring device, a direction measuring device, and an inclination measuring device.

As an example, one or more NMR measuring devices (e.g., NMR units, etc.) may be included in a drillstring (e.g., a BHA, etc.) where, for example, measurements may support one or more of geosteering, geostopping, trajectory optimization, etc. As an example, motion characterization data can be utilized for control of NMR measurements (e.g., acquisition, processing, quality assessment, etc.).

FIG. 2 also shows some examples of types of holes that may be drilled. For example, consider a slant hole 272, an S-shaped hole 274, a deep inclined hole 276 and a horizontal hole 278.

As an example, a drilling operation can include directional drilling where, for example, at least a portion of a well includes a curved axis. For example, consider a radius that defines curvature where an inclination with regard to the vertical may vary until reaching an angle between about 30 degrees and about 60 degrees or, for example, an angle to about 90 degrees or possibly greater than about 90 degrees. As an example, a trajectory and/or a drillstring may be characterized in part by a dogleg severity (DLS), which can be a two-dimensional parameter specified in degrees per 30 meters (e.g., or degrees per 100 feet).

As an example, a directional well can include several shapes where each of the shapes may aim to meet particular operational demands. As an example, a drilling process may be performed on the basis of information as and when it is relayed to a drilling engineer. As an example, inclination and/or direction may be modified based on information received during a drilling process.

As an example, deviation of a bore may be accomplished in part by use of a downhole motor and/or a turbine. As to a motor, consider a drillstring that can include a positive displacement motor (PDM).

As an example, a system may be a steerable system and include equipment to perform a method such as geosteering. As mentioned, a steerable system can be or include an RSS. As an example, a steerable system can include a PDM and/or a turbine on a lower part of a drillstring which, just above a drill bit, a bent sub can be mounted. Geosteering equipment of a drillstring can include one or more geosteering actuators that can provide for orienting a drill bit of the drillstring. For example, an actuator that can include a piston that moves a pad for providing a force that can be exerted against a borehole wall thus steering a bottom hole assembly (e.g., orienting a drill bit of the bottom hole assembly). As an example, an actuator can be a bent downhole motor, which may be actuated via one or more processes. As an example, a bent drilling motor may be used with a fixed bend that cannot be varied during normal operation or with a variable bend that, for example, can be varied based on a geosteering command. As an example, for a variable bend drilling motor, one or more actuators can be included that can be configured to create or vary a bend, thereby affecting the steering behavior of the steering system. As an example, an actuator can be a downhole actuator that can adjust orientation downhole and/or an actuator can be a surface actuator that can perform an action uphole (e.g., at surface) to adjust orientation downhole.

As an example, borehole orientation may be described in terms of inclination and azimuth. Inclination can refer to the vertical angle measured from the down direction, noting that the down, horizontal, and up directions may have inclinations of 0 degrees, 90 degrees, and 180 degrees, respectively. Azimuth can refer to the horizontal angle measured clockwise from true north, noting that the north, east, south, and west directions may have azimuths of 0 degrees, 90 degrees, 180 degrees and 270 degrees, respectively. In directional drilling, a parameter known as toolface may be the angle measured in a plane perpendicular to a drillstring axis, for example, an angle that is between a reference direction on the drillstring and a fixed reference. As an example, for near-vertical wells, north may be the fixed reference and the angle may be the magnetic toolface. For more-deviated wells, the top of the borehole may be the fixed reference and the angle may be the gravity toolface, or high side toolface. As an example, toolface may be defined with respect to a deflection tool or a steerable motor system and may be a part thereof that is oriented in a particular direction to make a desired deflection within a borehole. As an example, a method may include geosteering that includes controlling one or more components of a rig system, a drillstring, etc., to orient a drill bit, whether directly and/or indirectly. In such an example, the method may include determining one or more control parameters (e.g., values, etc.) based at least in part on data acquired downhole using one or more tools of a drillstring (e.g., LWD equipment, MWD equipment, etc.).

As an example, above a PDM, MWD equipment that provides real time or near real time data of interest (e.g., inclination, direction, pressure, temperature, real weight on the drill bit, torque stress, etc.) and/or LWD equipment may be installed. As to the latter, LWD equipment can make it possible to send to the surface various types of data of interest, including for example, geological data (e.g., gamma ray log, resistivity, density and sonic logs, etc.). As explained, geosteering may be a type of steering of a drillstring that is controlled in a manner that depends at least in part on geological data.

As an example, the coupling of sensors providing information on the course of a well trajectory, in real time or near real time, with, for example, one or more logs characterizing the formations from a geological viewpoint, can allow for implementing a geosteering method. Such a method can include navigating a subsurface environment, for example, to follow a desired route to reach a desired target or targets.

As an example, a drillstring can include one or more of an azimuthal density neutron (ADN) tool for measuring density and porosity; a MWD tool for measuring inclination, azimuth and shocks; a compensated dual resistivity (CDR) tool for measuring resistivity and gamma ray related phenomena; a combinable magnetic resonance (CMR) tool for measuring properties (e.g., relaxation properties, etc.); one or more variable gauge stabilizers; one or more bend joints; and a geosteering tool, which may include a motor and optionally equipment for measuring and/or responding to one or more of inclination, resistivity and gamma ray related phenomena.

As an example, a tool such as the ECOSCOPE tool (SLB, Houston, Texas) may be utilized to acquire measurements. Such a tool can include one or more PNGs and associated detectors. Such a tool can include features for one or more of resistivity, neutron porosity, azimuthal gamma ray, density, elemental capture spectroscopy and sigma measurements. For example, consider features for one or more of 2 MHz and 400 kHz propagation resistivity, elemental capture spectroscopy, neutron-gamma density, capture cross section (sigma), azimuthal bulk density, azimuthal photoelectric factor, azimuthal natural gamma ray, density caliper, ultrasonic caliper, annular pressure and temperature while drilling, triaxial shocks and vibration, and near-bit borehole inclination. Such a tool can be operatively coupled to one or more telemetry systems that may provide for real-time acquisition and, for example, real-time decision making, rendering of graphics, etc. As an example, such a tool may be operatively coupled to one or more types of circuitries, which may, for example, perform computations downhole using measurements acquired downhole.

As to sigma measurements (e.g., sigma data), sigma is the macroscopic cross section for the absorption of thermal neutrons, or capture cross section, of a volume of matter, measured in capture units (c.u.). A sigma log is the principal output of a pulsed neutron capture log, which may be used for one or more purposes.

As an example, one or more types of nuclear measurements may be acquired by one or more tools where such nuclear measurements can include one or more of electron density ($\rho_e$), hydrogen index (HI), and thermal neutron capture cross section (sigma or $\Sigma$).

As an example, geosteering can include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

Referring again to FIG. 2, the wellsite system 200 can include one or more sensors 264 that are operatively coupled to the control and/or data acquisition system 262. As an example, a sensor or sensors may be at surface locations. As an example, a sensor or sensors may be at downhole locations. As an example, a sensor or sensors may be at one or more remote locations that are not within a distance of the order of about one hundred meters from the wellsite system 200. As an example, a sensor or sensor may be at an offset wellsite where the wellsite system 200 and the offset wellsite are in a common field (e.g., oil and/or gas field).

As an example, one or more of the sensors 264 can be provided for tracking pipe, tracking movement of at least a portion of a drillstring, etc.

As an example, the system 200 can include one or more sensors 266 that can sense and/or transmit signals to a fluid conduit such as a drilling fluid conduit (e.g., a drilling mud conduit). For example, in the system 200, the one or more sensors 266 can be operatively coupled to portions of the standpipe 208 through which mud flows. As an example, a downhole tool can generate pulses that can travel through the mud and be sensed by one or more of the one or more sensors 266 (e.g., consider mud-pulse telemetry). In such an example, the downhole tool can include associated circuitry such as, for example, encoding circuitry that can encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the system 200 can include a transmitter that can generate signals that can be transmitted downhole via mud (e.g., drilling fluid) as a transmission medium.

Analysis of formation information acquired by one or more tools may reveal features such as, for example, vugs, dissolution planes (e.g., dissolution along bedding planes), stress-related features, dip events, etc. As an example, a tool may acquire information that may help to characterize a reservoir, optionally a fractured reservoir where fractures may be natural and/or artificial (e.g., hydraulic fractures). A reservoir can be a porous formation where fluid can be within various pores of the porous formation and amenable to movement (e.g., to produce fluid from the reservoir). As an example, information acquired by a tool or tools may be analyzed using a framework such as the TECHLOG framework (SLB, Houston, Texas). As an example, the TECHLOG framework can be interoperable with one or more other frameworks such as, for example, the PETREL framework (SLB, Houston, Texas). As an example, a computational environment such as, for example, the DELFI environment (SLB, Houston, Texas) may be utilized, which can provide for utilization of the PETREL framework and other frameworks, optionally in interrelated manners.

Figure 3:
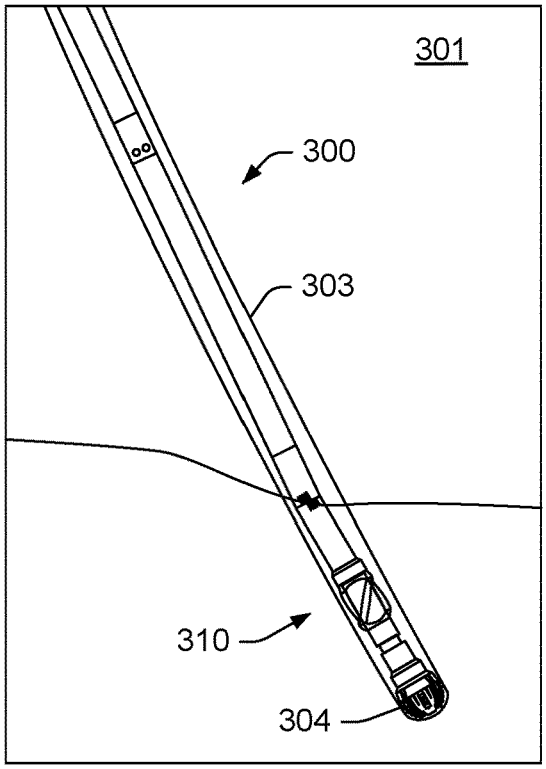
FIG. 3 illustrates an example of a geologic environment with a borehole and an example of a portion of a drillstring that can include various components.
Figure 3:
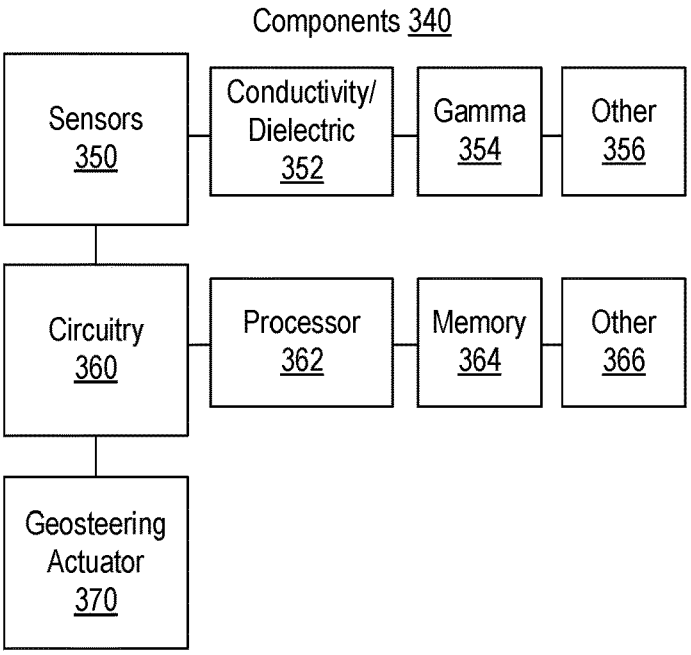
Figure 3:
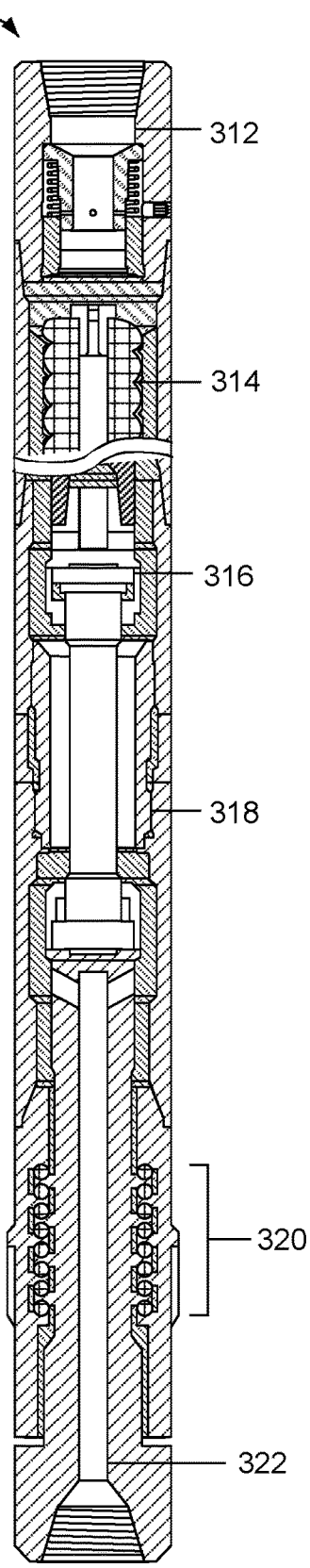

FIG. 3 shows an example of a drilling assembly 300 in a geologic environment 301 that includes a borehole 303 where the drilling assembly 300 (e.g., a drillstring) includes a drill bit 304 and a motor section 310 where the motor section 310 can drive the drill bit 304 (e.g., cause the drill bit 304 to rotate and deepen the borehole 303).

As shown, the motor section 310 can include a dump valve 312, a power section 314, a surface-adjustable bent housing 316, a transmission assembly 318, a bearing section 320 and a drive shaft 322, which can be operatively coupled to a bit such as the drill bit 304. The motor section 310 of FIG. 3 may be a POWERPAK family motor section (SLB, Houston, Texas) or another type of motor section.

A power section can convert hydraulic energy from drilling fluid into mechanical power to turn a bit. For example, consider the reverse application of the Moineau pump principle. During operation, drilling fluid can be pumped into a power section at a pressure that causes a rotor to rotate within a stator where the rotational force is transmitted through a transmission shaft and drive shaft to a bit.

FIG. 3 also shows examples of components 340 such as, for example, sensors 350, circuitry 360 and a geosteering actuator 370. As shown, the sensors 350 can include a conductivity and dielectric sensor 352, a gamma sensor 354 and one or more other sensors 356. As shown, the circuitry 360 can include a processor 362, memory 364 and one or more other types of circuitries 366. As shown, the geosteering actuator 370 can be operatively coupled to the circuitry 360 and the sensors 350. For example, the circuitry 360 can process signals (e.g., measurements or sensor data) of the sensors 350 to generate one or more commands for actuation of the geosteering actuator 370. In the example of FIG. 3, the geosteering actuator 370 may provide for one or more of PDM actuation and bent sub actuation, for example, to orient the drill bit 304.

Figure 4:
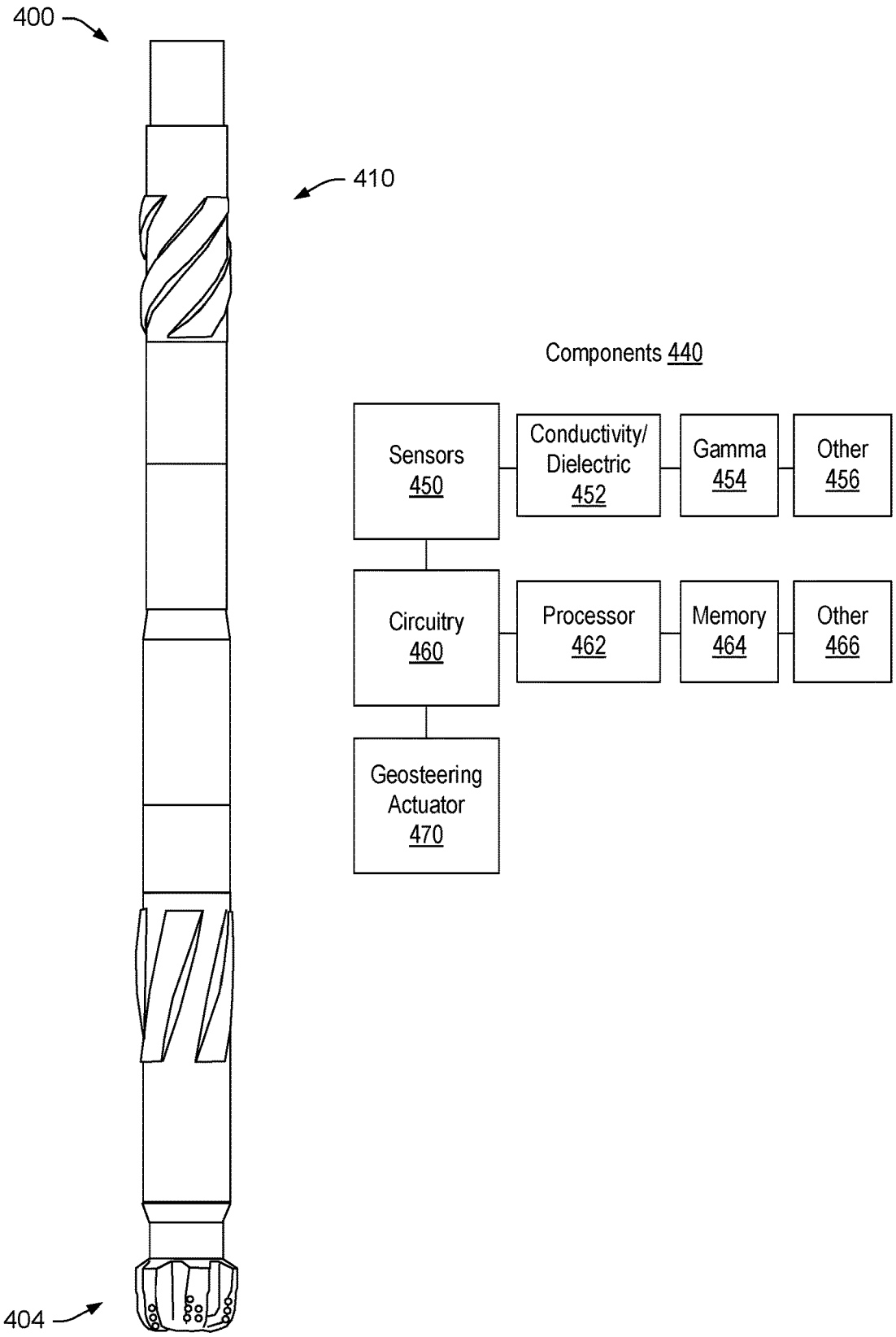
FIG. 4 illustrates an example of a portion of a drillstring that can include various components.

FIG. 4 shows an example of a drilling assembly 400 (e.g., a portion of a drillstring) that includes a drill bit 404 and a rotary steerable system (RSS) 410. As mentioned, an RSS can be utilized for directional drilling, including geosteering. As an example, the RSS 410 can include one or more features of a POWERDRIVE ARCHER RSS (SLB, Houston, Texas).

FIG. 4 also shows examples of components 440 such as, for example, sensors 450, circuitry 460 and a geosteering actuator 470. As shown, the sensors 450 can include a conductivity and dielectric sensor 452, a gamma sensor 454 and one or more other sensors 456. As shown, the circuitry 460 can include a processor 462, memory 464 and one or more other types of circuitries 466. As shown, the geosteering actuator 470 can be operatively coupled to the circuitry 460 and the sensors 450. For example, the circuitry 460 can process signals (e.g., measurements or sensor data) of the sensors 450 to generate one or more commands for actuation of the geosteering actuator 470. In the example of FIG. 4, the geosteering actuator 470 may provide for RSS actuation, for example, to orient the drill bit 404.

As an example, the drilling assembly 400 can include one or more of a near-bit continuous inclination and azimuth measurement unit or sub, a near-bit azimuthal gamma ray measurement unit or sub, and one or more other types of measurement units or subs.

As an example, a drilling assembly can include one or more types of circuitries. For example, consider a processing unit with a processor and associated memory where one or more sensors may generate signals that can be received by the processing unit. In such an example, the processing unit may perform computations that can utilize information in the signals (e.g., measurements, etc.) to generate commands for geosteering. In such an example, a drilling assembly may be capable of performing, at least in part, downhole geosteering according to geosteering commands generated downhole without transmission of information uphole to a controller and subsequent transmission of information downhole to geosteering equipment. In such an example, at least some types of geosteering processes may be performed more rapidly in response to sensor signals. For example, consider sensor signals indicative of one or more of presence of clay, an amount of clay, a type of clay, and a boundary as an interface between layers, where downhole geosteering equipment can act to steer a drill bit based on one or more of such sensor signals.

As an example, an electromagnetic conductivity measurement tool (ECM tool) can be implemented as a wireline tool and/or implemented as a LWD tool to generate permittivity and conductivity measurements at each frequency for one or more frequencies, which may be interpreted using a petrophysical model. In such an example, output parameters of the model can include water-filled porosity (e.g., hence water saturation if the total porosity is known) and water salinity ($C_w$). As an example, textural effects may be output for carbonates or cation exchange capacity (CEC) in various types of rock (e.g., shaly sands, etc.). For a well drilled with oil-base mud (OBM), calculated water salinity ($C_w$) can be the formation water salinity. As to CEC, inorganic and/or organic particles can exhibit CEC. Various clays can be characterized by CEC and organic particles with functional groups can be characterized by CEC. For example, kerogen can contribute to CEC in black shales and other rocks. Oxygen functional groups such as carboxyl groups of organic materials can contribute to CEC.

As explained, parameters that can be output using ECM tool measurements (e.g., induction, propagation, etc.) can include bulk formation cation exchange capacity (CEC), water saturation ($S_w$), connate water salinity ($C_w$), Archie cementation exponent and Archie saturation exponent. As an example, a method can provide for simultaneous formation salinity and water saturation determinations using in-phase and quadrature conductivities. As an example, a method can provide for simultaneous determinations as to at least two of formation salinity, water saturation, bulk formation CEC, Archie cementation exponent and Archie saturation exponent, using ECM tool measured in-phase and quadrature conductivities.

The Archie cementation exponent and the Archie saturation exponent can be found in the Archie equation for water saturation where $S_w^n$ is equal to $R_w$ divided by the product of $\phi^m$ and $R_t$ and where $S_w$ is the water saturation of an uninvaded zone, n is the saturation exponent (e.g., which may vary from approximately 1.8 to approximately 4.0), $R_w$ is the formation water resistivity at formation temperature, $\phi$ (or phi) is porosity, m is the cementation exponent (e.g., which may vary from approximately 1.7 to approximately 3.0) and $R_t$ is the true resistivity of the formation, corrected for invasion, borehole, thin bed, and other effects.

The Archie water saturation equation relates resistivity and fluid saturation. Various equations or models have been developed assuming that shale exists in one of various geometric forms. Such models can include a clean sand term, for example, described by the Archie water saturation equation, plus a shale term. The shale term may be fairly simple or quite complex; the shale term may be relatively independent of, or it may interact with, the clean sand term. Various models tend to reduce to the Archie water saturation equation when the fraction of shale is zero; noting that, for relatively small amounts of shaliness, various models may yield similar results. As to the term "clean sand", it can be a sand that has no shale or no shaliness and, as to the term "clean formation", it can be a formation that has no shale or no shaliness; noting that a shale or shaliness threshold value may be utilized, which may be greater than zero (e.g., a low percentage such as, for example, less than 3 percent), to classify a sand or a formation as effectively being "clean". The term "shaliness" can refer to the content of shale (or clay) in a dominantly non-shale formation; the degree to which ion-exchange processes contribute to resistivity measurements. As an example, electrical conduction in shales can be via an ion-exchange process whereby electrons move between exchange sites on the surface of clay particles. As an example, a threshold value for "clean" (e.g., effectively clean) may be determined based on utilization of data for a formation factor (F) versus formation water resistivity ($R_w$) where, for example, F remains substantially constant with respect to increasing $R_w$ for a clean sand and where F decreases with respect to increasing $R_w$ for a shaly sand; noting that, in a shaly sand, for lower values of $R_w$, the decrease in F may be less than for higher values of $R_w$. In various instances, a decrease in F at a value of $R_w$ can depend on amount or level of shaliness of a shaly sand. As an example, a threshold value for shaliness to classify a formation or a sand as clean may depend on one or more factors (e.g., as may be determined via a plot of F versus $R_w$, etc.).

One type of model is the Dual Water model, which may model shaly formations. The Dual Water model considers two classes of water in pore space: far water, which is the normal formation water; and near water (or clay-bound water) in the electrical double layer near the clay surface. The Dual Water model may be explained with respect to the following three premises: conductivity of clay is because of its CEC; CEC of pure clays is proportional to the specific surface area of the clay; and, in saline solutions, anions are excluded from a layer of water around the surface of the grain where thickness of this layer expands as the salinity of the solution (e.g., below a certain limit) decreases, and the thickness is a function of salinity and temperature. As CEC is proportional to specific area (area per unit weight) and to the volume of water in a counter-ion exclusion layer per unit weight of clay, conductivity of clay tends to be proportional to the volume of the counter-ion exclusion layer, this layer being "bound" to the surface of the clay grains. For clays, this very thin sheet of bound water has relevance because of the large surface areas of clays relative to sand grains (e.g., several magnitudes greater). Therefore, in the Dual Water model, a clay can be modeled as include bound water and clay minerals as components. In such an approach, clay minerals may be modeled as being electrically inert; and the clay electrical conductivity may be modeled as being derived from the conductivity of the bound water, which may be assumed to be independent of clay type. The amount of bound water can vary according to clay type, for example, being higher for finer clays (e.g., with higher surface areas), such as montmorillonite, and lower for coarser clays, such as kaolinite. Salinity also has an effect; in low-salinity waters (e.g., roughly <20,000 ppm NaCl), the diffuse layer expands. In the Dual Water model, porosity and water saturation of a sand (e.g., clean formation) phase (e.g., which may be a nonclay phase) of a formation may be obtained by subtracting the bulk-volume fraction of bound water. The Dual Water model can also include parameters for the Archie saturation exponent and the Archie cementation exponent.

As mentioned, a method can provide for simultaneous determination of parameters using ECM tool measurements. For example, a method can simultaneously solve for two of three formation parameters by using in-phase and quadrature conductivity measurements from ECM wireline (WL) and/or ECM logging-while-drilling (LWD) tools. In such an example, unknown formation parameters solved for can be two or more of a group of formation parameters that can include one or more of bulk formation cation exchange capacity (CEC), water saturation ($S_w$), connate water salinity ($C_w$), Archie cementation exponent (m), and Archie saturation exponent (n). When a sufficient number of such formation parameters is known, which may be via one or more other types of measurements, two of the remaining formation parameters can be simultaneously solved for using two input conductivities. Such a method can apply to one or more types of low frequency electromagnetic measurements that may be affected by interfacial polarization effects from constituents in a formation. Generally, such effects may be seen at frequencies below approximately 400 kHz; noting that a tool or tools may be utilized that generally operates at energy emission frequencies that are greater than approximately 400 kHz. In various examples, one or more tools may be utilized that may provide for frequencies less than 400 kHz and/or greater than 400 kHz (e.g., consider 100 kHz, 400 kHz, and 2 MHz, etc.).

Various wireline (WL) and logging while drilling (LWD) tools can measure both in-phase and quadrature conductivities. Several minerals create a sufficiently large quadrature signal that may be measured. As an example, a method can include acquiring in-phase and quadrature conductivities for a formation and characterizing particles (e.g., inorganic particles such as clay minerals, organic particles, etc.) in the formation that contribute to the in-phase and quadrature conductivity. In such an example, there can be an implication that a formation lacks other dielectric producing minerals such that particles (e.g., clay minerals, etc.) are present in sufficient quantities to contribute to measurable quadrature conductivity. A WL tool or a LWD tool can include circuitry that provides for acceptable accuracy and precision to measure quadrature conductivity that has been created by particle volumes in a formation.

As an example, solving for formation $S_w$ and salinity simultaneously can assist in characterization, operations, etc., particularly when salinity is variable or unknown within the formation and when bulk CEC can be calculated from spectroscopy or other measurements. Formation salinity tends to be unknown such that it becomes a manually determined parameter that is input by a petrophysicist. Using a supplied salinity, $S_w$ may then be computed, for example, via shaly sand equations. In cases where a field has been water flooded or where a formation is subject to aquifer recharge, salinity is often unknown and variable in each permeable formation. As mentioned, a method can provide for simultaneously solving for $S_w$ and salinity in a manner that allows for a more accurate $S_w$ calculation. As an example, a method may be applied to instances where salinity is known such that $S_w$ and CEC can be solved for simultaneously. As an example, in instances where $S_w$ is known, a method can include solving for CEC and salinity simultaneously.

Figure 5:
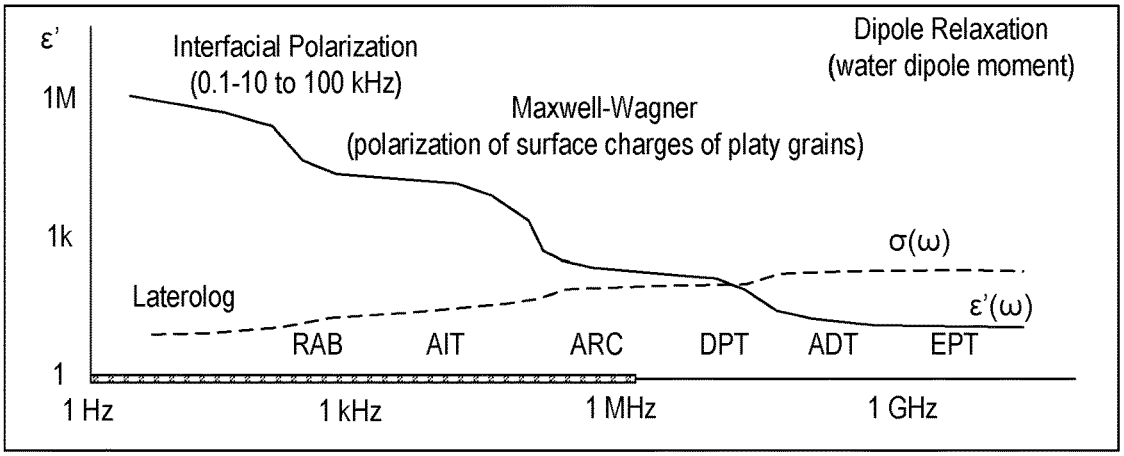
FIG. 5 illustrates an example of a plot and examples of logs.
Figure 5:
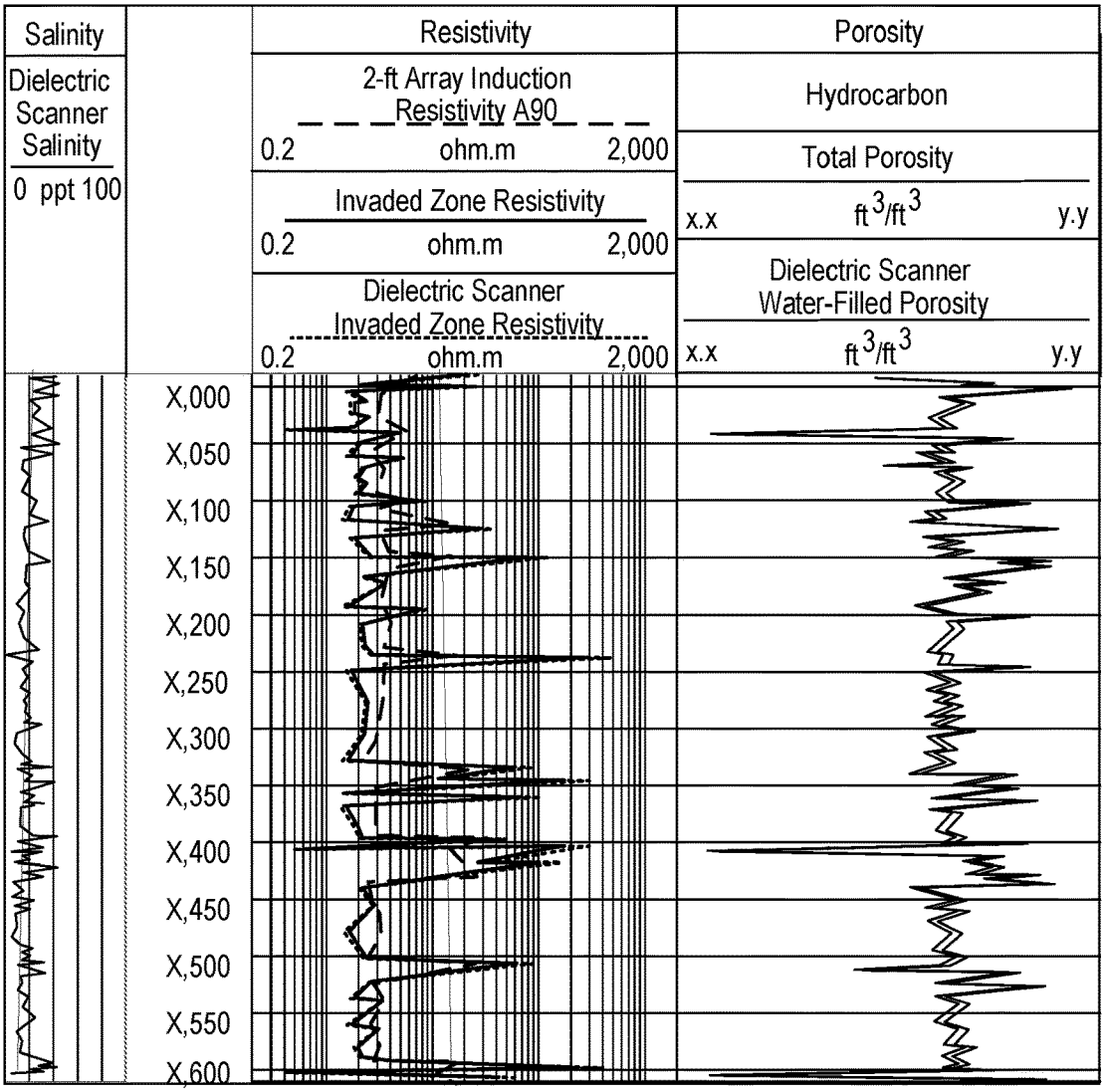

FIG. 5 shows an example of a plot 510 of permittivity versus frequency and an example of logs 520 from a dielectric scanner tool; noting that an ECM tool can operate at frequencies that are less than those of a dielectric scanner tool. In the plot 510, various frequency dependent physical phenomena are shown along with conductivity (σ) and dielectric constant (ε'). Tool acronyms are also shown, including laterolog operational at 35 Hz and 280 Hz, resistivity at bit (RAB) operational at 1.5 kHz, array induction tool (AIT) operational at 26 kHz and 52 kHz, compensated array resistivity (ARC) operational at 0.4 MHz and 2 MHz, dielectric propagation tool (DPT) operational at 25 MHz, array dielectric tool (ADT) operational at 0.9 GHz and electromagnetic propagation tool (EPT) operational at 1.1 GHz. In the plot 510, various frequencies can be approximate, noting that a particular tool (e.g., laterolog, RAB, AIT, ARC, DPT, ADT, EPT, etc.) may operate at a narrower range, a greater range, etc., than the frequencies listed or appearing in the plot 510. In terms of frequency, an approximate frequency value may be plus or minus fifteen percent a stated frequency value. For example, approximately 100 kHz may be 85 kHz to 115 kHz. Again, the plot 510 shows relative effects of frequency on measured conductivities and dielectric constants for earth formations. Various underlying physics responsible for the effects are indicated. As explained, one or more tools may operate at a number of frequencies, for example, ADT frequencies can include 24, 100, 350, 960 MHz; whereas, an ECM tool (e.g., consider an AIT) can operate at various frequencies that are less than ADT frequencies.

As an example, a dielectric scanner tool (e.g., ADT), as a wireline tool and/or as a drilling tool, can include a relatively short, multispacing antenna array pad. In such an example, each cross-dipole antenna can be collocated with magnetic dipoles. As an example, transmitters (e.g., TA and TB) can be located centrally while receivers (e.g., RA1-4 and RB1-4) can be placed symmetrically around the transmitters for improved measurement accuracy and borehole compensation. To minimize environmental effects, a short, fully articulated antenna pad can be applied firmly against a borehole wall, for example, by a hydraulically operated eccentering caliper to enable appropriate pad contact, even in rugose boreholes. During operation, electromagnetic waves can be generated and propagated into the formation at multiple frequencies (e.g., consider four frequencies) with multiple polarizations (e.g., consider two polarizations) to promote high-resolution, high-accuracy measurements of reservoir properties at a distance into the formation, which may be, for example, up to approximately 10 cm (e.g., 4 inches) in from a borehole wall.

As shown in the plot 510, a laterolog tool can operate at the lower end of the electromagnetic frequency spectrum. A laterolog is a type of resistivity log as acquired by a laterolog tool that can use guard or bucking electrodes that aim to force current to flow nearly at right angles to the laterolog tool. For example, a laterolog tool can provide current that can be fed into bucking electrodes where sensing electrodes can be used to adjust bucking-electrode currents. A dual laterolog tool may measure resistivity at different depths of penetration. An array laterolog tool can determine resistivities by processing data from an array of detectors rather than by focusing current.

As shown in the plot 510, an EPT can operate at the higher end of the electromagnetic frequency spectrum. An EPT can provide for measurement using a high operational frequency (e.g., approximately 1 GHz) to determine dielectric properties of a formation. For example, consider an EPT that includes a GHz microwave transmitter that can be positioned a distance below two receivers separated by approximately 4 cm. At approximately 1 GHz, the response can be explained as the propagation of a wave. Thus, the phase shift and attenuation of the wave between the receivers can be measured and transformed to give log measurements of propagation time and attenuation. Because of the short spacings, an EPT produces exceptional vertical resolution and can generally be utilized within centimeters of a borehole wall (e.g., depending on resistivity). Different transmitter and receiver spacings and orientations can be used, leading to different arrays, such as an endfire array and a broadside array. An ideal measurement would give the plane wave properties of the formation. However, the geometry of the measurement tends to preclude this such that a spreading-loss correction is employed for the attenuation and to a smaller extent for the propagation time. EPT measurements can also be affected by dielectric properties and thickness of mudcake; noting that borehole compensation can adjust for EPT tilt or a rough borehole wall.

As to the DPT, in the plot 510, it is shown as associated with frequencies above 1 MHz and less than 1 GHz. In terms of tool notation, "dielectric propagation" as in DPT differs from "electromagnetic propagation" as in EPT, while both utilize electromagnetic energy. As to DPT measurements, they can refer to logs that measure the properties of electromagnetic waves as they move through a formation. For example, propagation resistivity logs may be between approximately 100 kHz and 10 MHz and other propagation logs may be between 20 MHz and 200 MHz. As explained, logs at frequencies above 200 MHz and into the GHz range are referred to as electromagnetic propagation logs as acquired from an EPT. Below approximately 100 kHz, various types of measurements can be based on properties of standing waves, rather than propagation. Induction and laterolog tools can operate in ranges that include electromagnetic frequencies at or below 100 kHz.

As an example, an induction tool (e.g., AIT), as a type of ECM tool, can include multiple coil arrays that aim to optimize vertical resolution and depth of investigation. As to operation of an induction tool, a receiver coil and a transmission coil can be operatively coupled to circuitry for operation at one or more frequencies. As an example, coils can be mounted coaxially on a mandrel. As an example, a coil separation may be in a range from approximately 30 cm (e.g., 1 ft) to approximately 300 cm (e.g., 10 ft). As an example, a coil can be defined by a number of turns, for example, a coil can have from approximately several turns to approximately 100 turns or more. As to operating frequency or frequencies, a tool may operate at relatively discrete frequencies in a range from approximately tens of kHz to hundreds of kHz.

In the example of FIG. 5, in the logs 520, a log of salinity with respect to depth is shown along with logs of resistivity and porosity with respect to depth where the resistivity log shows array induction resistivity (2 ft, A90), invaded zone resistivity and dielectric scanner invaded zone resistivity and where the porosity log includes total porosity and dielectric scanner water-filled porosity, and optionally hydrocarbons (e.g., based at least in part on water-filled porosity). In the logs 520, various tracks rely on ADT measurements, which, as explained per the plot 510, are acquired at a higher frequency or frequencies than AIT measurements.

As explained, a method can utilize ECM tool measurements for simultaneous generation of output of two or more of salinity, water saturation, CEC, Archie cementation exponent and Archie saturation exponent. Such a method can be performed without use of an ADT or ADT measurements; noting that, for one or more reasons, an ADT and ADT measurements may be utilized when characterizing a formation, performing a portion of a method, etc.

Referring again to the plot 510, it shows various mechanisms responsible for the effects of formation conductivity and dielectric as a function of frequency. As an example, a method can include acquiring measurements from a tool or tools that can operate using one or more frequencies in a range such as, for example, a range of frequencies from DC to 100 kHz or even to 2 MHz where interfacial polarization (IPol) effects tend to dominate. In various examples, frequencies may be below 2 MHz and, in some instances, below 100 kHz. As indicated in the plot 510, above approximately 2 MHz, Maxwell-Wagner surface charge effects start to dominate. As an example, a method can include using the Misra model to predict IPol effects, which can occur at frequencies in the MHz range that tend to be diminished compared to the response at the lower frequencies. At higher frequencies (e.g., ~100 kHz to ~2 MHz) and above, a Maxwell-Wagner model may be more appropriate especially from 2 MHz to several hundred MHz (e.g., approximately 300 MHz). As an example, a method may include acquiring measurements at frequencies higher than in an IPol range and extrapolating a fitting function and/or a model down to a value or values that would have been measured at a lower frequency where IPol effects dominate.

In various examples, modeling can pertain to lower frequencies where IPol effects can be expected to be the dominate mechanism affecting conductivity and dielectric measurements. For ranges where Maxwell-Gardner effects dominate, one or more models may be selected and utilized that account for conductivity and dielectric. Imaginary conductivity and dielectric are related quantities, and these terms can be used interchangeably.

$$\varepsilon'_r = \frac{\sigma_{imag}}{\omega\varepsilon_0}$$

In the foregoing equation, $\varepsilon'_r$ is the dielectric constant, $\sigma_{imag}$ is the imaginary conductivity, co is the frequency and $\varepsilon_0$ is the permittivity of free space or a vacuum. In various instances, the dielectric constant may be referred to as epsilon and may be represented using $\varepsilon$ or $\in$, for example, without a superscript or a subscript.

A US Provisional Application having Ser. No. 63/398,690, filed 17 Aug. 2022, and a US Patent Cooperation Treaty (PCT) Application having Serial No. PCT/US2023/071914, filed 9 Aug. 2023, claiming priority thereto, are incorporated by reference herein in their entirety, and describe various inversion techniques. As an example, an inversion may be performed using downhole circuitry and/or uphole circuitry (e.g., surface circuitry). As an example, a drillstring can include a processor, memory and executable instructions to perform an inversion where, for example, one or more results of the inversion can be utilized for purposes of geosteering.

As an example, a processor-based inverter can be configured to perform one or more types of simultaneous inversions. For example, consider an inverter that can perform a salinity-$S_w$ inversion, a CEC-$S_w$ inversion and/or a salinity-CEC inversion, which may be selectively performed (e.g., according to one or more criteria, etc.). As to a salinity-CEC inversion, it may utilize a sigma data for $S_w$ as input.

As an example, an inverter or inversion application can provide for analyzing complex conductivity core data. In such an example, a routine such as, for example, the MATLAB FSOLV minimization routine (MATHWORKS, Natick, Massachusetts) can be implemented to solve for $S_w$ and salinity simultaneously for a number of salinities and core samples of core data. Such an approach can include making adjustments to data such as, for example, overweighting certain measurements relative to other measurements. An inverter can include one or more of the Wael, Simone and Revil equations for an imaginary conductivity forward model, optionally along with Dual Water formulas for in-phase conductivity. As an example, an inverter can utilize a measurable quadrature conductivity for low frequency in an Revil IPol forward model approach. As clean formations will not have a measurable signal, such an approach can be utilized where there is some clay in a formation where the amount of clay can depend on factors such as frequency and signal to noise ratio of a measurement tool.

As an example, a method can include utilizing measurements and electromagnetic theory to relate formation dielectric constant ($\varepsilon'_r$) at propagation frequencies, for example, of approximately 100 kHz to approximately 2 MHz, to surface area to volume ratio (SAV). For example, formation dielectric constant ($\varepsilon'_r$) can be shown to be positively correlated and a function of the surface area to volume ratio (SAV).

SAV is mostly controlled by the volume of clay and to a lesser extent by the grain size and sorting. Therefore, the propagation dielectric constant is primarily controlled by clay induced Maxwell-Wagner effects; noting that Maxwell-Wagner effects tend to dominate at propagation frequencies and that Maxwell-Wagner effects are due to surface charge polarizations.

In geosteering, orientation decisions can depend on location of a resistivity boundary and value of resistivity of a bed in which a well (e.g., a lateral well) is placed in along with resistivity of one or more adjacent beds. During geosteering, an issue may arise where an adjacent, non-crossed clean water bearing formation and a clay rich shale can have approximately the same resistivity thereby making them indistinguishable. In general, a water bearing formation is to be avoided and steered away from to reduce risk of water encroachment or water entry into a well. In contrast, a clay rich shale formation can be approached or steered closely to without increasing the risk of consequences from a water bearing formation. While a clean water bearing formation may have approximately the same resistivity as a clay shale formation, the formation dielectric constant values of each will be dramatically different. Thus, through use of dielectric measurements, geosteering can be improved. For example, a method can improve geosteering using dielectric measurements to differentiate between two beds that may have similar resistivity such that a geosteered borehole have a reduced risk of water breakthrough.

Figure 6:
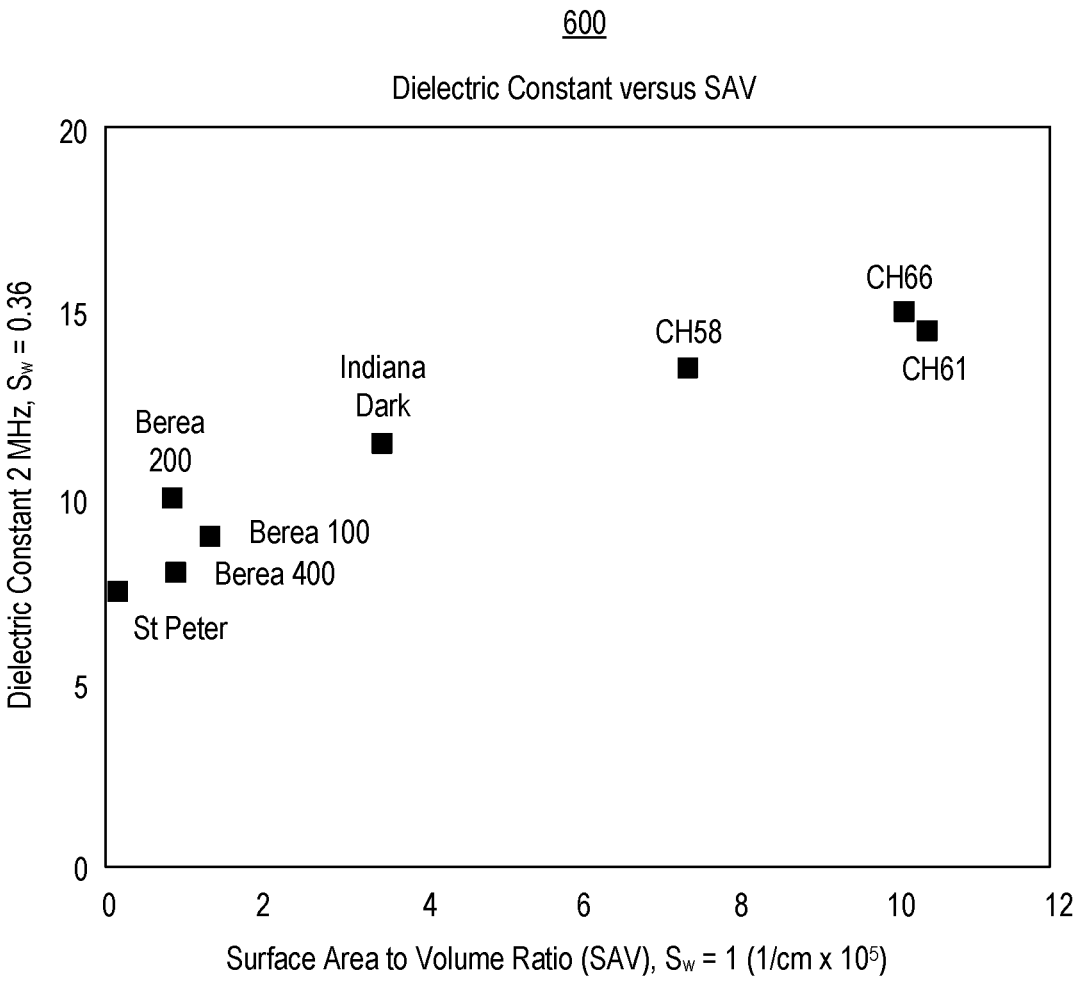
FIG. 6 illustrates an example of a plot.

FIG. 6 shows an example of a plot 600 of dielectric constant versus surface to volume ratio. The plot 600 is an analysis of data from an article by Knight and Nur, "The Dielectric Constant of Sandstones, 60 kHz to 4 MHz", Geophysics, Vol 52, No. 5, pp. 644-654 (1987), which is incorporated by reference herein in its entirety and referred to as Knight-Nur. The plot 600 demonstrates that the measured formation dielectric constant increases as SAV increases. Hence, dielectric constant correlates with SAV.

Figure 7:
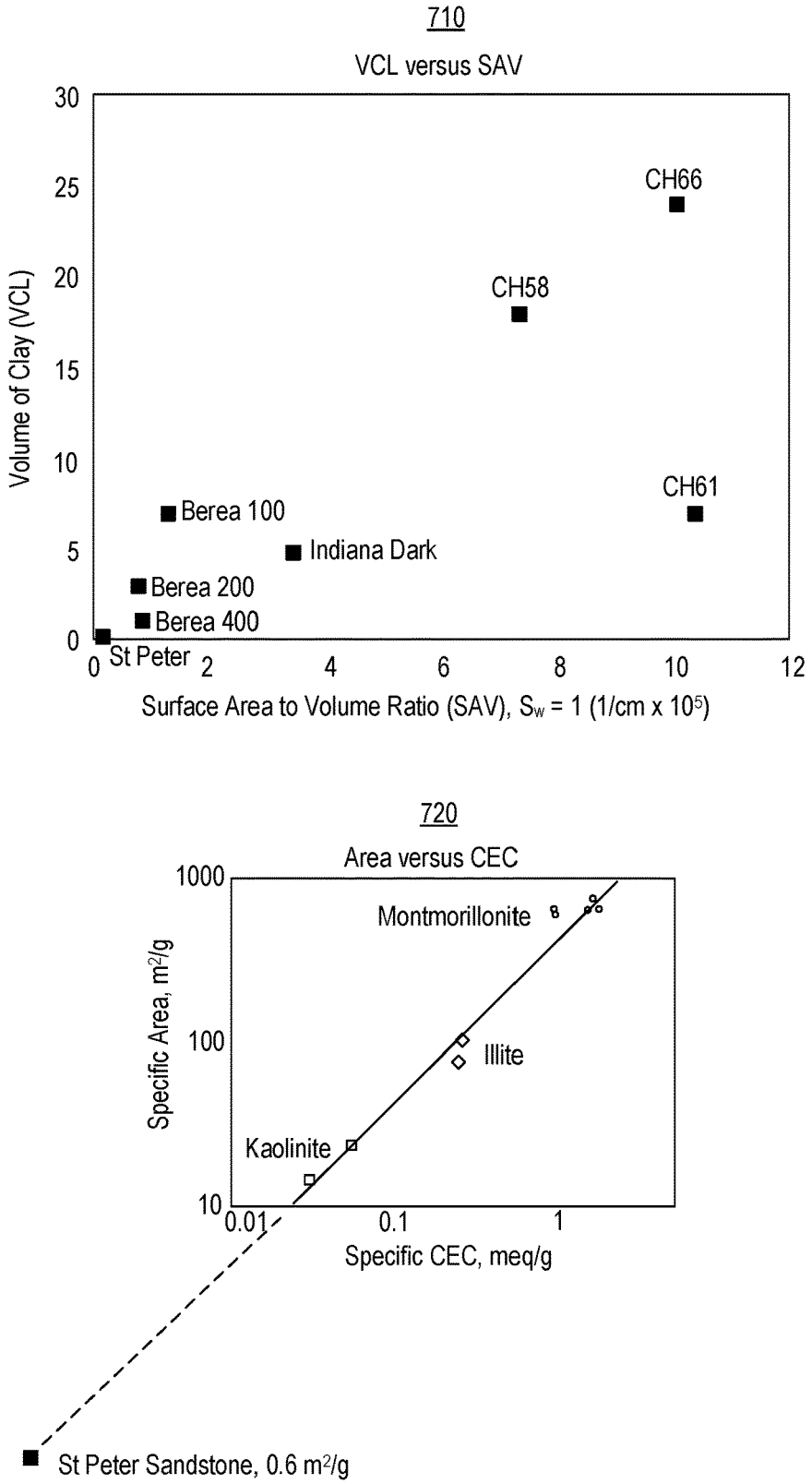
FIG. 7 illustrates examples of plots.

FIG. 7 shows examples of plots 710 and 720 where the plot 710 shows volume of clay (VCL) versus S/V and where the plot 720 shows relation between specific CEC and specific area for API standard clays, specifically montmorillonite, illite, and kaolinite. Additionally, a line is extrapolated from the data in the plot 720 for St. Peter sandstone, which has a specific area of approximately 0.6 $m^2/g$, which is approximately 170 times lower than the specific area of illite. The plot 710 demonstrates that S/V is primarily a function of VCL. As to St. Peter sandstone, it is an Ordovician geological formation and belongs to the Chazyan stage of the Champlainian series in North American regional stratigraphy, equivalent to the late Darriwilian global stage. St. Peter sandstone originated as a sheet of sand in clear, shallow water near the shore of a Paleozoic sea and consists of fine-to-medium-size, well-rounded quartz grains with frosted surfaces.

In general, clays tend to have the largest SAV of the constituents in normal formations. Hence, there exists a positive correlation of SAV with VCL as shown in the plot 710. As shown in the plot 720, the specific surface area value of montmorillonite is larger than illite while the specific surface area of kaolinite is less and the specific area of St. Peter sandstone considerably less. The specific surface area and SAV can be derived from each other using grain density and porosity. Therefore, they tend to be highly correlated to each other and clays with a high specific surface area also have a high SAV. In the plot 710, some of the scatter may be due to various samples having trace amounts of clays other than illite present. In the plot 710, the data point for CH61 falls outside the trend, which may be due to an undercount of the thin section point count of VCL. This core has the highest SAV, the lowest porosity, and the lowest permeability of all the cores, leading to a conclusion that its VCL is an undercount.

Figure 8:
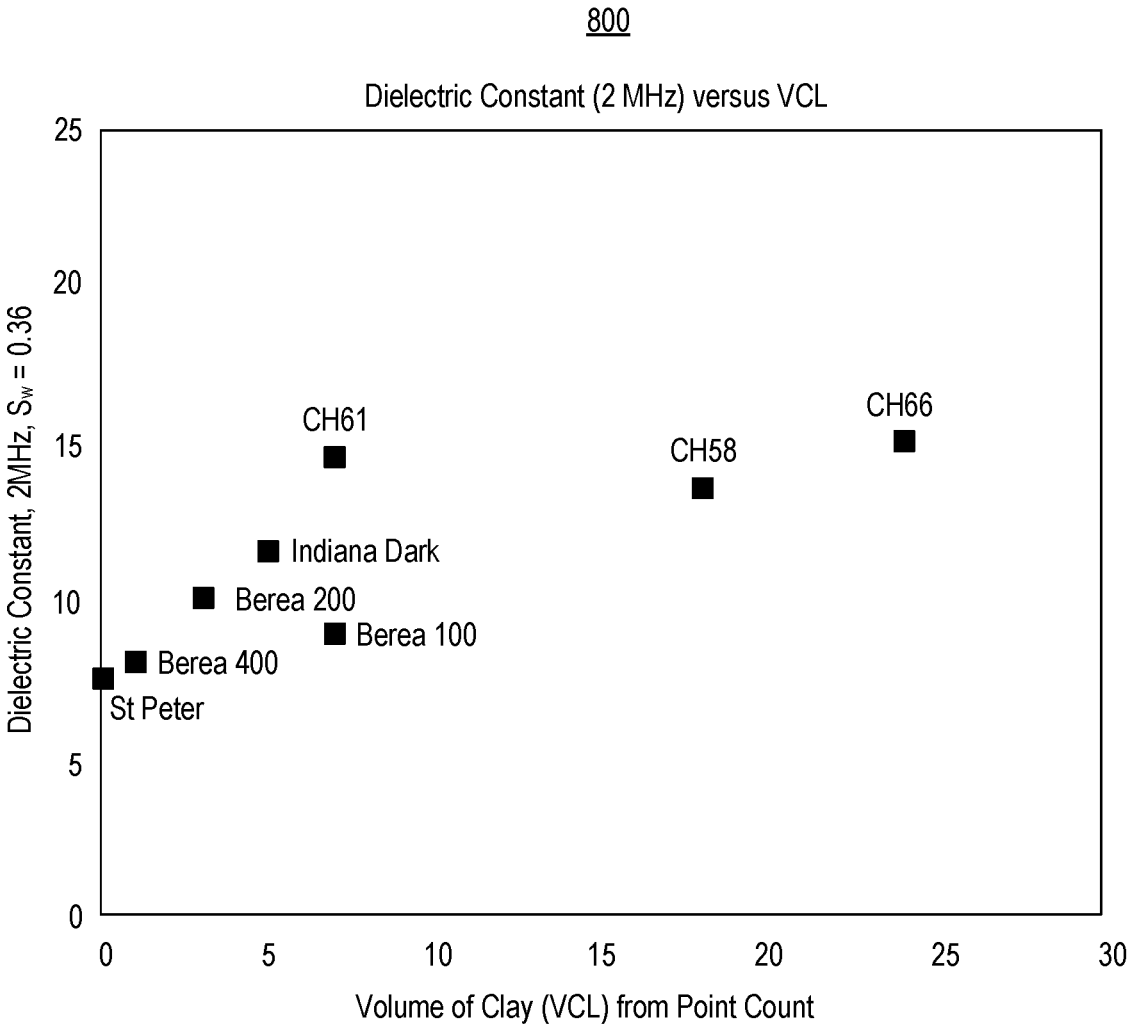
FIG. 8 illustrates an example of a plot.

FIG. 8 shows an example of a plot 800 of dielectric constant versus VCL. As both formation dielectric constant and VCL correlate with SAV, formation dielectric constant correlates with VCL, noting a positive correlation of formation dielectric constant to VCL. The core without clay (St. Peter sandstone) has a formation dielectric constant of 7.5 while the CH66 sample with VCL of 24 percent has a formation dielectric constant of 15, a doubling of formation dielectric constant for a 24 percent increase of VCL.

Figure 9:
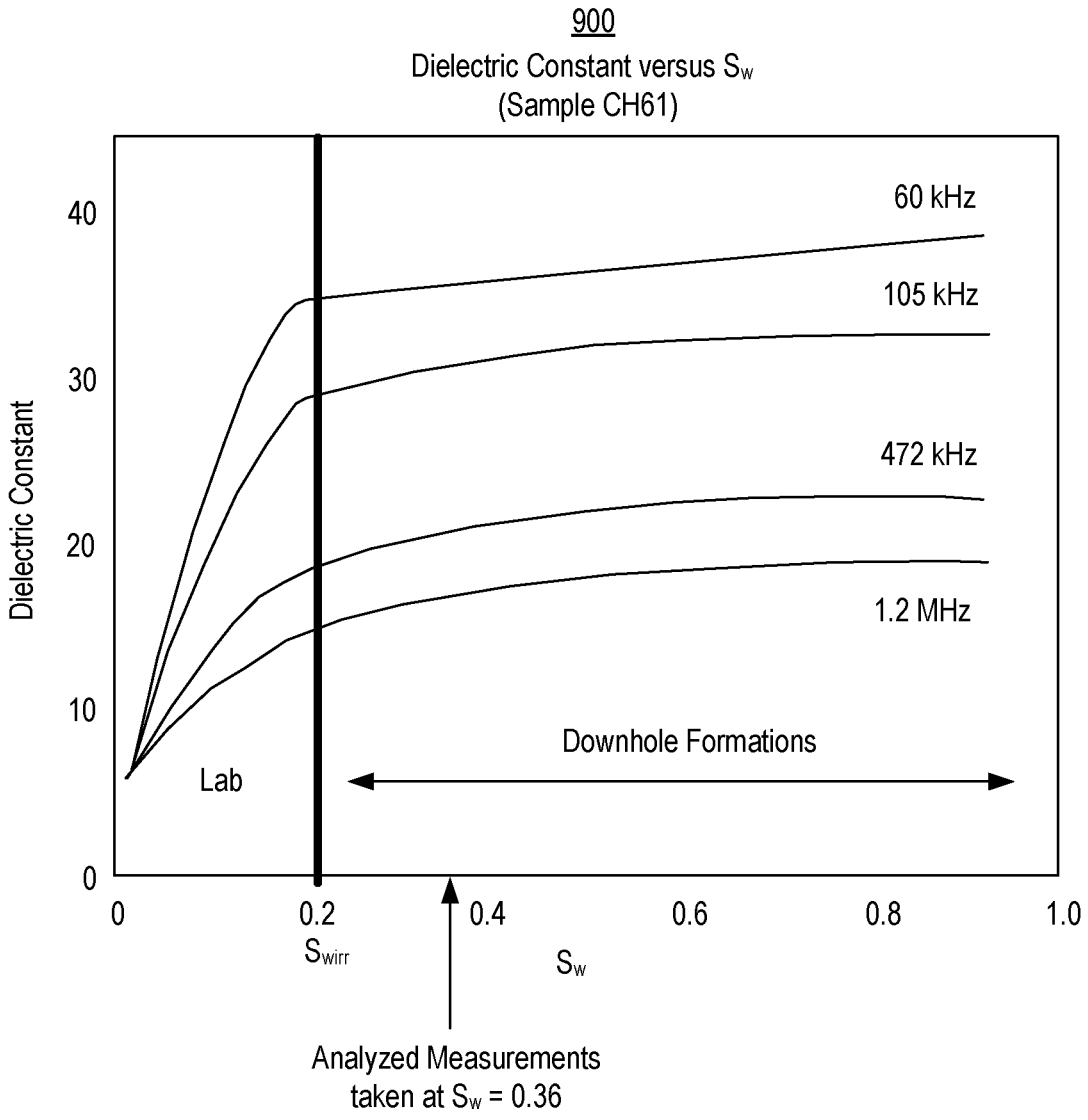
FIG. 9 illustrates an example of a plot.

FIG. 9 shows an example of a plot 900 of dielectric constant versus $S_w$ for the CH61 core sample at four frequencies (60 kHz, 105 kHz, 472 kHz, and 1.2 MHz). The formation dielectric constant at $S_w$=0.36 is slightly lower than the formation dielectric constant at $S_w$=1 for the four frequencies. The measured formation dielectric constant is relatively insensitive to water filled porosity above $S_w=S^{wirr}$. The plot 900 demonstrates that there is a slight dependance of formation dielectric constant on $S_w$ when $S_w$ is greater than $S_{wirr}$ (irreducible water saturation). The data of the plot 900 further demonstrate the relative insensitivity of formation dielectric constant to water filled porosity at various frequencies especially in the range of propagation measurements. The region in the plot 900 where $S_w$ drops below $S_{wirr}$ is obtainable in the laboratory and not in-situ as $S_w$ does not drop below $S_{wirr}$ downhole.

As an example, a method can include modeling the effect of VCL on formation dielectric constant, which may provide for effectively removing it, such that the remaining effect on formation dielectric constant can be computed. In such an example, if the rock (clay and matrix) is hydrocarbon wet, the formation dielectric constant will likely approach the matrix values and read noticeably low and lower than predicted by a water wet model. As an example, a petrophysical model that incorporates rock wettability may be used to flag rock wettability even though the sensitivity of formation dielectric constant to free water volumes is relatively insignificant.

Figure 10:
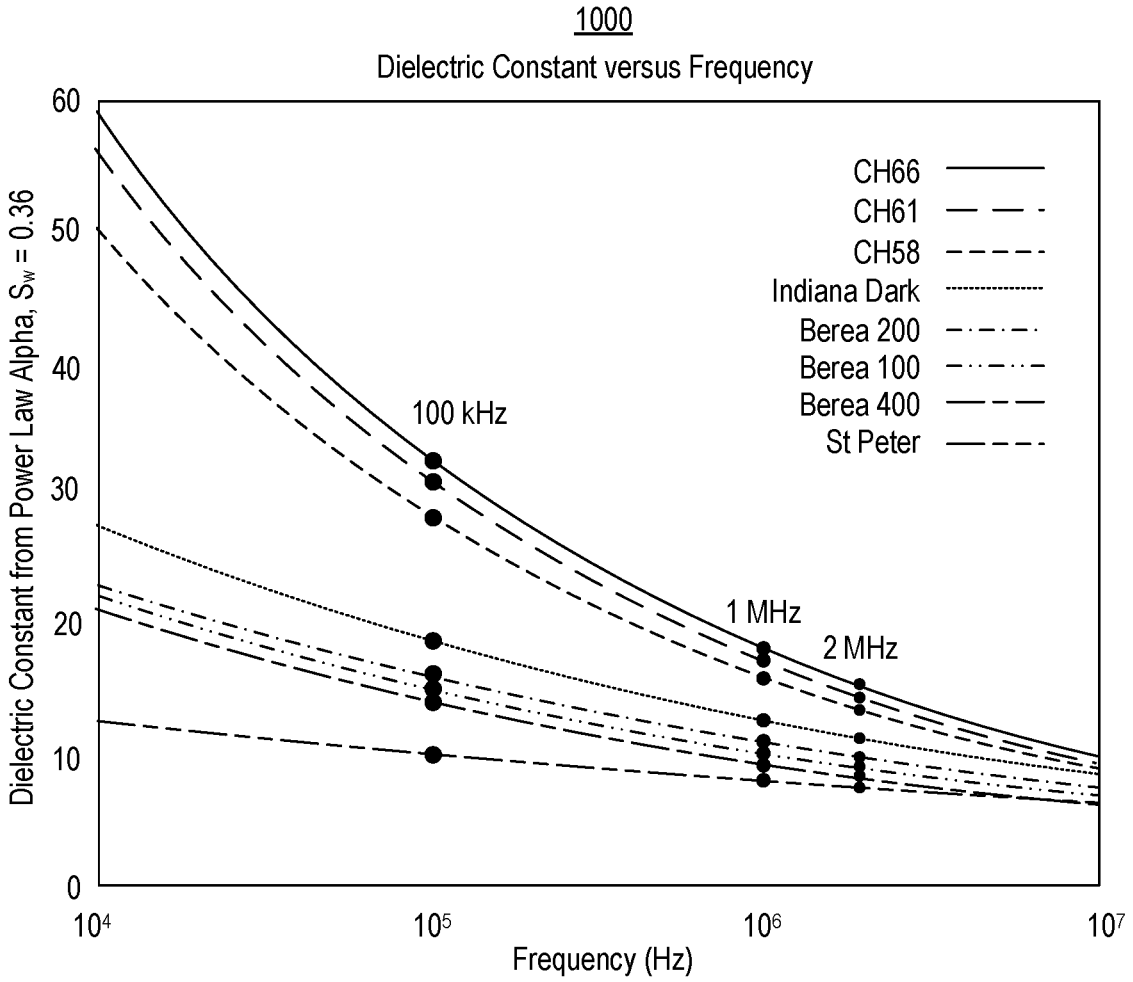
FIG. 10 illustrates an example of a plot.

FIG. 10 shows an example of a plot 1000 of dielectric constant from a power law model versus frequency for various samples. The plot 1000 demonstrates how the formation dielectric constant at other propagation frequencies compares to the formation dielectric constant at 2 MHz (e.g., as shown in FIGS. 6, 7 and 8). Specifically, the plot 1000 shows three of the measurements of formation dielectric constant versus frequency for eight core samples. The formation dielectric constant at any one frequency is monotonic compared to any other frequency, i.e., the order between the various core sample data remains the same regardless of frequency. This implies that our interpretation of the 2 MHz data will apply at 400 kHz, and 100 kHz, which can be common LWD tool propagation frequencies.

As explained, a method can include utilizing dielectric information for purposes of geosteering. In such an example, geosteering can be performed using at least measured formation dielectric constant at one or more propagation frequencies. As mentioned, the plot 1000 demonstrates that observations made at 2 MHz as to order between the various core samples are valid at 400 kHz and at 100 kHz. Therefore, a formation dielectric constant computed from directional LWD measurements ranging from approximately 100 kHz and below to approximately 2 MHz can be used for geosteering. For example, consider a method where phase and attenuations from such measurements are inverted for formation dielectric constant and conductivity simultaneously, which may be performed in a manner akin to an inversion for non-directional propagation measurements. For example, consider one or more of the techniques described in U.S. Pat. No. 11,150,373 B2, issued 19 Oct. 2021, and entitled "Determining dielectric constant and resistivity with induction measurement", which is incorporated by reference herein in its entirety.

Figure 11:
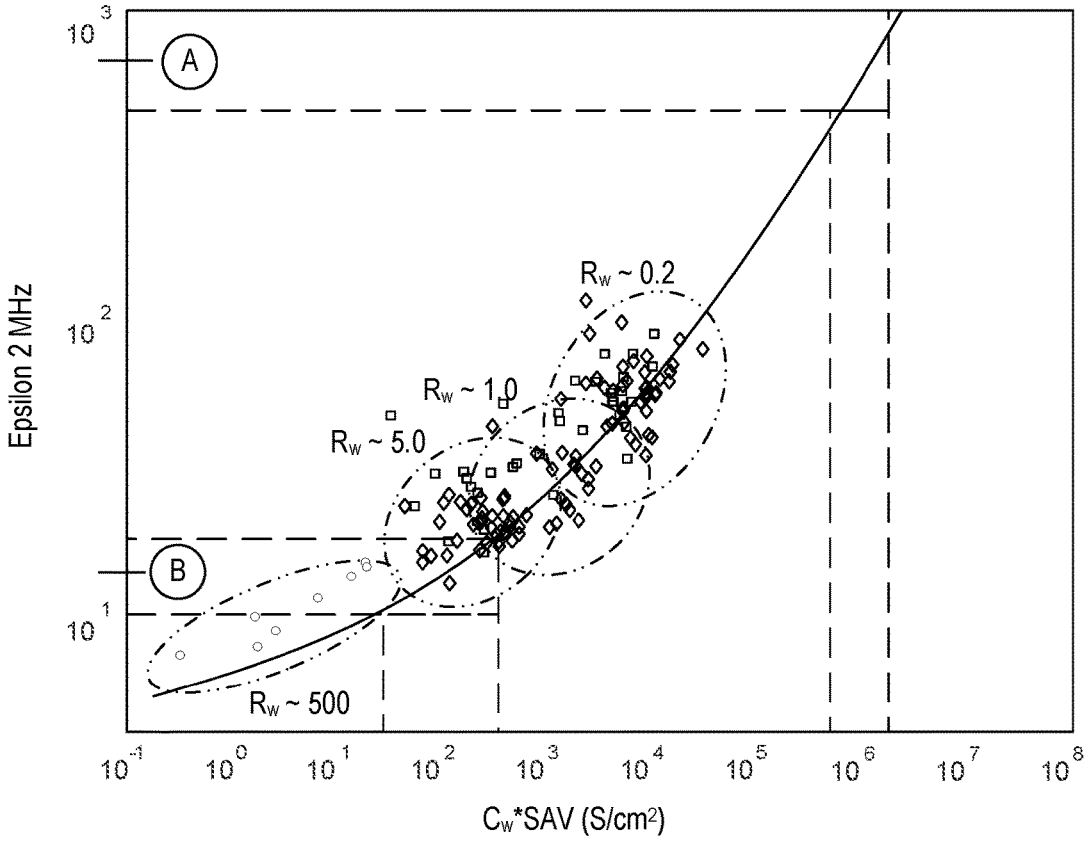
FIG. 11 illustrates an example of a plot.

FIG. 11 shows an example of a log-log plot 1100 of dielectric constant versus water salinity ($C_w$) multiplied by surface area to volume ratio with units of S/cm$^2$ for a frequency of 2 MHz where different regions are identified, which include a region spanning approximately 50 to 500 S/cm$^2$ with associated dielectric constant values and another region spanning approximately 500,000 to 5,000,000 S/cm$^2$ with associated dielectric constant values. As shown, sandstone and carbonates (shown with markers as diamonds and squares, respectively) generally have values greater than approximately 100 S/cm$^2$, ranging up to approximately 100,000 S/cm$^2$; noting a range of formation water resistivities, $R_w$, ranging from approximately 0.2 to approximately 5 for carbonates and ranging from approximately 0.2 to approximately 10 for sandstones.

As shown in the plot 1100 of FIG. 11, a curve may be fit to the data, which may be fit for an entire data set and/or for portions of the data. For example, consider fitting a curve to the entire data set and formulating one or more equations for one or more portions of the data set, which may include one or more equations that extend to values beyond those of the data set.

Figure 12:
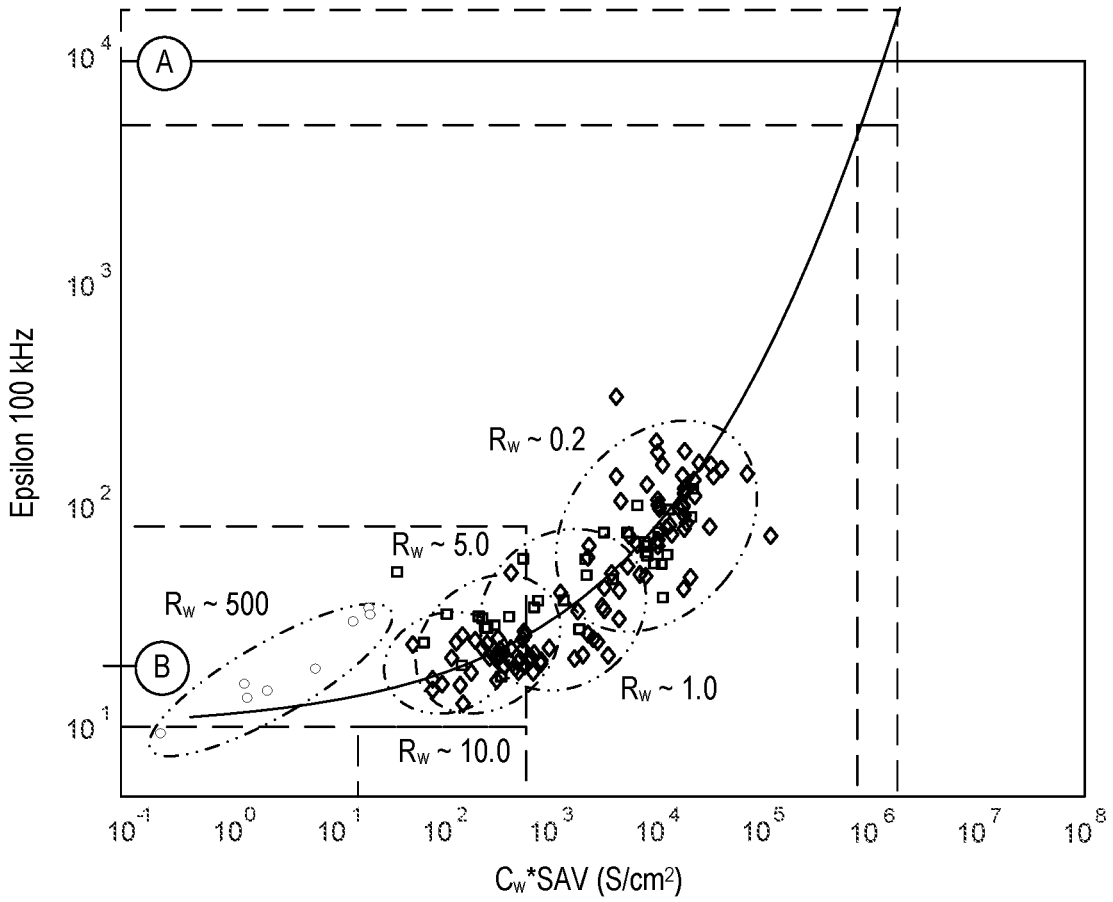
FIG. 12 illustrates an example of a plot.

FIG. 12 shows an example of a log-log plot 1200 of dielectric constant versus water salinity ($C_w$) multiplied by surface area to volume ratio with units of S/cm$^2$ for a frequency of 100 kHz where different regions are identified, which include a region spanning approximately 50 to 500 S/cm$^2$ with associated dielectric constant values and another region spanning approximately 500,000 to 5,000,000 S/cm$^2$ with associated dielectric constant values As shown, sandstone and carbonates (shown with markers as diamonds and squares, respectively) generally have values greater than approximately 100 S/cm$^2$, ranging up to approximately 100,000 S/cm$^2$; noting a range of formation water resistivities, $R_w$, ranging from approximately 0.2 to approximately 5 for carbonates and ranging from approximately 0.2 to approximately 10 for sandstones.

As shown in the plot 1200 of FIG. 12, a curve may be fit to the data, which may be fit for an entire data set and/or for portions of the data. For example, consider fitting a curve to the entire data set and formulating one or more equations for one or more portions of the data set, which may include one or more equations that extend to values beyond those of the data set.

An article by Taherian et al., "Measurement of dielectric response of water-saturated rocks", Geophysics, Vol. 55, No. 12, pp. 1530-1541 (1990), which is incorporated by reference herein in its entirety, provides Cole-Cole fitting coefficients for dielectric measurements of cores over a frequency range of 10 MHz to 1300 MHz. As an example, such coefficients may be utilized to compute extrapolated dielectric constants at lower frequencies, for example, consider frequencies of 2 MHz, 400 kHz and 100 kHz. The plots 1100 and 1200 of FIGS. 11 and 12 provide evidence that the formation dielectric constant is monotonically increasing as frequency decreases for a given core. As an example, a method can include using Cole-Cole coefficients to predict the dielectric constant at one or more other frequencies. In the plots 1100 and 1200, the curves provide for formulating equations for predicting the dielectric constant with respect to formation water salinity ($C_w$) (e.g., formation water conductivity, S/m) multiplied by the surface area to volume ratio (e.g., SAV, 1/cm) based on the data as measured on the sample cores.

As an example, a method may include formulating one or more equations based at least in part on data for determining dielectric constants for clean and shaly formations as a function of frequency. For example, based on the data in the plots 1100 and 1200, the formation dielectric constant at a given frequency may be governed by the product $C_w$*SAV where $C_w$ is water salinity (e.g., water conductivity) and SAV is surface area to volume ratio.

Referring to the plot 1100 of FIG. 11, as mentioned, it corresponds to data acquired at 2 MHz, showing dielectric constant versus $C_w$*SAV for clean and moderate shaly cores along with non-shaly Knight-Nur core data. Such data may be fit to provide for extrapolation to a $C_w$*SAV value using an SAV of $4\times10^6$ for a typical true shale and a typical downhole $C_w$ of approximately 25 S/m. In the example of FIG. 11, given such values, a predicted dielectric constant may be about 700 where such a value may be used in an LWD tool directional forward modeling code for measurements acquired at a frequency of approximately 2 MHz. In the example of FIG. 12, which is for a frequency of approximately 100 kHz, a dielectric constant of approximately 10,000 for a shale is determined. In a similar fashion the expected dielectric constant for a shale downhole may be found to be approximately 4,000 at a frequency of approximately 400 kHz.

As an example, a method may provide for determination of pore water salinity and CEC from propagation conductivity and dielectric constant measurements. As explained, a method may determine from measurements and electromagnetic theory that the formation dielectric constant within a range of propagation frequencies (e.g., approximately 100 kHz to approximately 2 MHz) may be positively correlated and may be a function of the surface area to volume ratio (SAV). As an example, a method may determine that pore water salinity or conductivity also plays a role in determining the formation dielectric constant for one or more particular frequencies such as, for example, approximately 2 MHz.

The ratio SAV tends to be mostly controlled by the volume of clay and to a lesser extent by the grain size, shape and sorting. Therefore, the propagation dielectric may tend to be primarily controlled by clay and salinity induced Maxwell-Wagner effects. Such a relationship is a reasonable given the fact that Maxwell-Wagner effects tend to dominate at propagation frequencies and that Maxwell-Wagner effects are due to surface charge polarizations.

As an example, a method can include inverting for the formation dielectric constant using LWD tool propagation real and imaginary measured conductivities (see, e.g., Wang et al., 2021). As an example, a determination of pore water salinity may be derived from an empirical correlation between formation dielectric constant and the product of pore water conductivity ($C_w$, S/m) and SAV (1/cm). As an example, where pore water conductivity is known, the SAV may be computed and from the SAV, formation permeability may be computed. Additionally, where SAV is known, the water conductivity may be computed.

As an example, a framework may provide for assessing formation characteristics during one or more field operations, which may include, for example, drilling. As an example, formation characteristics may be utilized to control drilling, for example, consider geosteering based at least in part on formation characteristics.

As an example, a framework may provide for handling real and imaginary propagation conductivities over a range for frequencies (e.g., approximately 100 kHz to approximately 2 MHz). As an example, a framework may provide for determinations as to formation dielectric constants as may be related to SAV. In such an example, dependency on pore water salinity (e.g., conductivity) may be considered, for example, for a particular frequency (e.g., approximately 2 MHz). As an example, a framework may provide for determination of pore water salinity from formation dielectric constant. As explained, a known pore water salinity (e.g., conductivity) may provide for determination of SAV and hence permeability. As an example, a framework may provide for determinations as to pore water salinity (e.g., conductivity) where SAV is known. As explained, in various types of formations, the propagation dielectric constant tends to be primarily controlled by clay induced Maxwell-Wagner effects.

In the aforementioned article by Taherian et al., a technique of fitting Cole-Cole parameters to the complex conductivity measurements is described along with validation thereof with respect to goodness of fit. The article by Taherian et al., does not provide the underlying data (e.g., raw data); rather, it provides the Cole-Cole fitting parameters and several other petrophysical parameters for each sample. As an example, a workflow may involve recreating a database of raw data (e.g., measurements) using fitting coefficients. For example, consider recreating a database using fitting coefficients spanning a range of frequencies from approximately $10^7$ Hz to $1.3\times10^9$ Hz. In such a workflow, dielectric constant at approximately 2 MHz may be computed for assessing the accuracy of the fitting coefficients, for example, by determining how well they replicate the original dielectric-resistivity relationship.

As an example, a workflow may be performed using one or more computational platforms that may include a library or libraries. For example, consider using the MATLAB platform. In such an example, fitting coefficients may be loaded into the MATLAB platform and the dielectric constant at 2 MHz computed by taking the real component of Eq. 1 at 2 MHz, where Eq. 1 may be given as follows:

$$\varepsilon^* = \varepsilon_{inf} + \frac{\varepsilon_s - \varepsilon_{inf}}{1 + (j\omega\tau)^{1-a}} - j\frac{\sigma_s}{\omega\varepsilon_o} \tag{1}$$

Figure 13:
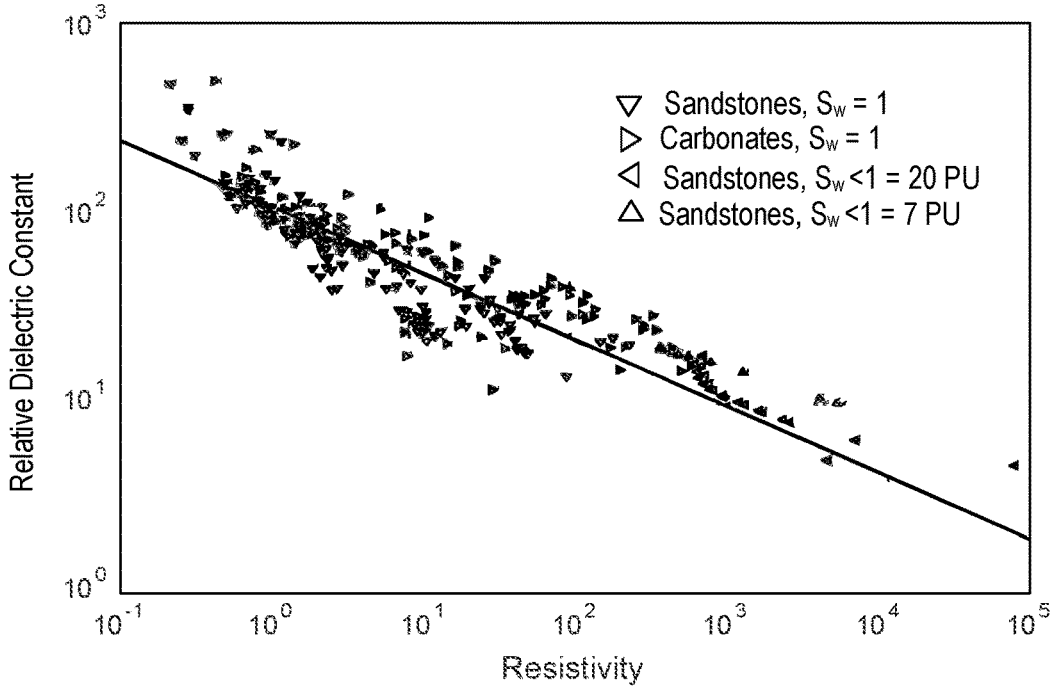
FIG. 13 illustrates examples of plots.
Figure 13:
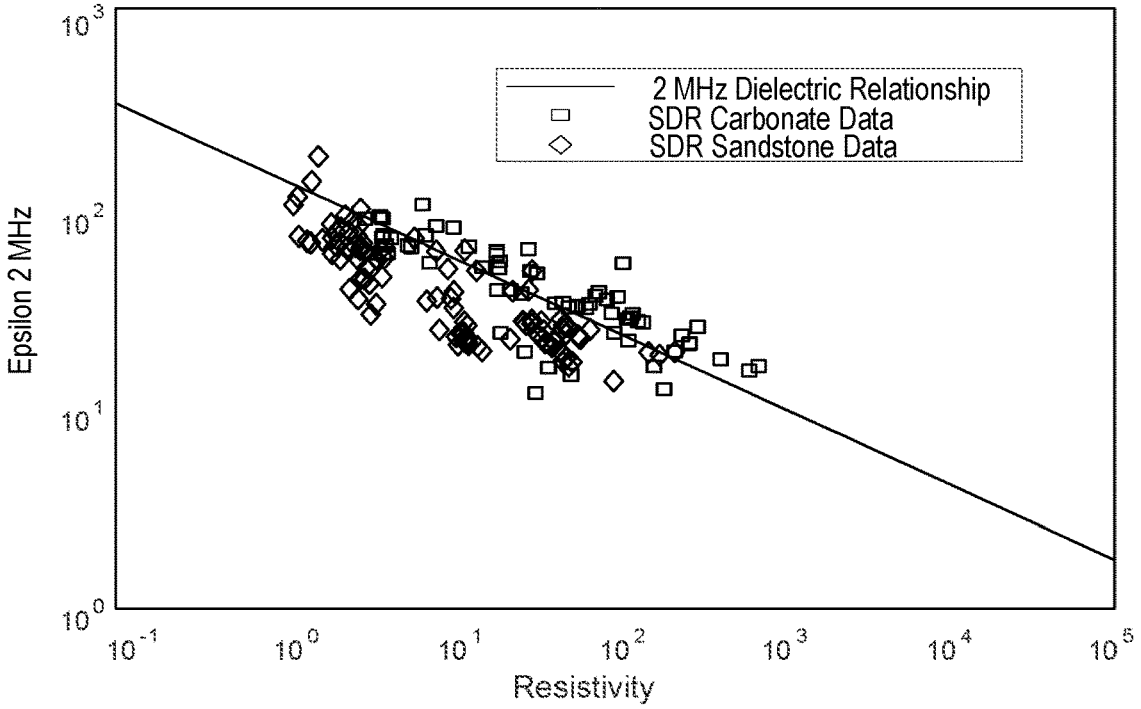

FIG. 13 shows example plots 1310 and 1320 of dielectric constant versus resistivity. As shown in FIG. 13, computed data from the article by Taherian et al., fits an existing relationship reasonably well and, therefore, is deemed suitable. In the example plots 1310 and 1320, data includes data for both sandstone and carbonate samples. As the data extracted from the coefficients of the article by Taherian et al., provides a sufficient goodness of fit, the extracted data are deemed sufficient for use in assessing petrophysical properties behind the dielectric constant-resistivity relationship. The article by Taherian et al., also includes measured CEC, surface area (SA), grain density, formation factor, porosity and $R_w$; noting that the article by Taherian et al., does not list the measured resistivity of the samples; rather, the values are computed from the formation factor and $R_w$. The article by Taherian et al., also provides the DC conductivity, $\sigma_s$, as computed from the Cole-Cole relationship as in Eq. 1.

In this example workflow, while both conductivities correlate, it is possible to choose to use the value of $1/\sigma_s$ as the resistivity for cross-plots to reduce miscomprehension that may arise from using an assumed value of m equal to 2 when computing resistivity from the formation factor.

Figure 14:
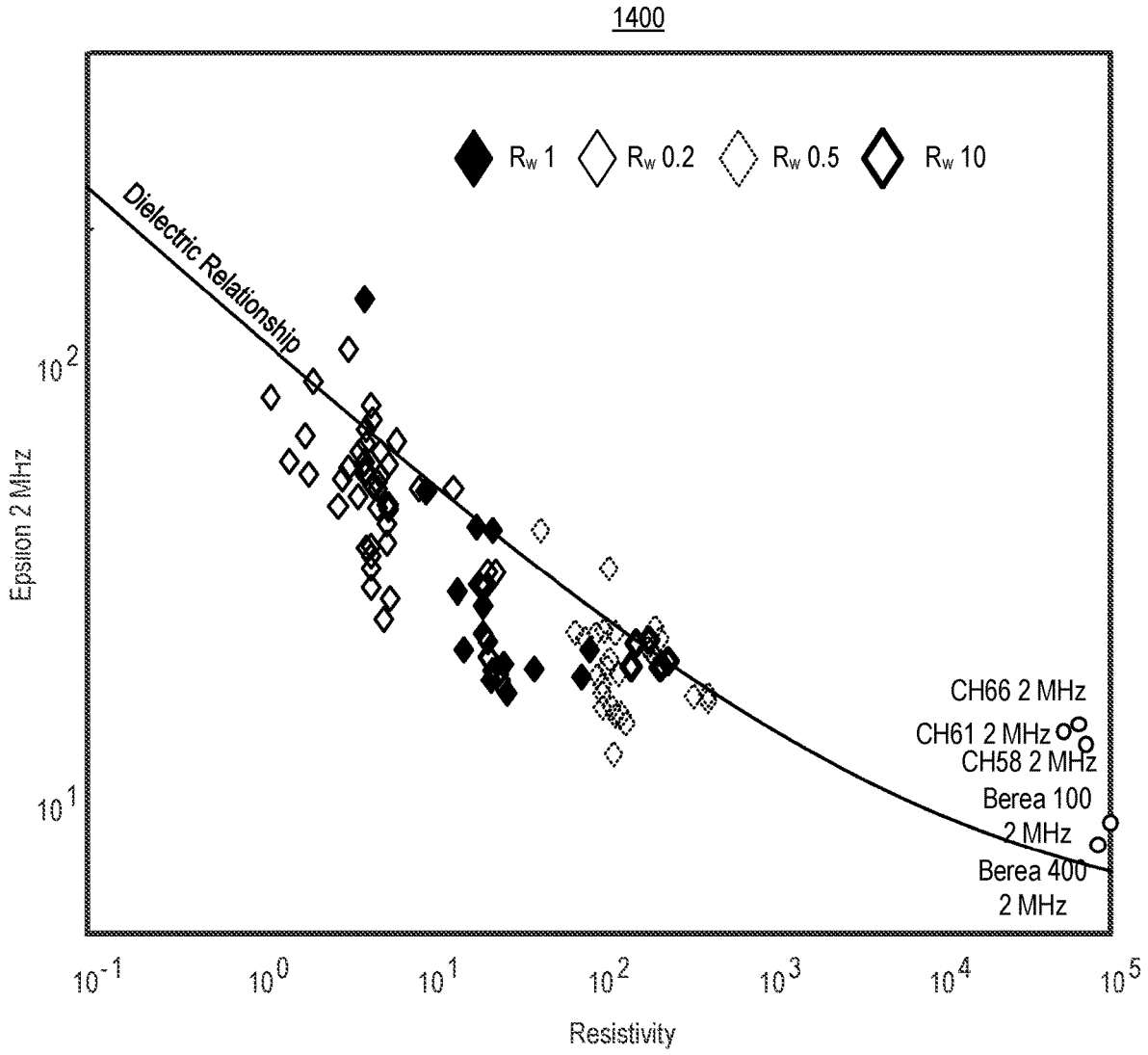
FIG. 14 illustrates an example of a plot.
Figure 15:
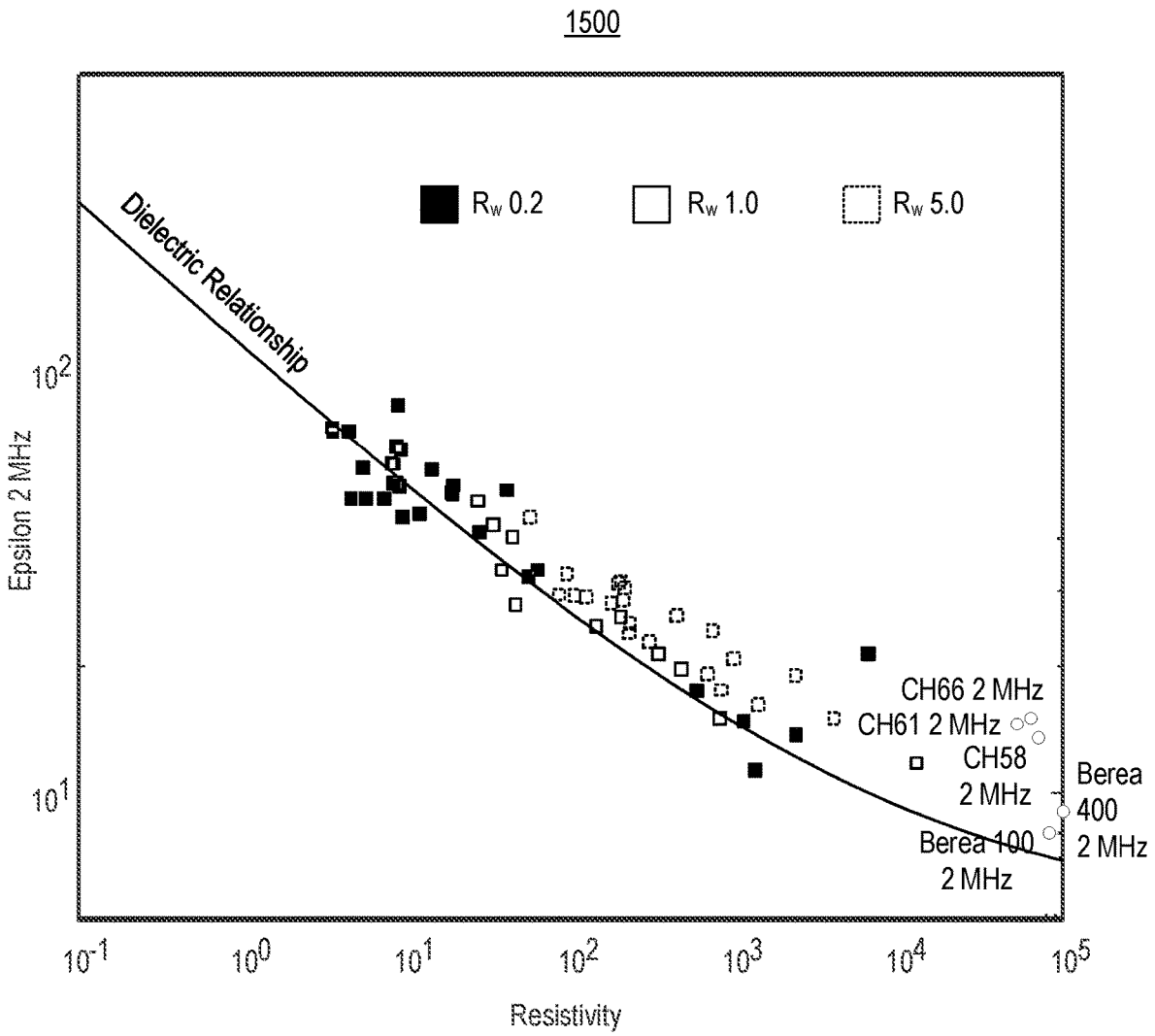
FIG. 15 illustrates an example of a plot.

FIG. 14 and FIG. 15 show plots 1400 and 1500, respectively, of dielectric constant versus resistivity. In particular, the plots 1400 and 1500 show resistivity-dielectric data sorted by $R_w$ values. In these examples, an existing relationship was modified according to an article by Wu (1999) (e.g., an addition of a factor of 5 to the existing relationship).

The plots 1400 and 1500 illustrates that most of the variation in resistivity is in the $R_w$ values used to saturate the cores. In these examples, most of the cores were measured at multiple salinities as indicated by the legend. Additional data are included from the article by Knight and Nur, "The Dielectric Constant of Sandstones, 60 kHz to 4 MHz", Geophysics, Vol 52, No. 5, pp. 644-654 (1987), which is incorporated by reference herein. The Knight-Nur data were taken using de-ionized water which has a very high $R_w$. The value of $R_w$ has a profound effect on the measured dielectric constant as seen in the plots 1400 and 1500 and in various subsequent cross-plots.

As an example, a workflow may include determining what basic petrophysical properties a 2 MHz dielectric constant is a function thereof. Such an approach can involve determining correlations, which may be, for example, visualized using cross-plots.

Figure 16:
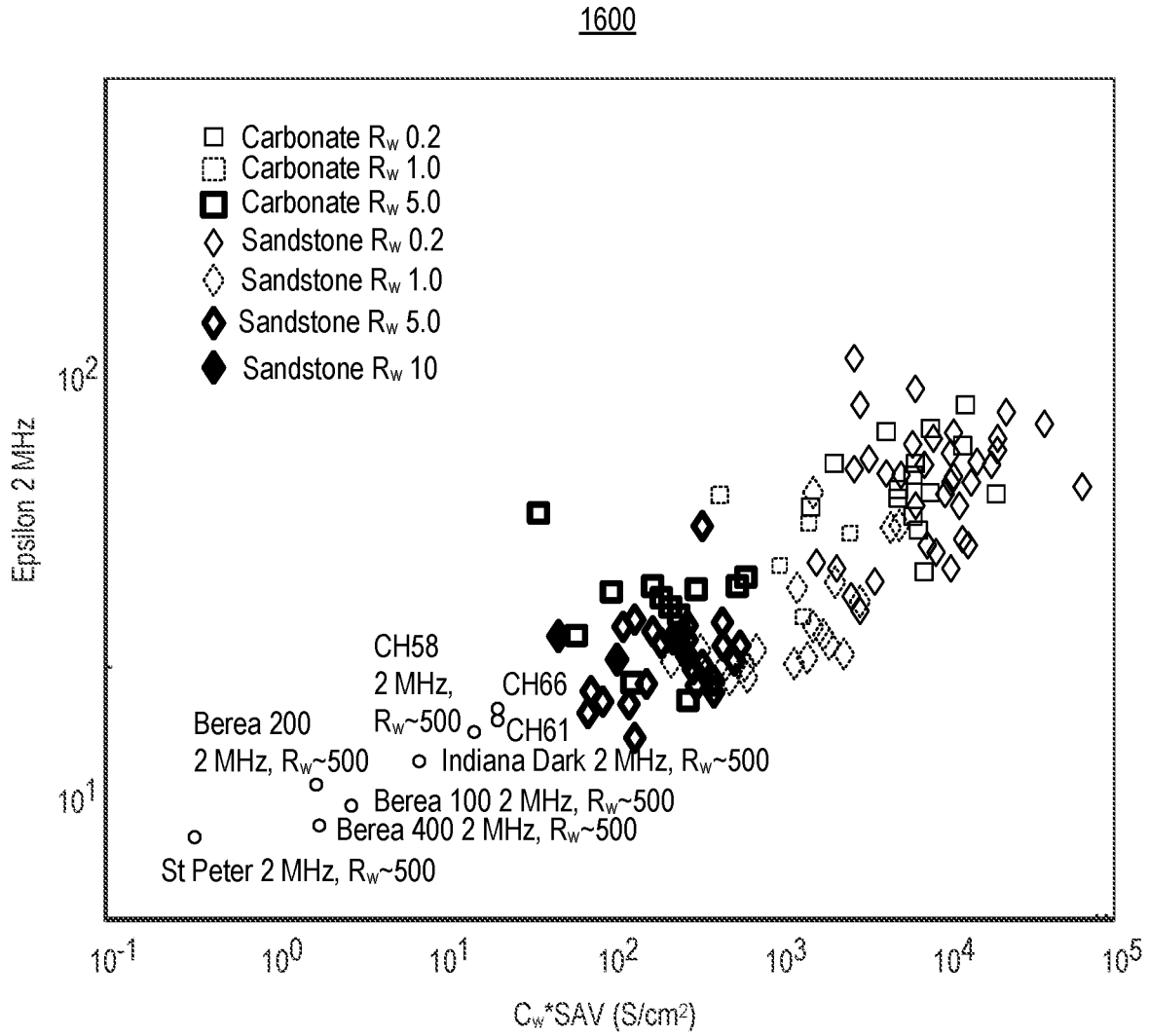
FIG. 16 illustrates an example of a plot.
Figure 17:
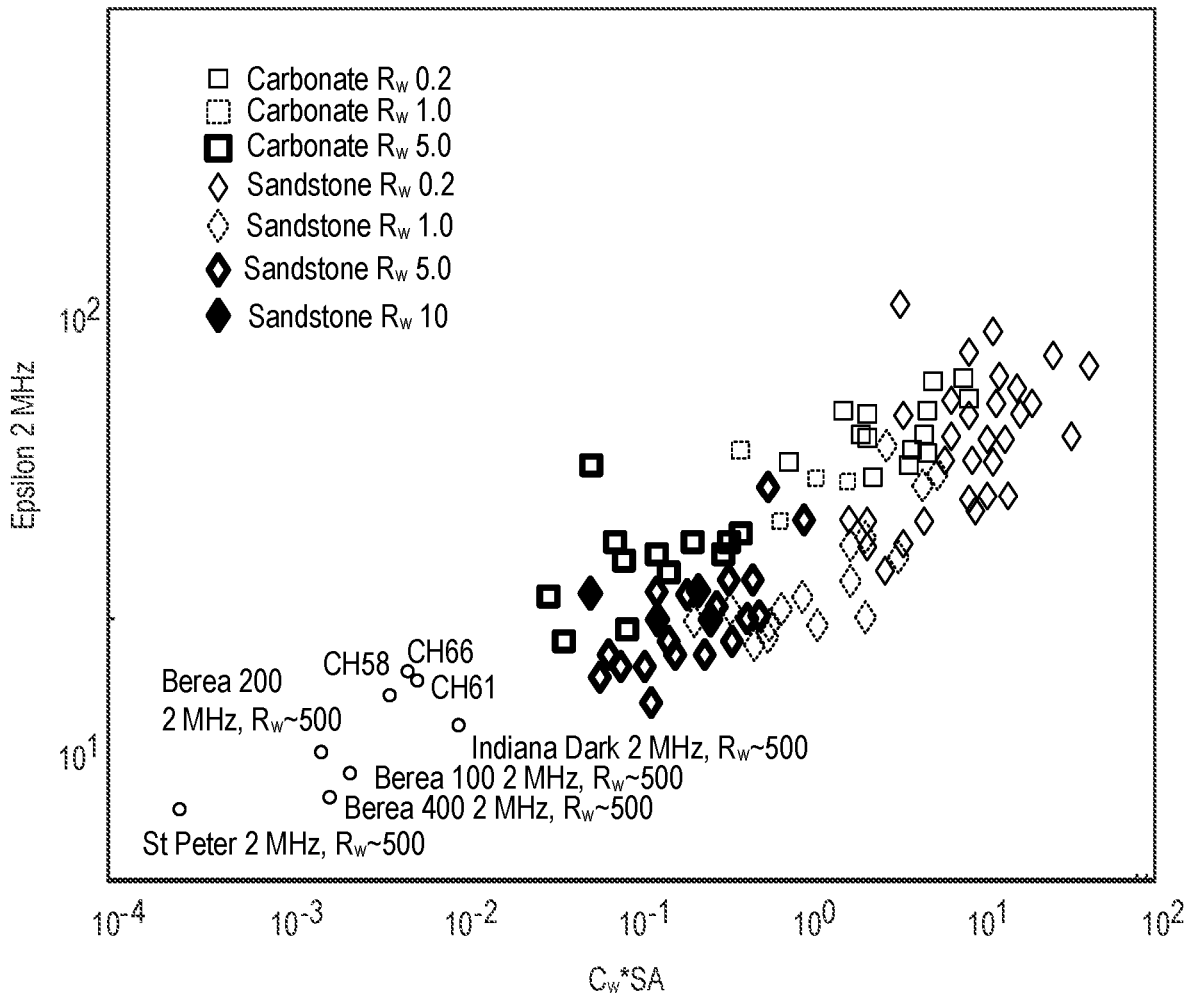
FIG. 17 illustrates an example of a plot.

FIG. 16 and FIG. 17 show example cross-plots 1600 and 1700 of dielectric constant at 2 MHz versus the product $C_w$*SAV (the cross-plot 1600) and versus the product $C_w$*SA (the cross-plot 1700). The correlation assessments of either of the cross-plots 1600 and 1700 may at least in part explain the 2 MHz dielectric constant; noting that the cross-plot 1600 tends to show a more linear correlation with the Knight-Nur data points. An analysis of the Knight-Nur data showed that SAV correlated quite well to dielectric constant. However, when considered with SDR data that had measurements of the same sample saturated with multiple salinities, it became apparent that $C_w$ also has an effect. The Knight-Nur samples were saturated with di-ionized water and it appears that a value of 500 ohm-m places the Knight-Nur data substantially in-line with the SDR data; noting that the $R_w$ of de-ionized water could be a factor of 10 higher.

Figure 18:
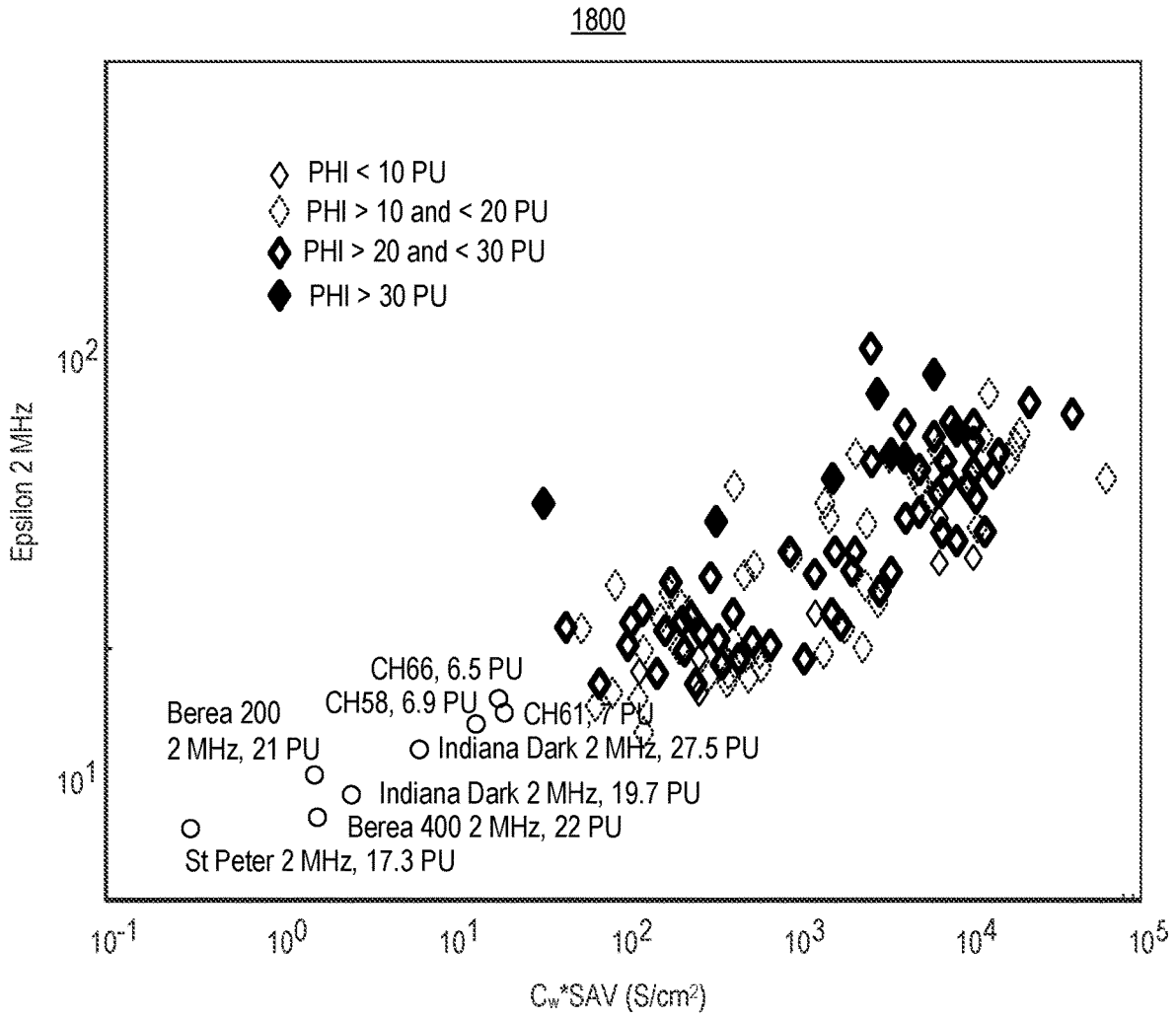
FIG. 18 illustrates an example of a plot.

FIG. 18 shows an example plot 1800 of dielectric constant at approximately 2 MHz versus the product $C_w$*SAV as sorted by porosity. The plot 1800 indicates an absence of porosity effects on the relationship described with respect to the plots 1600 and 1700.

As shown in the plot 1800, the various values of porosity overlap, which may be due to SAV including porosity in the denominator. Therefore, multiple values of porosity with various combinations of SA and $R_w$ may act to move data along the illustrated relationship making dielectric constant substantially independent of porosity; noting that the product $C_w$*SAV appears to be a proper dependent variable to correlate to dielectric constant.

As explained, the units of the product $C_w$*SAV are S/cm$^2$. Hence, the various plots indicate that a conductivity per unit area correlates with a dielectric constant, which tends to be primarily a function of Maxwell-Wagner type capacitance effects that are due to surface charges.

As an example, the following relationship, denoted Eq. 2, may be derived from the plots 1700 or 1800:

$$\varepsilon_{meas}=7.1714*(Cw*\mathrm{SAV}_{t_meas})^{0.2123} \tag{2}$$

Figure 19:
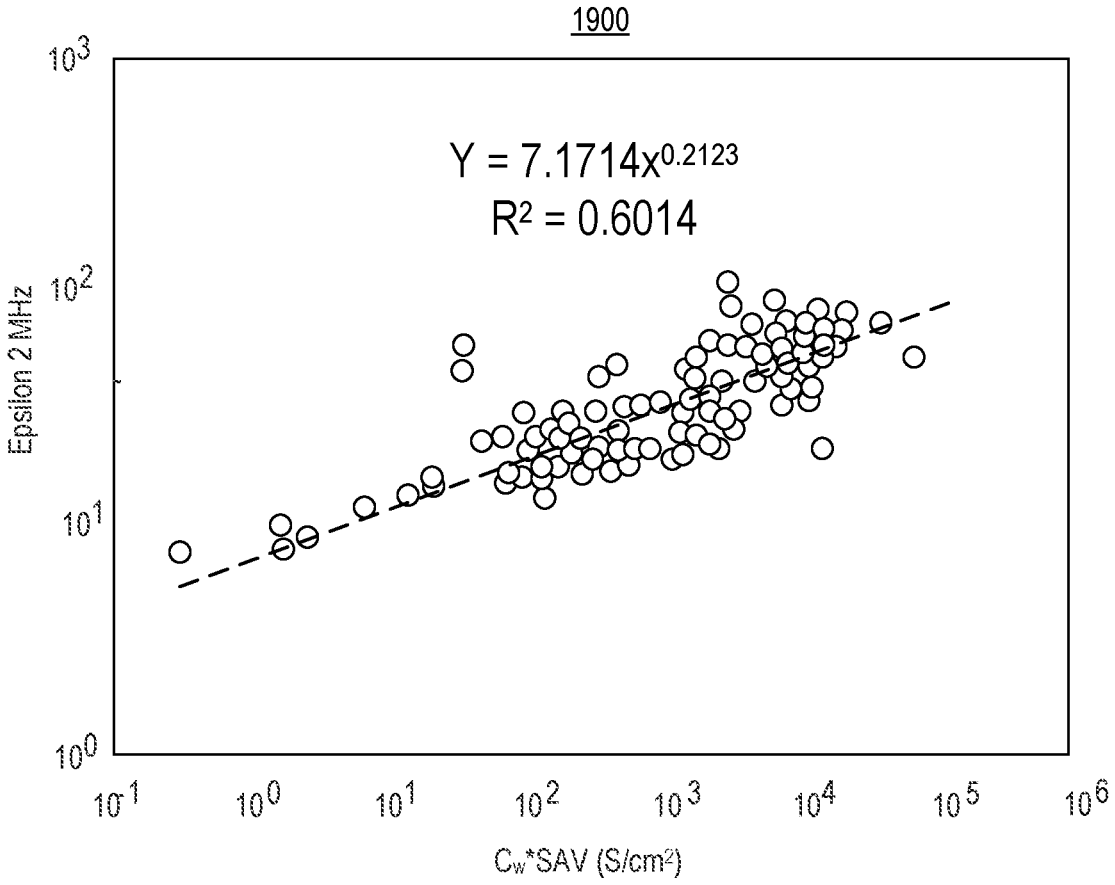
FIG. 19 illustrates an example of a plot.

FIG. 19 shows an example plot 1900 of dielectric constant at approximately 2 MHz versus the product Cw*SAV where a linear fit results in the relationship of Eq. 2, with a value of $R^2$ of 0.6014. As to SAV, it is a value based on a measured volume (referred to as $V_{t_meas}$).

As an example, a measured 2 MHz dielectric constant (epsilon) may be used with Eq. 2 to compute the quantity $C_w$*$SAV_{t_meas}$. In such an approach, given a known $C_w$, $SAV_{t_meas}$ can then be computed or given a known $SAV_{t_meas}$, $C_w$ can be computed.

As an example, a method may include determining $SAV_{t_meas}$ and permeability from dielectric constant (epsilon) and $C_w$. For example, a 2 MHz dielectric constant (e.g., $\varepsilon_{meas}$) may be computed from LWD propagation real and imaginary measured conductivities (see, e.g., Wang et al., 2021). As an example, the following equation, Eq. 3, may be utilized:

$$SAV_{t_meas} = 10\left(\frac{\log\varepsilon_{meas} - \log 7.1714}{0.2123} - \log Cw\right) \tag{3}$$

As an example, a method may include inputting pore water conductivity, $C_w$(S/m), in to Eq. 3 to allow for $SAV_{t_meas}$ of a formation to be computed.

Figure 20:
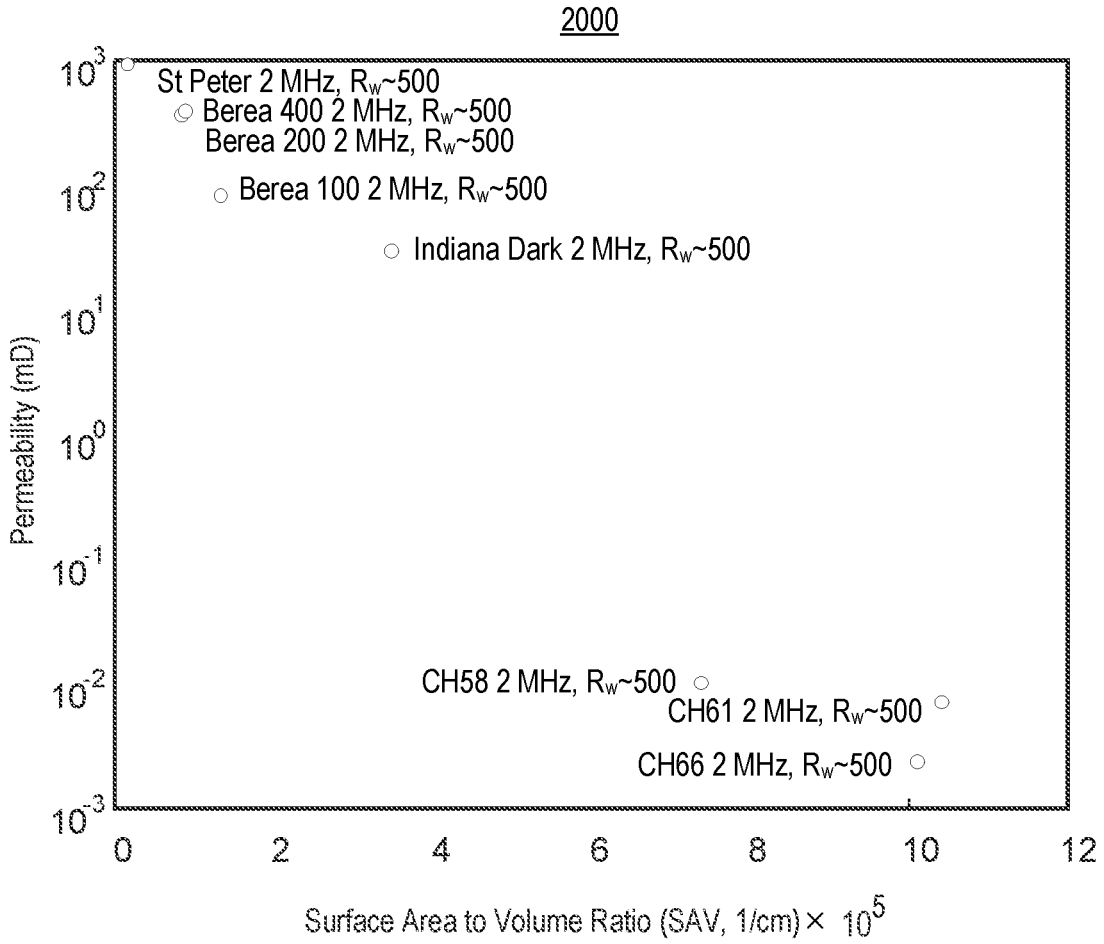
FIG. 20 illustrates an example of a plot.

FIG. 20 shows an example plot 2000 of permeability versus SAV; noting that $SAV_{t_meas}$ is a known predictor of formation permeability. The plot 2000 shows this relationship for the Knight-Nur data. In the example of FIG. 20, SAV is the total $SAV_{t_meas}$ of the formation which includes clay and non-clay minerals.

As an example, some permeability relationships may use the parameter surface area ($SA_{t_meas}$) instead of $SAV_{t_meas}$. For example, the following equation, Eq. 4, may be utilized, which indicates how various quantities are related:

$$SAV_{t_meas}\left(\frac{1}{\mathrm{cm}}\right) = SA_{t_meas}\left(\frac{\mathrm{m}^2}{\mathrm{gm}}\right) * RHGA\left(\frac{\mathrm{gm}}{\mathrm{cm}^3}\right) * \left(\frac{(1-\phi)}{\phi}\right) * 10^4\left(\frac{\mathrm{cm}^2}{\mathrm{m}^2}\right) \tag{4}$$

where RHGA is the rock grain density and Ø (phi) is the rock total porosity.

Re-arranging Eq, 4 can provide a solution for $SA_{t_meas}$, as follows, Eq. 5:

$$SA_{t_meas} = SAV_{t_meas} * \frac{1}{RHGA} * \left(\frac{\phi}{(1-\phi)}\right) * \frac{1}{10^4} \tag{5}$$

As an example, a method may include determining bulk CEC from $SAV_{t_meas}$. For example, consider the plot 720 of FIG. 7, which shows that $SA_{clay}$ is related to CEC. In the plot 720, the slope of the correlation is nearly unity. For example, consider the following equations, Eq. 6a and Eq. 6b as approximations:

$$SA_{clay} = 450 * CEC_{clay}\left(\frac{\mathrm{meq}}{\mathrm{gm}}\right) \tag{6a}$$

$$\mathrm{CEC}_{clay}=\mathrm{SA}_{clay}/450 \tag{6b}$$

Clays tend to have the largest SA of constituents in normal formations. The specific surface area value of montmorillonite is larger than illite while the specific surface area of kaolinite is less than illite. The value of St. Peter sandstone (Knight and Nur, 1987) is shown in the plot 720. The specific surface area of illite is approximately 800 times that of the St. Peter sandstone making the non-clay SA nearly negligible. However, the SA of the non-clay material may be accounted for before determining the bulk CEC using the following approach. The SA of each constituent in the formation may be weighted by its dry weight to compute the SA of the formation that would be representative of the measured value, for example, per the following equation, Eq. 7:

$$SA_{t_meas} = SA_{t_{non\text{-}clay}} + SA_{t_clay} = \mathrm{Dry\ Weight}_{non\text{-}clay}\left(\frac{\mathrm{gm}_{non\text{-}clay}}{\mathrm{gm}_{total}}\right) * SA_{non\text{-}clay}\left(\frac{\mathrm{m}^2}{\mathrm{gm}_{non\text{-}clay}}\right) + \mathrm{Dry\ Weight}_{clay}\left(\frac{\mathrm{gm}_{clay}}{\mathrm{gm}_{total}}\right) * SA_{clay}\left(\frac{\mathrm{m}^2}{\mathrm{gm}_{clay}}\right) \tag{7}$$

As an example, Eq. 6 may be rearranged for $SA_{clay}$ to provide the following equation, Eq. 8:

$$SA_{clay} = SA_{f_meas} - \frac{(\mathrm{Dry\ Weight}_{non-clay} * SA_{non-clay})}{\mathrm{Dry\ Weight}_{clay}} \tag{8}$$

As an example, dry weights of formation minerals (e.g., clay and non-clay) may be computed from conventional petrophysical analysis. NMR measurements tend to be unable to respond to the effects of clays due to their fast decay rates and therefore may be considered representative of non-clay mineral properties. As an example, one or more techniques may be utilized to convert NMR measurements to either $SA_{non\text{-}clay}$ or $SAV_{non\text{-}clay}$ ratios. For example, NMR can measure the restrictive diffusion of hydrogen molecules in a pore space of a formation which is proportional to $SAV_{non\text{-}clay}$. One or more other techniques for determining $SA_{non\text{-}clay}$ may include direct core measurements and approximations using grain sizes of the mineral components.

As an example, a method may include converting a determined $SAV_{non\text{-}clay}$ value to $SA_{non\text{-}clay}$ using Eq. 5. Where all of the parameters are determined for input into the right-hand side of Eq. 8 from which $SA_{clay}$ is computed, Eq. 6b may then be used to compute $CEC_{clay}$. In various scenarios, $CEC_{clay}$ may be a beneficial parameter in shaly sand analysis (see, e.g., Clavier et al., 1977 and 1984, and Waxman and Smits, 1968). The approach described above for determining $CEC_{clay}$ may be implemented by a framework for one or more purposes, which may include, for example, controlling one or more drilling operations.

As an example, a method may provide for determining $C_w$ from bulk CEC and $SAV_{t_meas}$. In such an example, one or more techniques may be utilized to compute $CEC_{clay}$. For example, consider use of lab measurements and log derived petrophysical calculations based on other log measurements such as spectroscopy yields. Having a computed $CEC_{clay}$ may allow for use of an equation or equations to compute $C_w$ of a formation and, from $C_w$, the salinity. For example, consider using Eq. 6a to compute $SA_{clay}$ where Eq. 8 may be rearranged to solve for $SA_{t_meas}$ per the following equation, Eq. 9:

$$SA_{t_meas} = SA_{clay} + \frac{(\text{Dry Weight}_{non\text{-}clay} * SA_{non\text{-}clay})}{\text{Dry Weight}_{clay}} \tag{9}$$

As an example, Eq. 4 may be used to solve for $SAV_{t_meas}$ where Eq. 3 may be rearranged as follows, Eq. 10, to solve for $C_w$:

$$C_w = 10\left(\frac{\log \varepsilon_{meas} - \log 7.1714}{0.2123} - \log SAV_{t_meas}\right) \tag{10}$$

As an example, various techniques may be applied to lower frequencies, for example, lower than approximately 2 MHz. Such an approach may provide for determining how the formation dielectric constant at other propagation frequencies compare to the formation dielectric constant at 2 MHz. The plot 1800 of FIG. 18 shows three of the measurements of formation dielectric constant versus frequency for eight cores. The formation dielectric constant at a given frequency is monotonic compared to any other frequency, i.e., the order between the various core data remains the same regardless of frequency. This implies that an interpretation of the 2 MHz data may be applied for a frequency of 400 kHz and for a frequency of 100 kHz, which are often LWD propagation frequencies.

As an example, a framework may provide for implementation of one or more methods. For example, consider one or more of a method to determine $SAV_{t_meas}$ and permeability from dielectric constant (epsilon) and $C_w$; a method to determine bulk CEC from $SAV_{t_meas}$; and a method to determine $C_w$ from bulk CEC and $SAV_{t_meas}$. Not that one or more methods may be combined, for example, to predict downhole water resistivity and thereafter formation salinity.

As an example, a framework may provide for an automated workflow that includes combining multiphysics measurements to determine $SAV_{t_meas}$ and CEC to predict formation salinity.

Figure 21:
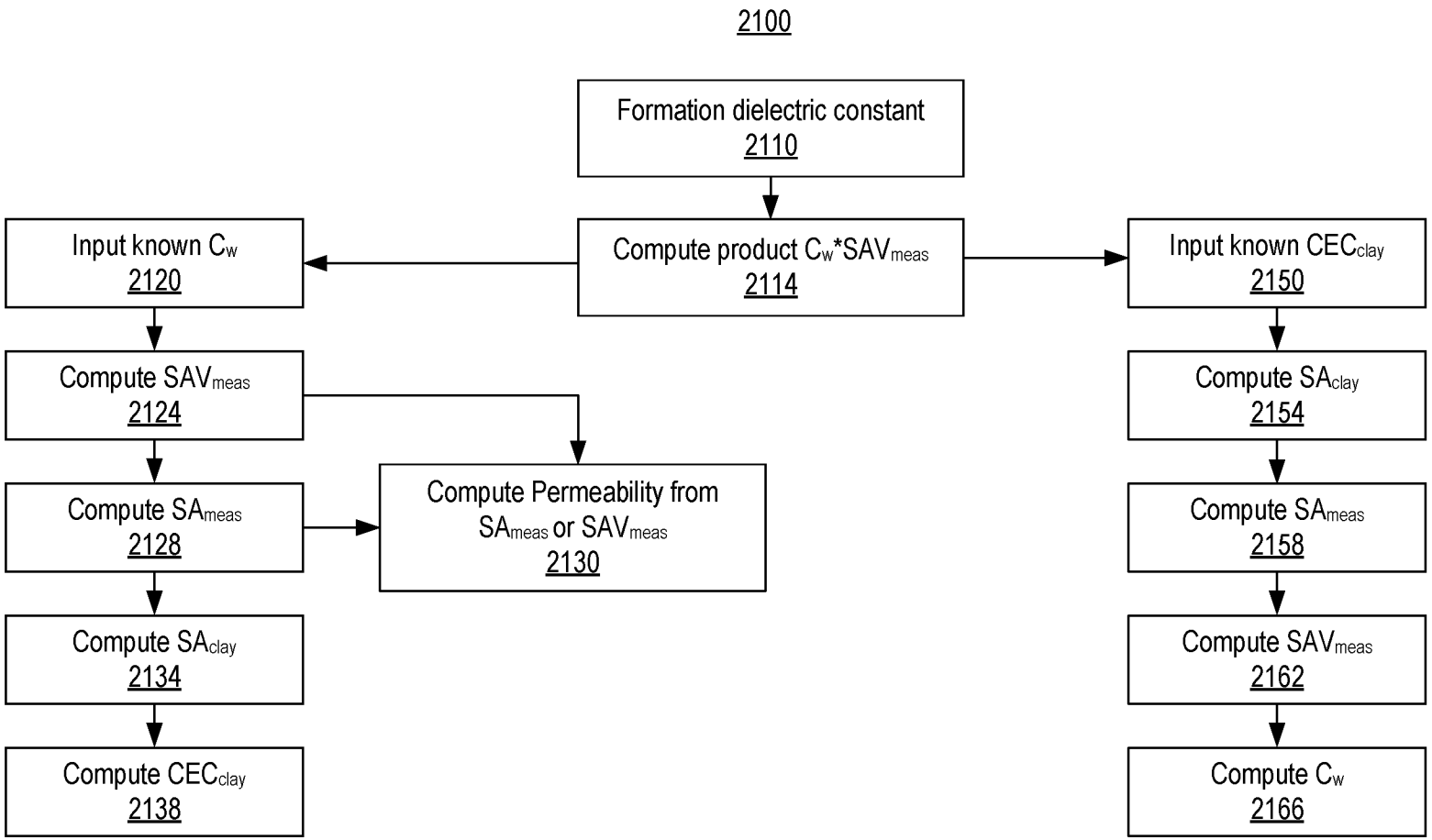
FIG. 21 illustrates an example of a method.

FIG. 21 shows an example of a method 2100 that can include receiving a formation dielectric constant and determining one or more values of one or more other characteristics of a formation. As shown, the method 2100 can include a reception block 2110 for receiving a dielectric constant (e.g., a dielectric constant value) and a computation block 2114 for computing the product of $C_w$ and $SAV_{meas}$. As shown, the block 2114 may provide output to one or more blocks 2120 and 2150, depending on what determinations may be desired. The block 2120 provides for input of a known $C_w$ followed by a computation block 2124 for computing $SAV_{meas}$, a computation block 2128 for computing $SA_{meas}$ and a computation block 2130 for computing permeability from $SAV_{meas}$ and/or $SA_{meas}$. As shown, the method 2100 may include a computation block 2134 for computing $SA_{clay}$ and a computation block 2138 for computing $CEC_{clay}$. As to the block 2150, it may provide for inputting a known $CEC_{clay}$, followed by a computation block 2154 for computing $SA_{clay}$, a computation block 2158 for computing $SA_{meas}$, a computation block 2162 for computing $SAV_{meas}$, and a computation block 2166 for computing $C_w$. As explained, various values may be determined on the basis of receiving a formation dielectric constant (e.g., from one or more downhole tools, etc.).

Figure 22:
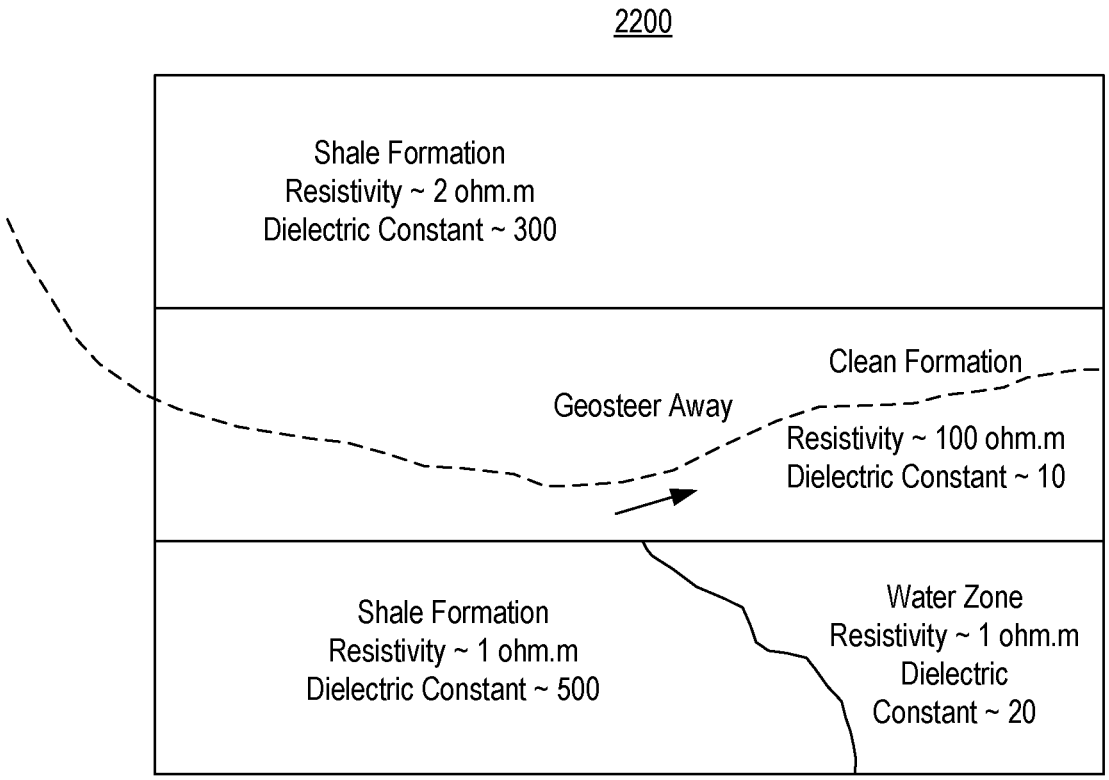
FIG. 22 illustrates an example of a graphic of a geologic region.

FIG. 22 shows an example of a graphic 2200 that includes various formations, which may be defined as beds, along with a borehole trajectory. As shown, the formations include a shale formation with resistivity of approximately 2 ohm and a dielectric constant of approximately 300, a clean formation with a resistivity of approximately 100 ohm and a dielectric constant of approximately 10, another shale formation with a resistivity of approximately 1 ohm and a dielectric constant of approximately 500, and a water zone with a resistivity of approximately 1 ohm and a dielectric constant of approximately 20.

In various circumstances, geosteering decisions can depend solely on the location of a resistivity boundary and the value of the resistivity of the bed. As explained, in such an approach, an issue can arise in that a clean water bearing formation and a clay rich shale can have approximately the same resistivity. For example, in FIG. 22, the graphic 2200 shows the lower shale formation and the water zone as having approximately the same resistivity such that resistivity-based information alone may be insufficient to distinguish these two regions for purposes of geosteering. As explained, a water bearing formation is to be avoided and steered away from to reduce the risk of water encroachment or water entry into a borehole (e.g., a lateral borehole); whereas, a clay rich shale formation can be approached or steered closely to without the risk of consequences of the water bearing formation.

As explained, a clean water bearing formation may have approximately the same resistivity as a clay shale formation (e.g., plus or minus 10 percent) but the formation dielectric constant values of each can be dramatically different. Hence, through use of dielectric information, a method of geosteering can provide for differentiation between the two beds to thereby reduce risks associated with clean water bearing formations.

As an example, a method can, initially, use the absolute value of formation dielectric constant to distinguish a clay shale bed from a clean zone, regardless of the clean zone hydrocarbon saturation. Such a method can provide for generation of one or more commands to steer a drill bit in a lateral portion of a borehole away from bottom water which may potentially be fractured into, ruining the productive potential of the lateral portion of the borehole.

As an example, a method for geosteering can include use of a petrophysical relationship between clay type, clay volume and formation dielectric constant. In such an example, the petrophysical relationship can be for lower frequencies (e.g., less than approximately 20 kHz). As explained, an inversion or inversions can be performed for one of three petrophysical unknowns of CEC, $S_w$, or salinity where such an inversion or inversions can be performed using measured complex conductivity (e.g., real and imaginary conductivity from which real conductivity and formation dielectric constant can be computed). As an example, a petrophysical model can be developed for propagation frequencies, where such a petrophysical model can be applied for propagation frequency data. As an example, by assuming a shale bed is at $S_w$=100, salinity and bulk CEC can be computed. As an example, if an assumption is made as to a clay type for a shale, a method can include computing volume of clay in a formation based on bulk CEC. In such an example, if the volume of clay is high, the bed can be positively identified as a shale bed; whereas, if the volume of clay is zero or very low, the bed can be identified as a clean formation with little shale.

As an example, a method can include boundary detection. For example, a method can utilize dielectric data that can extend beyond a drill bit in a look-ahead manner where such dielectric data can be indicative of one or more boundaries. As an example, a method can include use of one or more geometrical models where, for example, an inversion may be performed using at least dielectric data to locate a position of a boundary. In such an example, material at the boundary (e.g., to one side of the boundary) may be assessed, for example, with respect to clay content, clay type, etc.; noting that if the material is detrimental to borehole stability, well construction, etc., a method can include geosteering to steer away from such material.

As an example, a method can include using dielectric data to make one or more determinations as to mode of drilling. For example, consider a method that can provide for determinations as sliding mode and rotating mode. In such an example, a sliding mode can be part of a directional approach to drilling where at least some amount of control occurs at surface. For example, during sliding, a top drive may be utilized for oscillating rotational direction of a drillstring, which may provide for reduction in forces between a drillstring and a borehole wall and which may be limited such that the oscillations do not result in substantial rotational movement at an end of a drillstring (e.g., at a BHA). In contrast, a rotating mode aims to rotate a drill bit via rotation of the drillstring.

As an example, a method can include detection of sand such as clean sand where drilling through such a region may result in some tendency of a drill bit dropping downwardly due to compaction of the sand. In contrast, a shale region can help to hold a drill bit (e.g., at a steady level). As an example, with sand, directional drilling may call for more sliding; whereas, with shale, directional drilling may call for more rotating. As an example, determinations as to an amount of clay and/or a type of clay can be indicative of whether or not risk of dropping exists. As an example, dielectric data may be supplemented with gamma data; noting that a dielectric tool can generally see further away than a gamma tool. As an example, an initial determination may be made using dielectric data where the initial determination can be assessed, verified, adjusted, etc., using gamma data.

Figure 23:
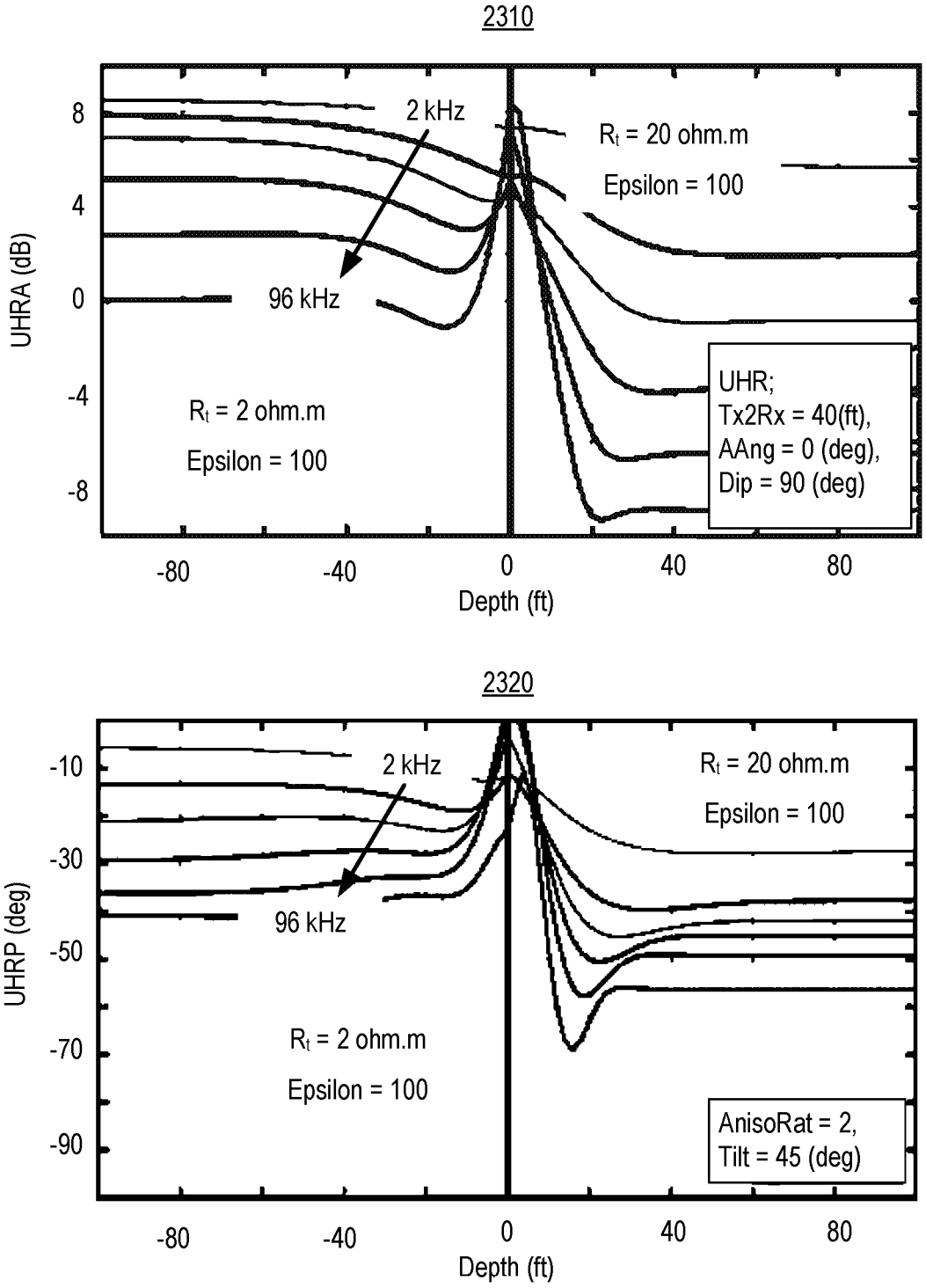
FIG. 23 illustrates examples of plots.

FIG. 23 shows examples of plots 2310 and 2320 of forward modeled directional tool response to boundary crossing. As shown, a boundary may be present where the boundary may be characterized by an azimuthal angle and/or a dip. In the example of FIG. 23, the boundary in the plot 2310 is between a formation with a resistivity, Rr, of 2 ohm-m (e.g., or ohm·m) and a dielectric constant, $\varepsilon_t$, of 100 and another formation with a resistivity, $R_t$, of 20 ohm-m and a dielectric constant, $\varepsilon_t$, of 100 where the boundary has a dip of 90 degrees and an azimuthal angle of 0 degrees. As shown, data from various frequencies may be available (e.g., from 2 kHz to 96 kHz) where data at higher frequencies may exhibit a more distinct response. In the plot 2320, an anisotropic ratio of 2 and a tilt of 45 degrees is present. As explained, one or more method may be utilized for boundary detection, for example, when drilling where drilling may be controlled based at least in part on a detected boundary.

In various instances, geosteering decisions may rely solely on the location of an approaching layer boundary and the resistivity contrast of the approaching layer compared to the layer the trajectory and tool are currently within. For example, a technique may use the sign and absolute values of the symmetrical directional measurements to determine the resistivity contrast of the approaching layer and the distance to the associated boundary. In such an example, a positive increasing measurement means the approaching layer from below is more resistive than the layer the trajectory is currently within; whereas, a negative signal means the approaching layer from below is less resistive than the layer the trajectory is presently within; and further, a zero signal means there is no approaching or nearby layer and the tool is in an infinite homogeneous layer of constant resistivity. Such interpretation techniques rely upon the assumption of a permittivity or dielectric constant approximated by a dielectric-resistivity relationship at frequencies of 2 MHz and 400 kHz that may underpredict the dielectric constant for shales. While one or more other directional measurements may be used in the interpretation and inversion, these too assume the same relationships for the dielectric constant and rely upon resistivity contrasts or the presence of anisotropy for their diagnosis.

In various instances, in a subsurface environment, there can be cases where there is no resistivity contrast, but only permittivity contrast between two layers. As an example, a method may provide for detecting this type of boundary between lithological layers.

Figure 24:
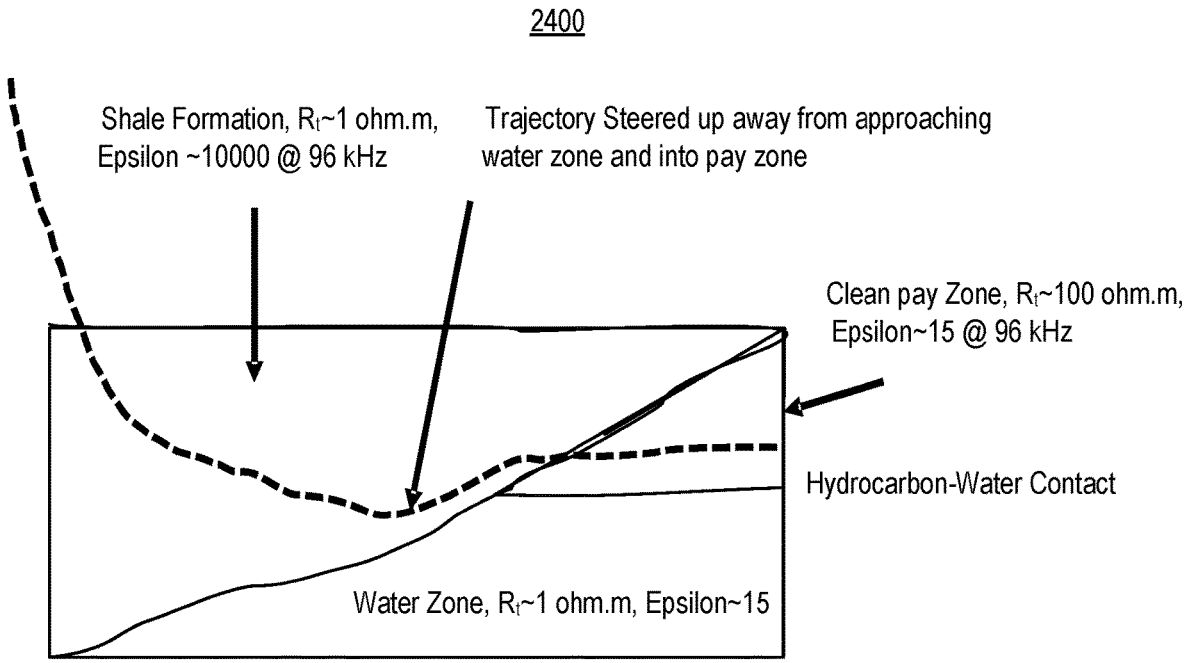
FIG. 24 illustrates an example of a graphic of a geologic region.

FIG. 24 shows an example graphic 2400 of a subsurface environment that represents a geosteering scenario where there is a lack of resistivity contrast and a permittivity contrast. In the example of FIG. 24, a lateral portion of a borehole is being drilled within a high dielectric shale layer and approaching a hydrocarbon bearing reservoir of similar resistivity (see clean pay zone). In this example, the hydrocarbon-water contact is higher than anticipated. In this example, if the trajectory of the borehole is allowed to continue along the same path and true vertical depth, it will drill into the water bearing section of the reservoir (see water zone). Because the shale and water zone have the same resistivity, this boundary may be erroneously interpreted using current direction measurements and their interpretation techniques; noting that one or more other geosteering scenarios may encounter such an issue where a lack of resistivity contrast between layers exist.

As an example, a framework may be implemented during directional drilling for purposes of geosteering (e.g., geosteering control, etc.). In such an example, the framework may provide for forward modeling of a formation dielectric property for each layer in addition to resistivity and its effect on the directional measurements. For example, as explained, a framework may have an ability to assign expected dielectrics for one or more lithological layers using the knowledge gained from various analyses (see, e.g., FIGS. 11 and 12 and the plots 1100 and 1200). As an example, a framework may include a forward modeling component that can be implemented to predict directional measurements response to one or more scenarios such as, for example, the scenario 2400 of FIG. 24; noting that one or more other scenarios may benefit from such forward modeling. As an example, output from a framework may include information suitable for rendering graphically to a display and/or information suitable for controlling a drillstring.

Figure 25:
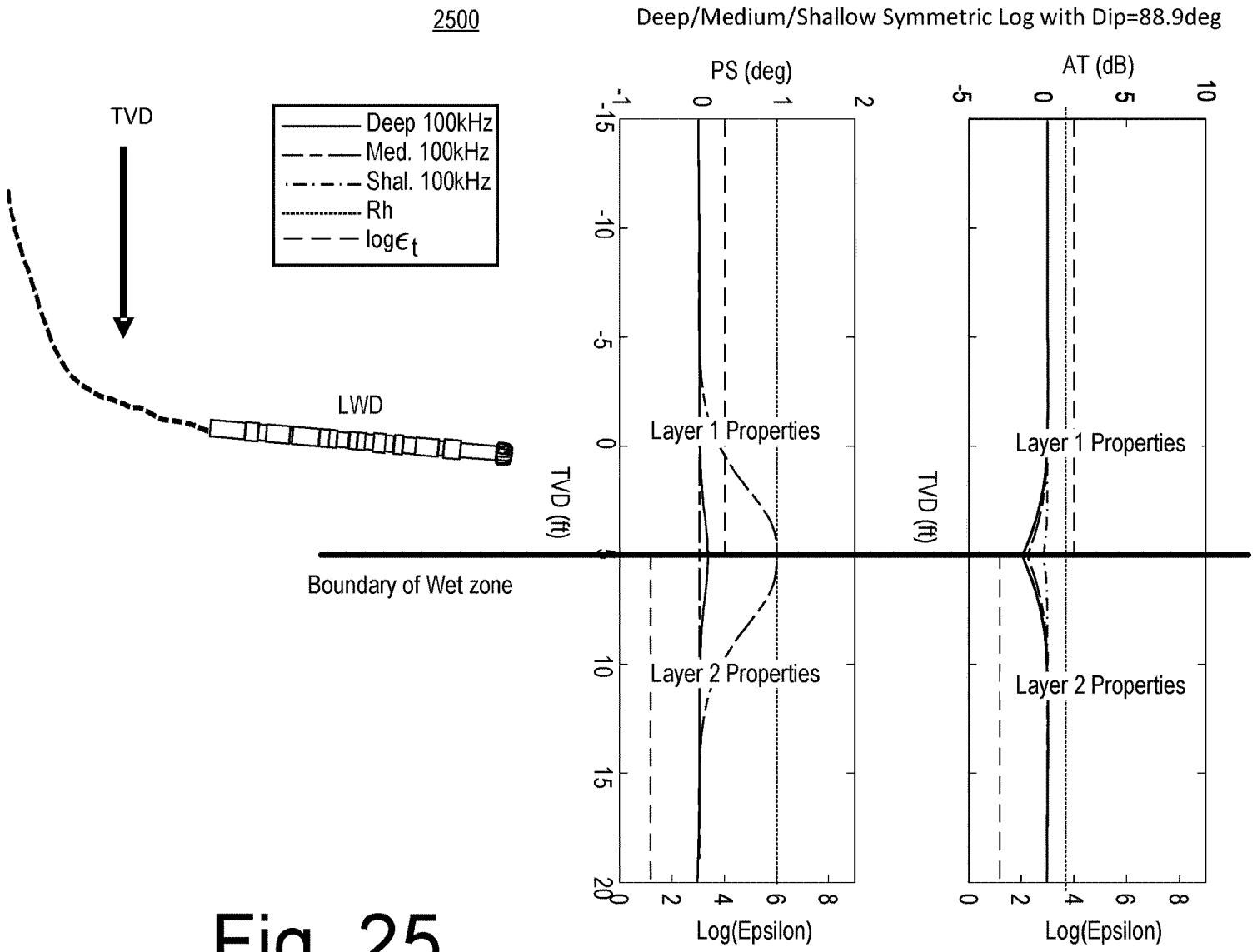
FIG. 25 illustrates example graphics and plots.

FIG. 25 shows an example graphic 2500 that includes a portion of a trajectory of a borehole that includes a drillstring with an LWD tool for acquiring measurements along with example plots of phase shift (PS) and attenuation (AT) with respect to total vertical depth (TVD). In the plots, values are given for deep, medium and shallow, Rh and log $\in_t$ (e.g., log $\varepsilon_t$), where Rh is horizontal resistivity. In various plots, abbreviations include SPD (e.g., symmetric phase deep), SPM (e.g., symmetric phase medium), SPS (e.g., symmetric phase shallow), SAD (e.g., symmetric attenuation deep), SAM (e.g., symmetric attenuation medium), and SAS (e.g., symmetric attenuation shallow).

In the example of FIG. 25, a boundary exists between a current formation and a wet zone formation where each formation (e.g., layer) has its own set of characteristic properties. As shown, measurements acquired by the LWD tool may be utilized to generate one or more plots that can provide indications as to the presence and location of the boundary such that, for example, the drillstring can be controlled to avoid drilling into or too closely to the boundary. In the example of FIG. 25, the PERISCOPE tool may be utilized with a frequency of 100 kHz as included in a drillstring for shale drilling into wet sand where the layers have approximately the same $R_t$ (e.g., 1 ohm-m), and different dielectric constant (epsilon) values (e.g., 10000, 15).

Figure 26:
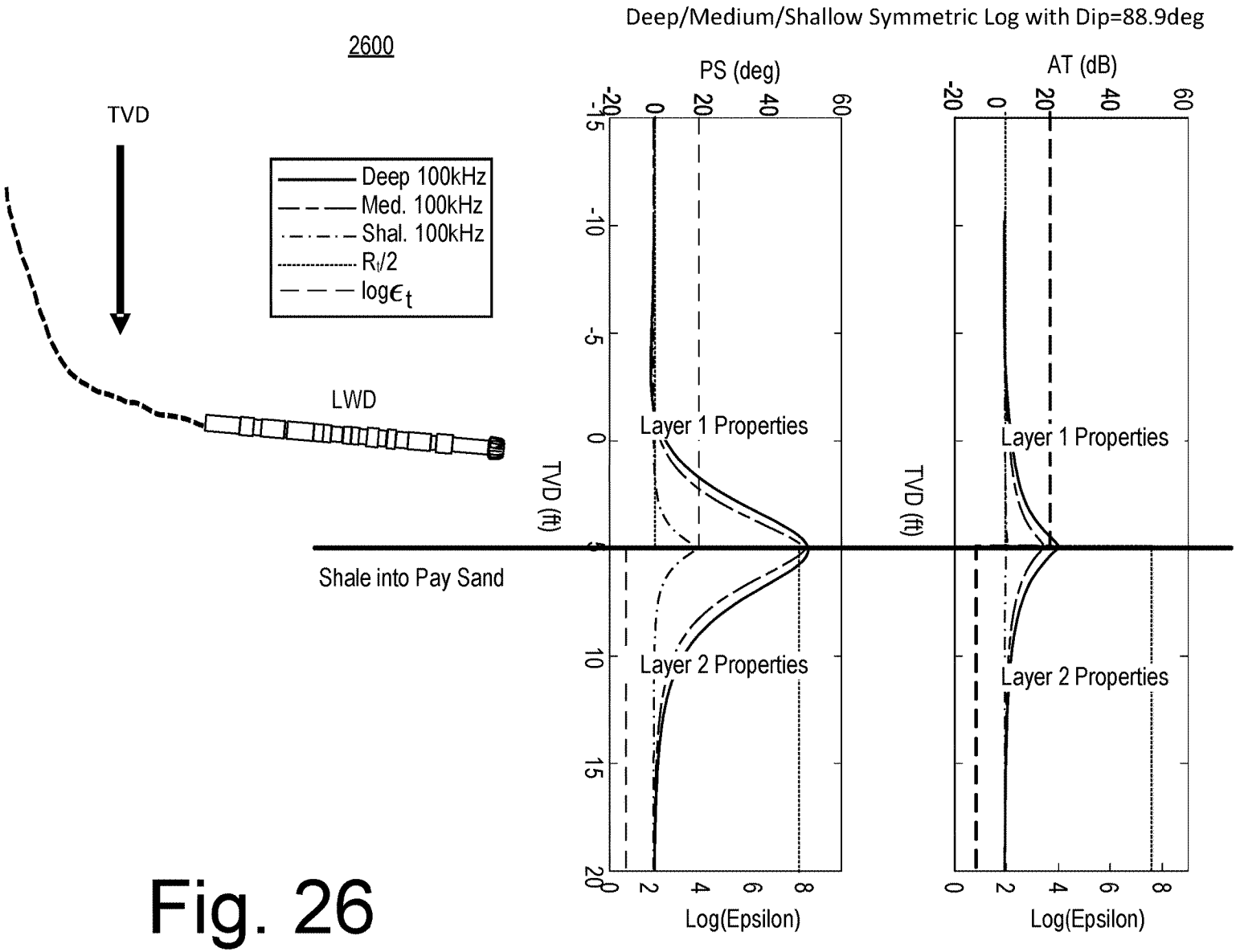
FIG. 26 illustrates examples of plots.

FIG. 26 shows example plots 2600 of phase shift (PS) and attenuation (AT) with respect to total vertical depth (TVD) for another scenario where a current formation is shale and a boundary exists between the shale and a pay zone formation of sand.

Figure 27:
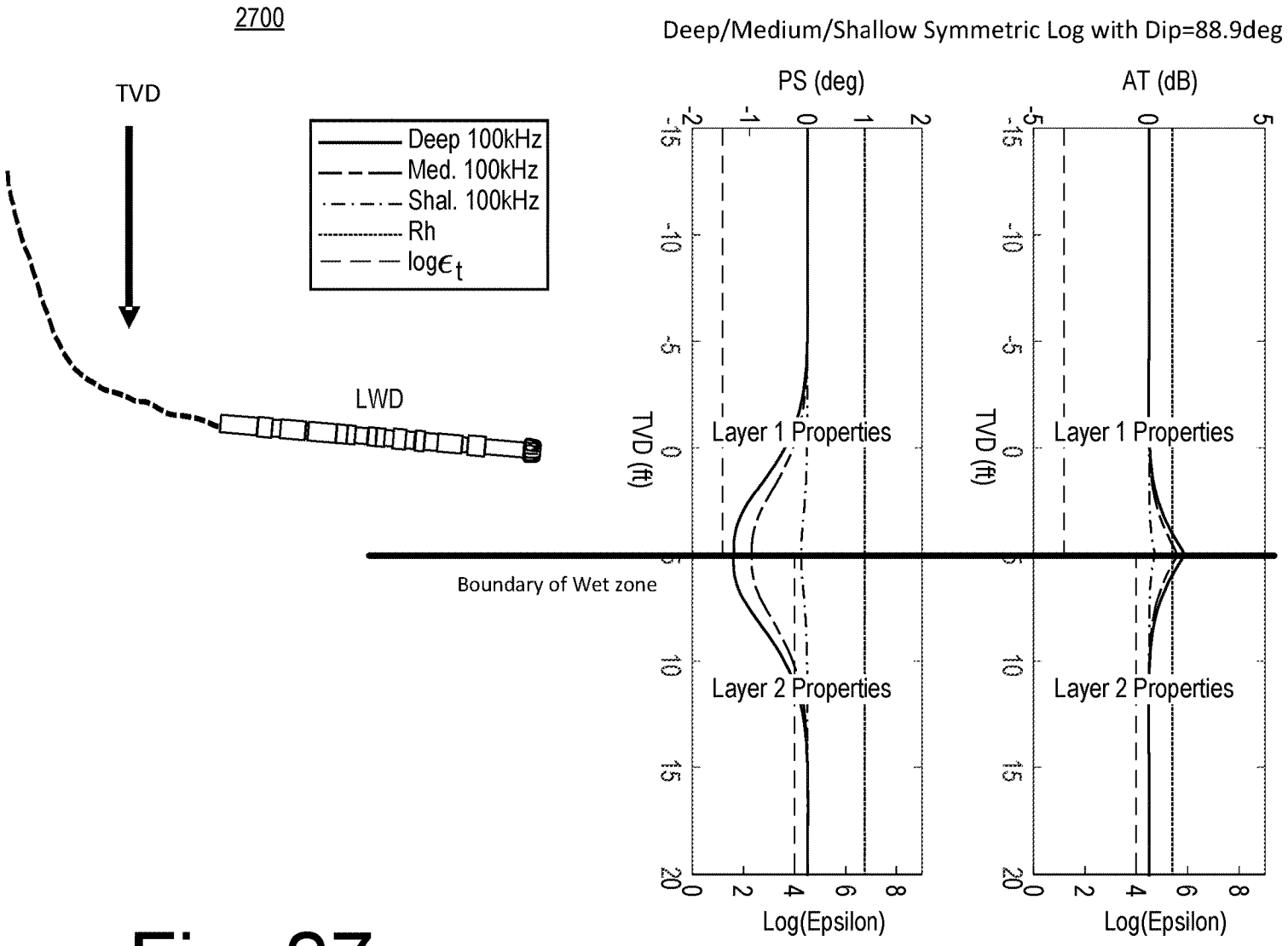
FIG. 27 illustrates example graphics and plots.

FIG. 27 shows an example graphic 2700 that includes a portion of a trajectory of a borehole that includes a drillstring with an LWD tool for acquiring measurements along with example plots of phase shift (PS) and attenuation (AT) with respect to total vertical depth (TVD). In the example of FIG. 27, a boundary exists between formations where each formation (e.g., layer) has its own set of characteristic properties. As shown, measurements acquired by the LWD tool may be utilized to generate one or more plots that can provide indications as to the presence and location of the boundary such that, for example, the drillstring can be controlled. In the example of FIG. 27, the PERISCOPE tool may be utilized with a frequency of 100 kHz as included in a drillstring wet sand drilling into shale where the layers have approximately the same $R_t$ (e.g., 1 ohm-m), and different dielectric constant (epsilon) values (e.g., 15, 10000).

Figure 28:
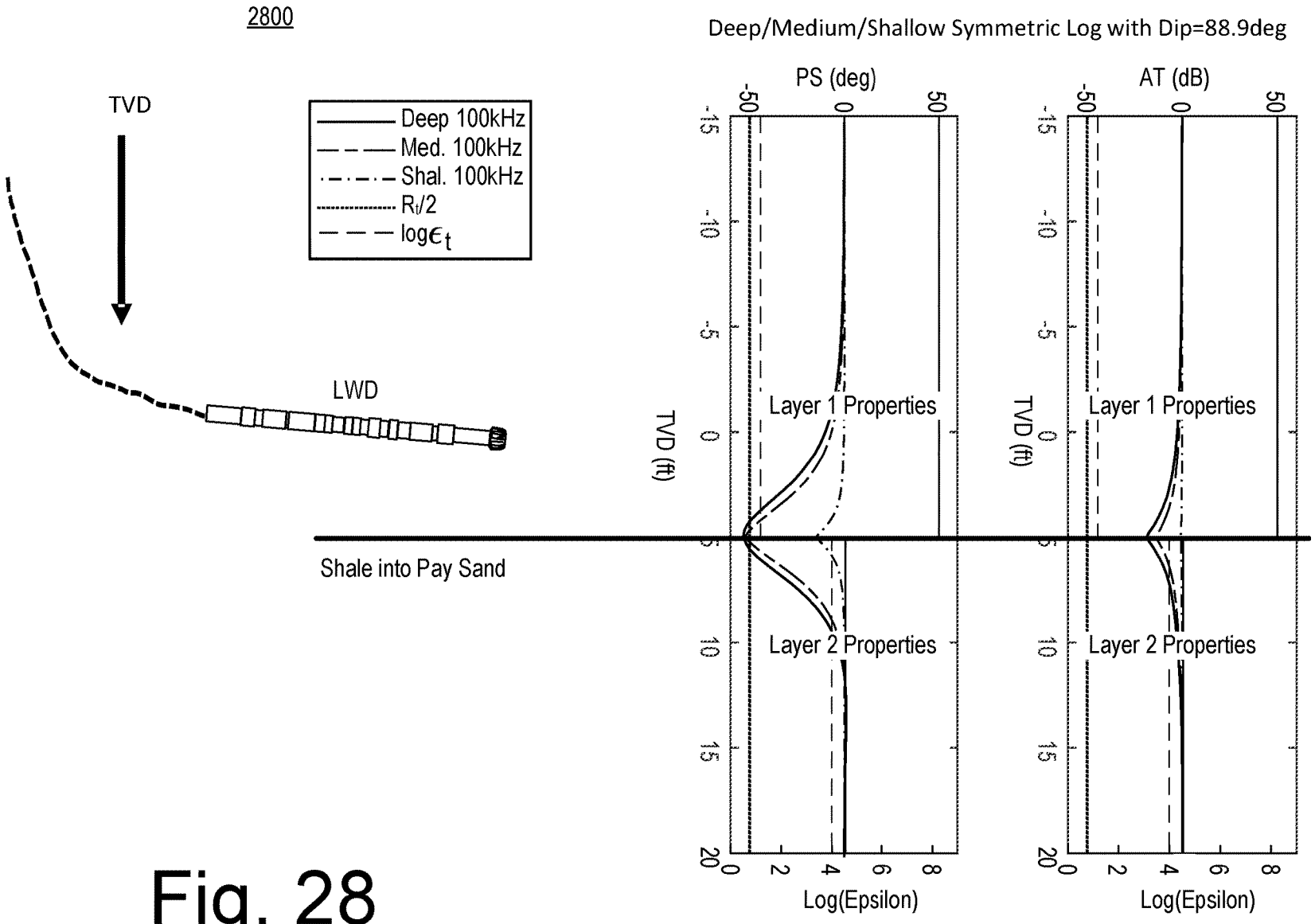
FIG. 28 illustrates examples of plots.

FIG. 28 shows example plots 2800 of phase shift (PS) and attenuation (AT) with respect to total vertical depth (TVD) for another scenario where a current formation is a pay zone formation of sand a boundary exists between the pay zone formation of sand and a formation of shale.

Figure 29:
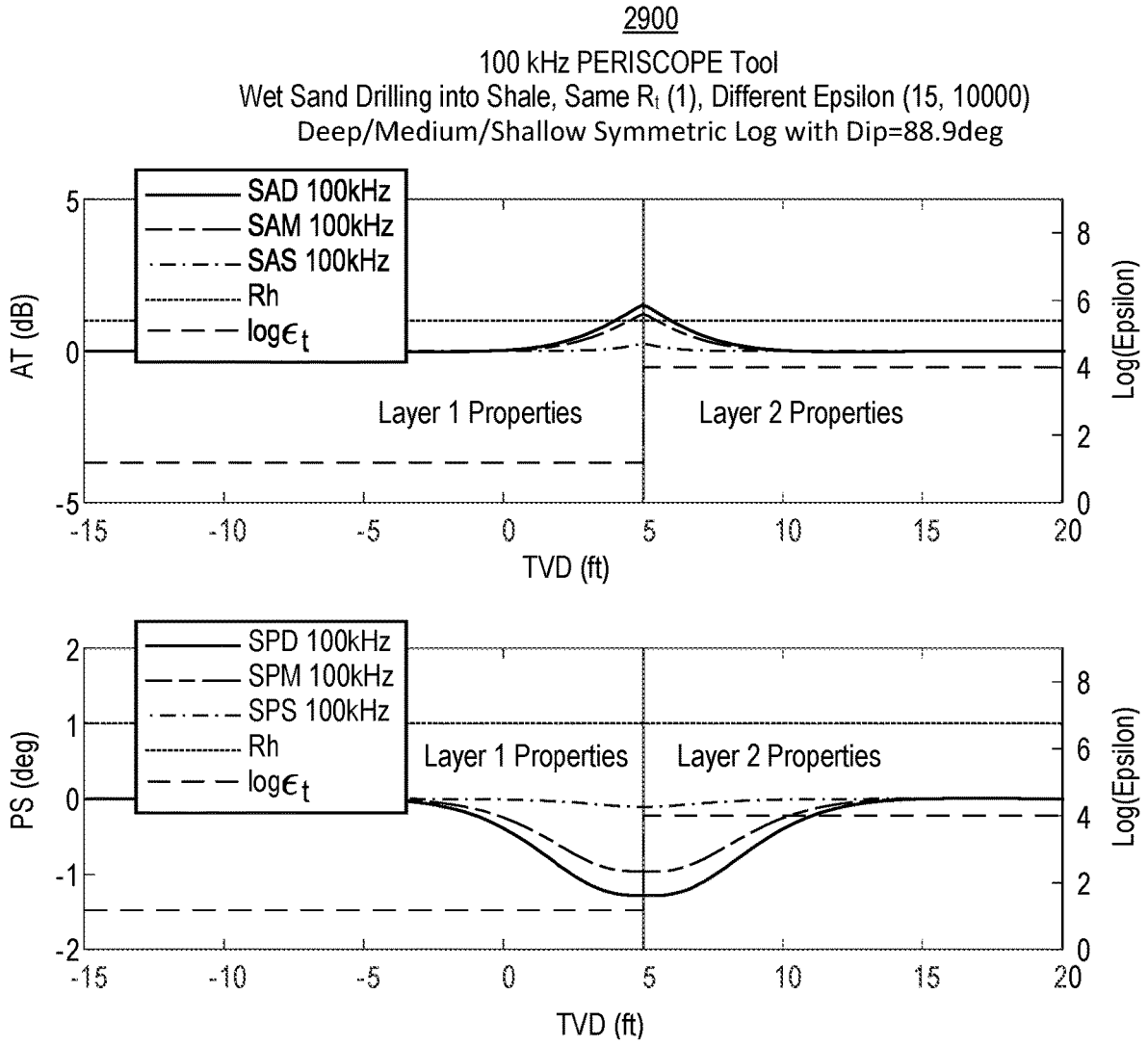
FIG. 29 illustrates examples of plots.

FIG. 29 shows example plots 2900 for a scenario using a 100 kHz PERISCOPE tool for wet sand drilling into shale with approximately the same $R_t$ (e.g., 1 ohm-m) and different dielectric constants (epsilon) (e.g., 15, 10000).

Figure 30:
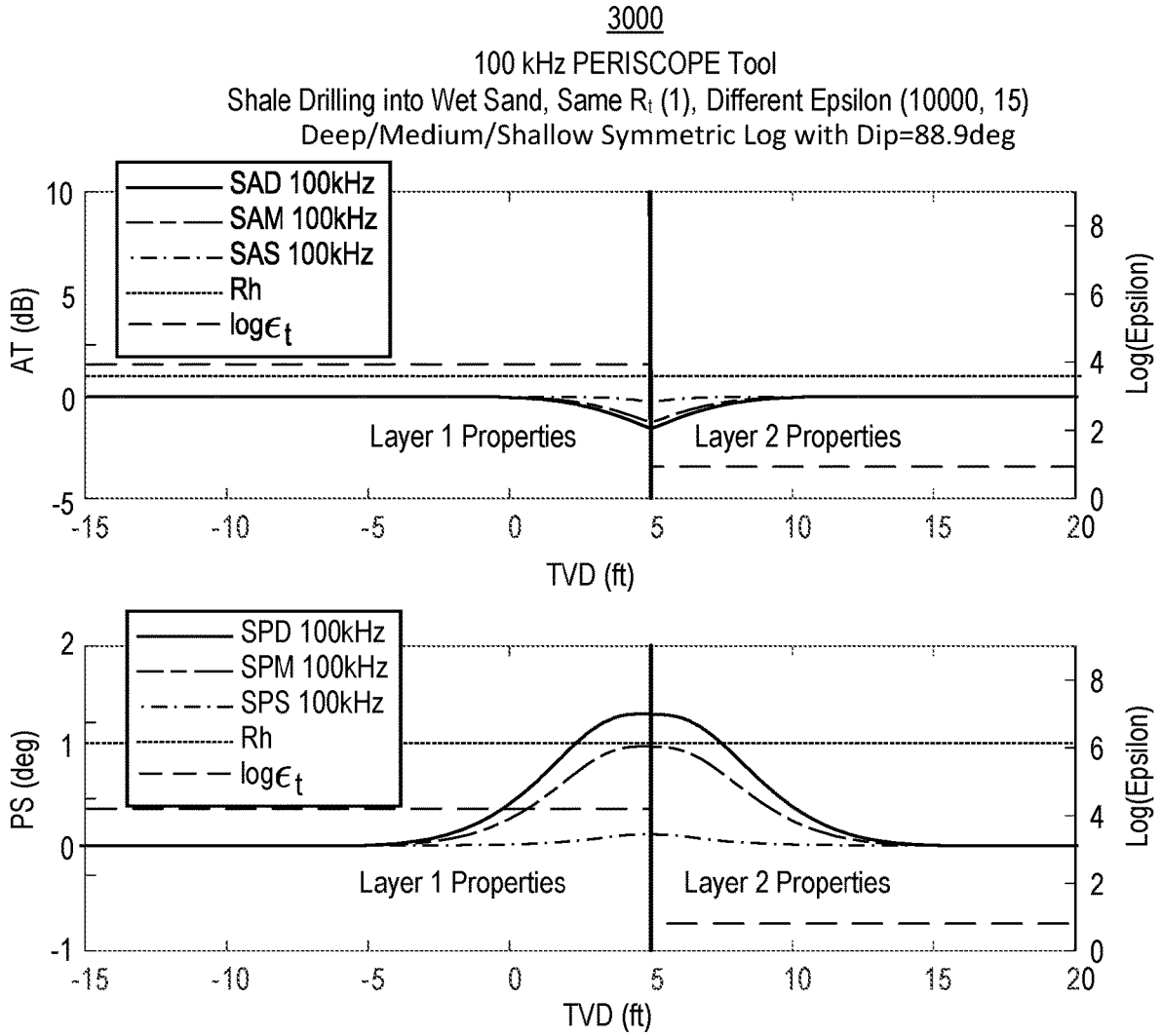
FIG. 30 illustrates examples of plots.

FIG. 30 shows example plots 3000 for a scenario using a 100 kHz PERISCOPE tool for shale drilling into wet sand with approximately the same $R_t$ (e.g., 1 ohm-m) and different dielectric constants (epsilon) (e.g., 10000, 15).

Figure 31:
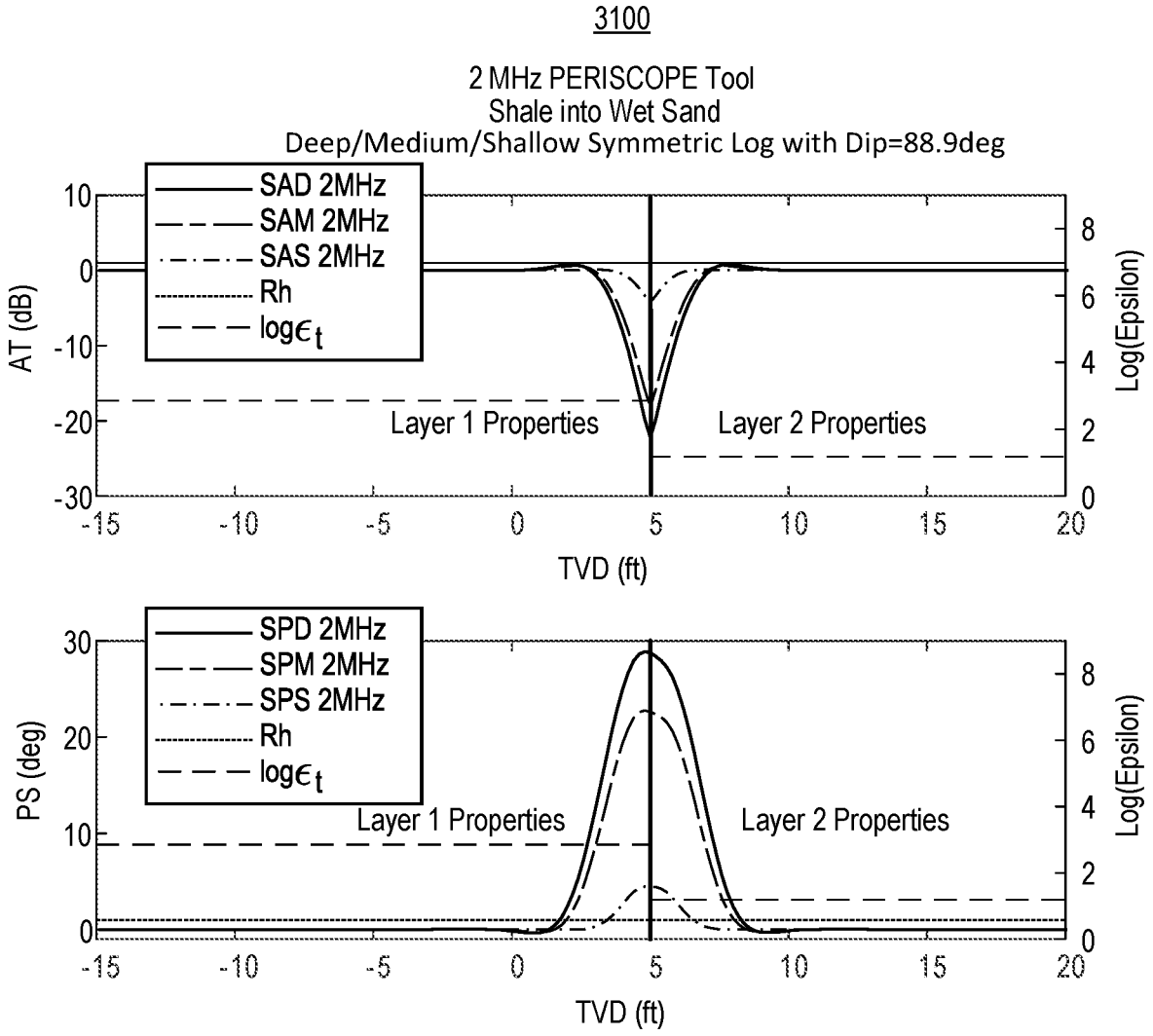
FIG. 31 illustrates examples of plots.

FIG. 31 shows example plots 3100 for a scenario using a 2 MHz PERISCOPE tool for wet sand drilling into shale with approximately the same $R_t$ (e.g., 1 ohm-m) and different dielectric constants (epsilon) (e.g., 15, 10000).

Figure 32:
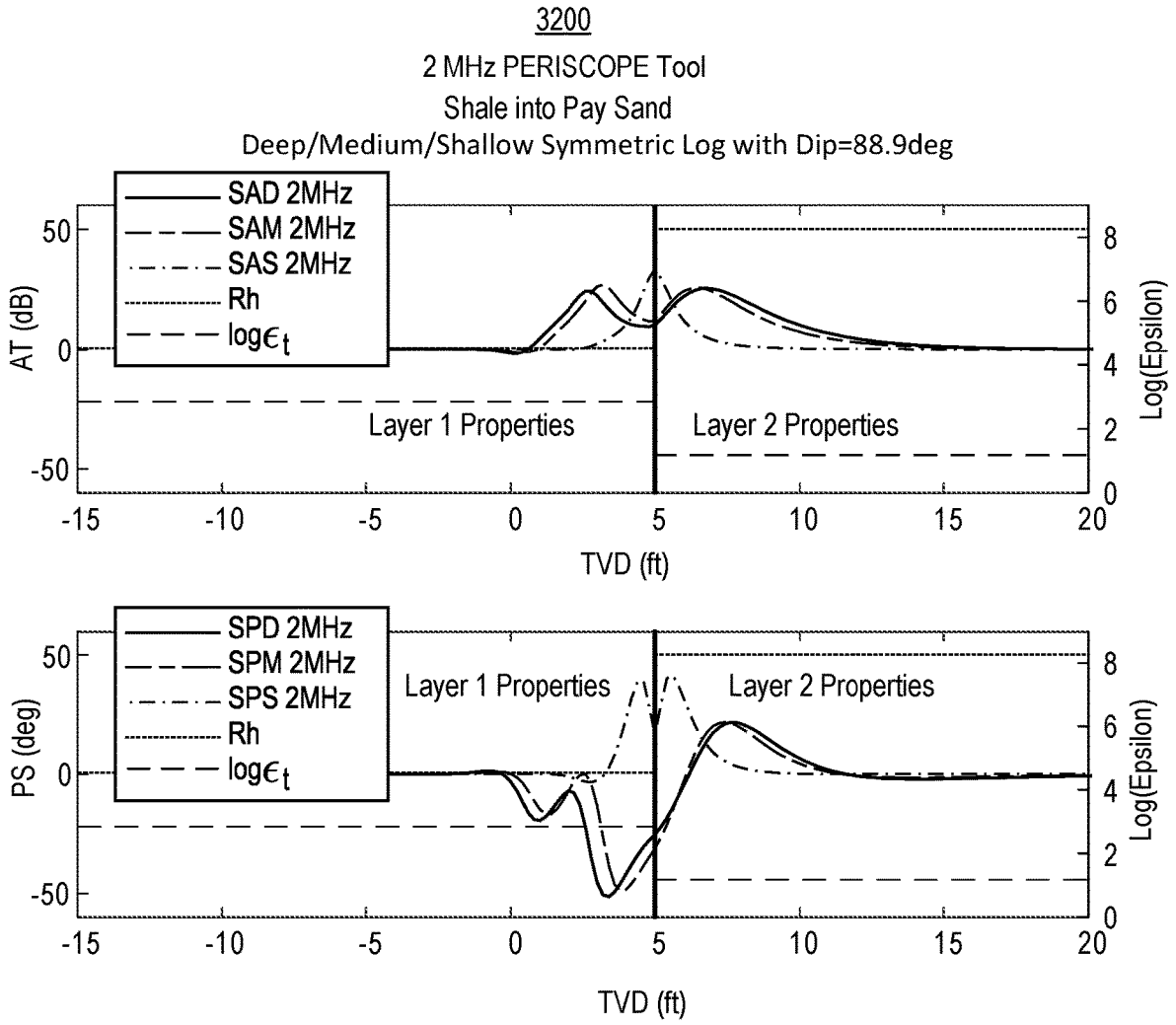
FIG. 32 illustrates examples of plots.

FIG. 32 shows example plots 3200 for a scenario using a 2 MHz PERISCOPE tool for shale drilling into wet sand with approximately the same $R_t$ (e.g., 1 ohm-m) and different dielectric constants (epsilon) (e.g., 10000, 15).

Figure 33:
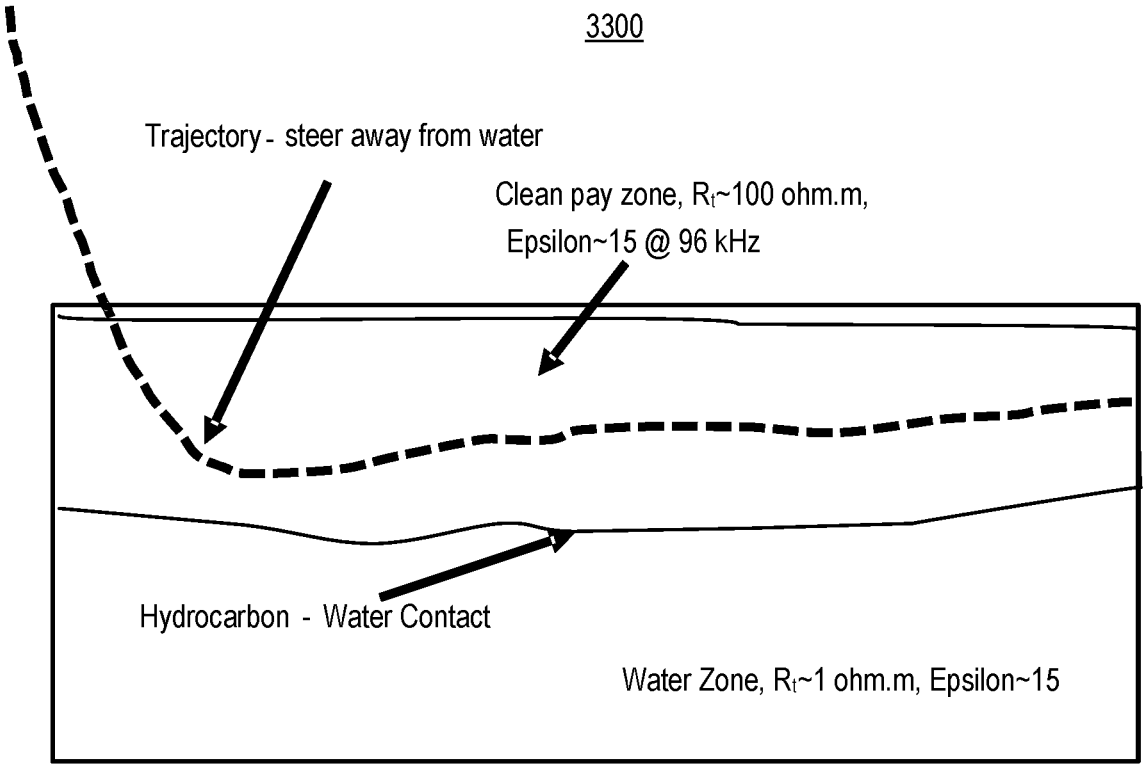
FIG. 33 illustrates an example of a graphic of a geologic region.

FIG. 33 shows an example graphic 3300 for a scenario of geosteering away from water. For example, consider a hydrocarbon and water contact interface or boundary where directional drilling is to maintain a borehole being drilled in a hydrocarbon zone, which may be referred to as a clean pay zone and to avoid drilling into a water zone. As explained, downhole tool measurements may be utilized to identify the interface (e.g., boundary) between such zones.

Figure 34:
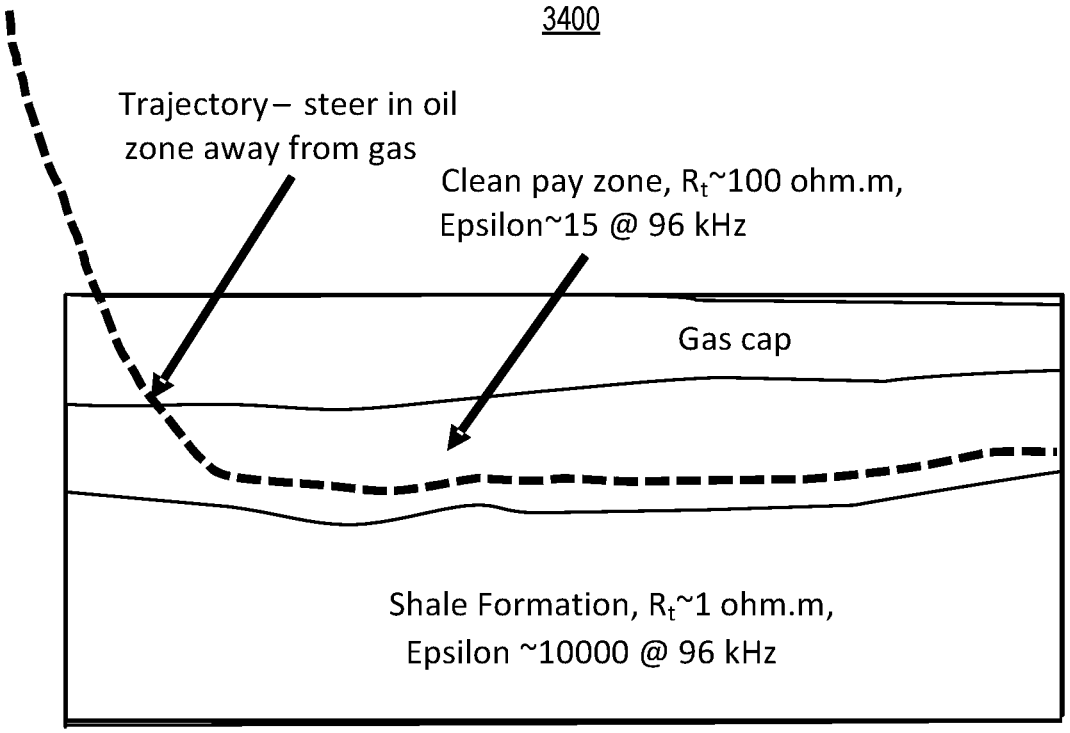
FIG. 34 illustrates an example of a graphic of a geologic region.

FIG. 34 shows an example graphic 3400 for a scenario of geosteering near shale and away from a gas cap. As shown, geosteering may aim to avoid drilling into a gas cap zone and to maintain a borehole being drilled within a clean pay zone.

Figure 35:
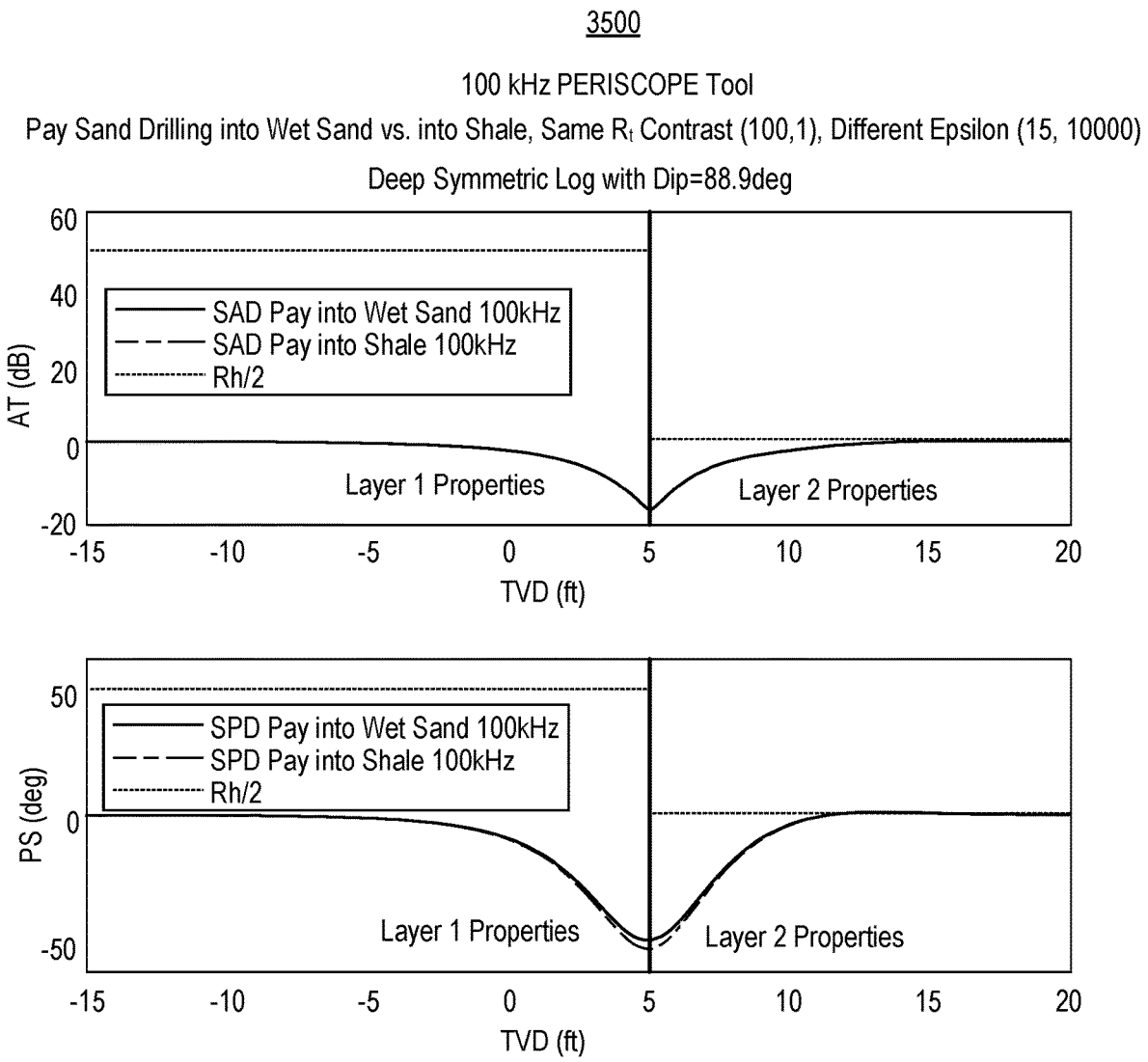
FIG. 35 illustrates examples of plots.

FIG. 35 shows example plots 3500 for a scenario using a 100 kHz PERISCOPE tool for wet sand drilling into shale with different $R_t$ (e.g., 100 ohm-m, 1 ohm-m) and different dielectric constants (epsilon) (e.g., 15, 10000).

Figure 36:
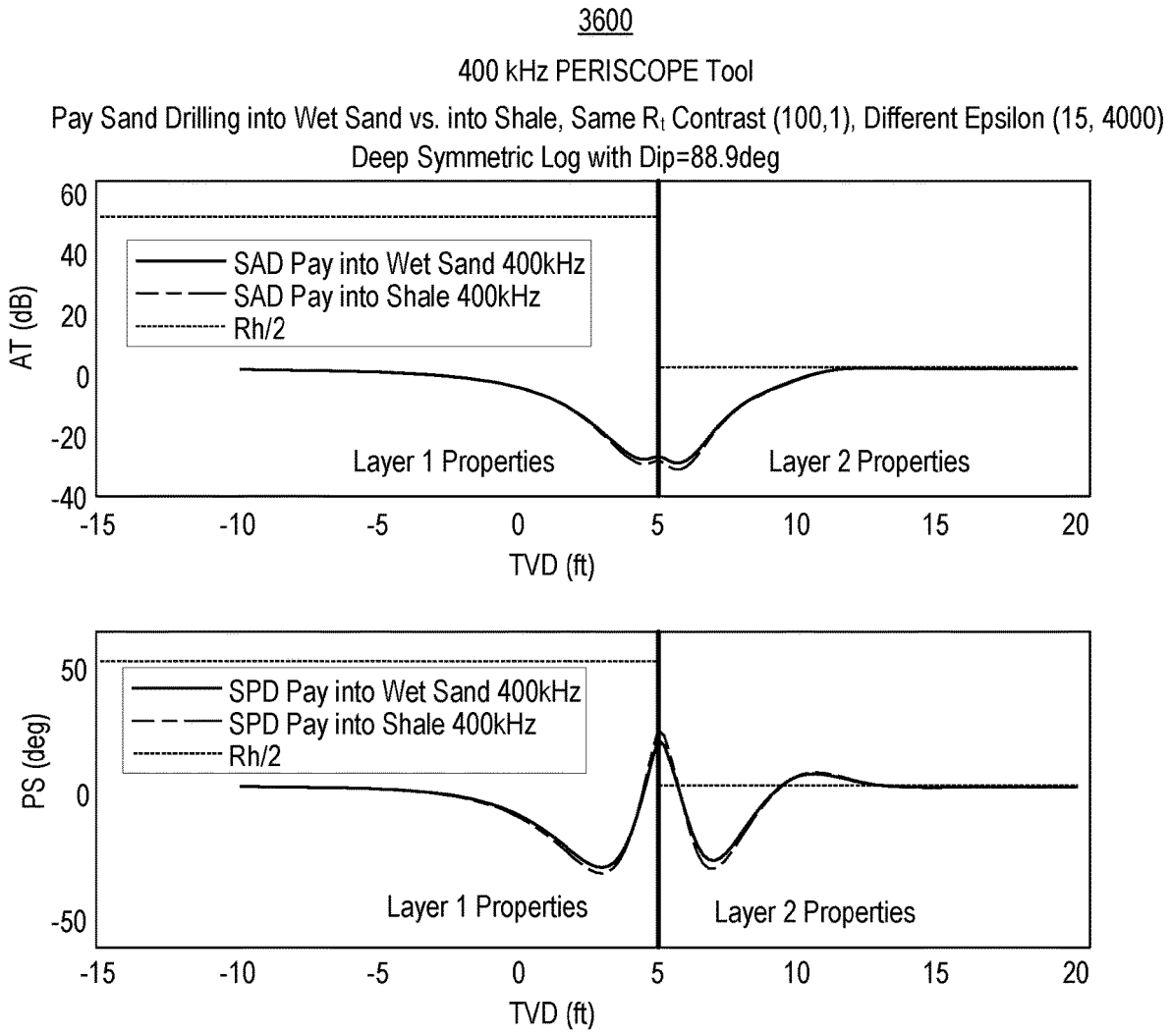
FIG. 36 illustrates examples of plots.

FIG. 36 shows example plots 3600 for a scenario using a 400 kHz PERISCOPE tool for wet sand drilling into shale with different $R_t$ (e.g., 100 ohm-m, 1 ohm-m) and different dielectric constants (epsilon) (e.g., 15, 4000).

Figure 37:
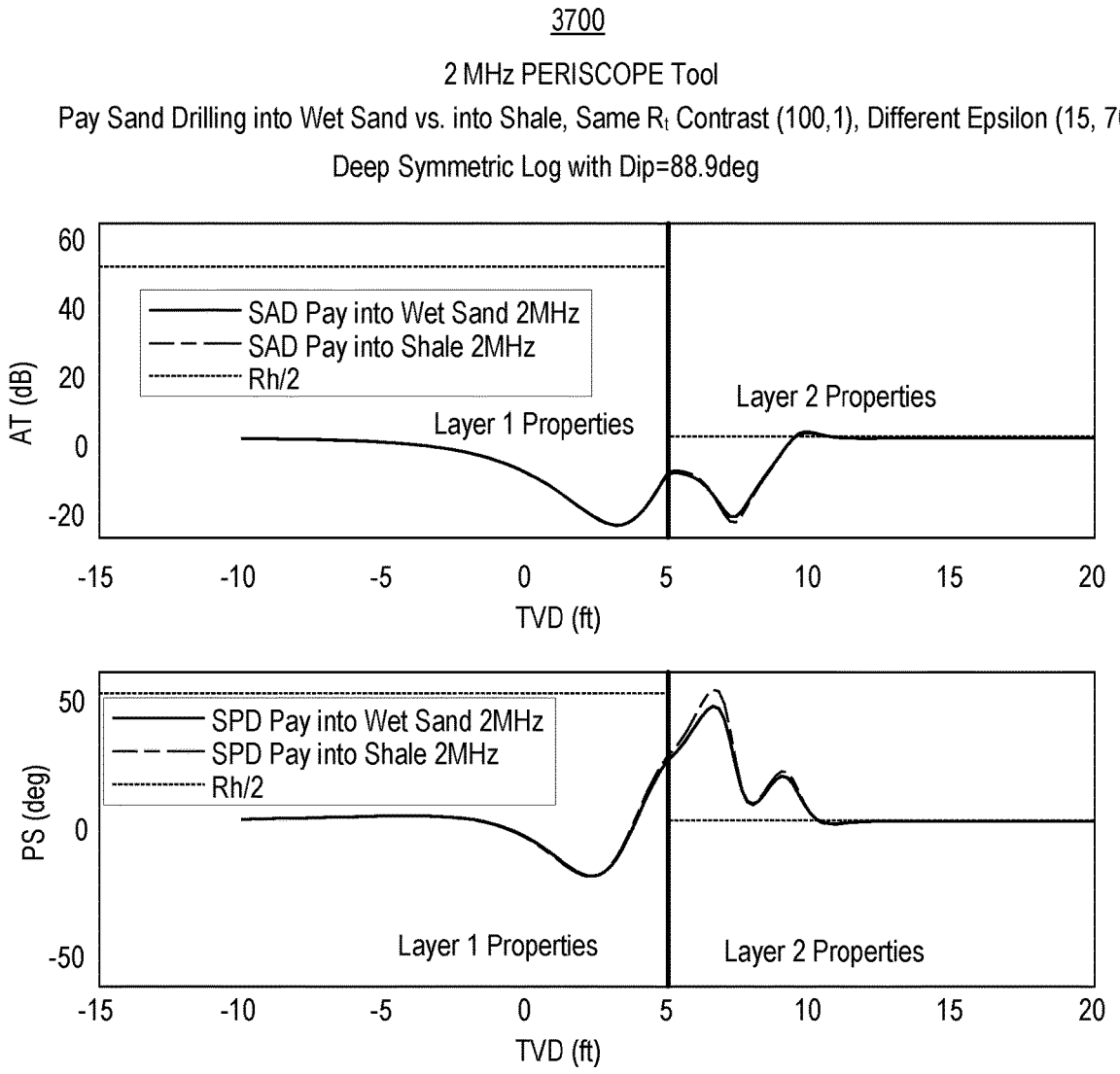
FIG. 37 illustrates examples of plots.

FIG. 37 shows example plots 3700 for a scenario using a 2 MHz PERISCOPE tool for wet sand drilling into shale with different $R_t$ (e.g., 100 ohm-m, 1 ohm-m) and different dielectric constants (epsilon) (e.g., 15, 700).

As explained, a framework may be implemented during field operations for geosteering. In such an example, the framework may utilize dielectric data acquired by a downhole tool for determinations as to, for example, phase and attenuation. As an example, a framework may provide for generation of one or more graphical user interfaces that may provide for rendering of representations of one or more layers, one or more boundaries, etc. As an example, a framework may provide for rendering of one or more types of images, which may include a resistivity image, a dielectric image, a lithology image, etc., which may be with respect to one or more spatial dimensions that correspond to a subsurface space. As an example, a framework may provide for superimposing two or more images for purposes of identification of a boundary, a layer, etc. As an example, a framework may provide for estimating the position of an interface and, for example, generating one or more geosteering commands and/or recommendations based on an estimated position of an interface.

As explained, a framework may provide for forward modeling using formation dielectric information. As explained, various graphics can show a trajectory in TVD along with a position of an LWD directional tool as part of a BHA behind a drill bit. Various graphics may include one or more plots, which may show layer properties, a boundary between layers, and a forward modeled phase shift and attenuation for symmetrized directional measurements taken at a particular frequency (e.g., consider 100 kHz for a shallow, medium and deep DOI curve).

In various examples, phase shift and attenuation may be approximately zero far from a boundary. For example, consider the scenario of FIG. 25 where, at a depth greater than 5 feet from the boundary, the deep symmetrized phase (PS) no longer reads zero and reaches a maximum value of 1.2 degrees at the boundary. Directional measurements tend to have a resolution of about 0.1 degrees, making this response significant. As shown, the attenuation (AT) has a peak response of about negative 1.5 dB, which is again easily measurable where tools have a resolution of 0.01 dB.

Without proper assessment, a normal interpretation of the measurements and an automatic inversion may erroneously attribute responses to a resistive layer being below the trajectory. In such an approach, drilling may continue with the expectation that the lateral would be drilled into the resistive hydrocarbon bearing reservoir; whereas, instead, the drill bit would enter the water bearing portion of the reservoir. As explained, a framework may provide for geosteering in a manner that may reduce risk of entering an unfavorable formation and/or to maintain a borehole being drilled within a favorable formation (e.g., with some assurances as to one or more distances from a boundary or boundaries, etc.).

Referring again to the example of FIG. 26, the plots 2600 show forward modeled directional symmetrized phase shift (PS) and attenuation (AT) when drilling in a shale and approaching a hydrocarbon bearing layer (e.g., pay sand). As shown in the plots 2600, the initial directional phase shift and attenuation responses mimic the response as in the plots 2500 of FIG. 25. The interpretation of the directional measurements and subsequent inversion results are not able to clearly differentiate between approaching the wet layer in FIG. 25 and approaching the hydrocarbon reservoir in FIG. 26 until the trajectory is within a few feet of the boundary. When the tool reaches boundary, the magnitude of the response is shown to have a greater magnitude when approaching the hydrocarbon bearing layer compared to the wet sand.

As explained, directional responses can be a function of contrasting formation conductivity and dielectric constant as well as distance to a layer boundary. Initially, an interpreter and an inversion may not necessarily be able to differentiate between a wet sand far from the trajectory and a pay sand closer to the trajectory; however, as the boundary is approached, responses may be generated for purposes of steering.

Referring again to FIG. 27 and the graphics 2700, the plots from forward modeling include directional symmetrized phase shift (PS) and attenuation (AT) when drilling in a wet sand and approaching a shale layer. As shown, directional measurements also have a positive value when the tool is in a high resistivity layer and is approaching a lower resistivity layer above the trajectory. The plots of FIG. 27 illustrate that when approaching a bed with a higher dielectric but having the same or similar resistivity, the directional measurement response is reversed compared to the opposite configuration as discussed with respect to the plots of FIG. 25. Hence, the plots of FIG. 25 and the plots of FIG. 27 illustrates the sensitivity of the directional measurements to the dielectric constant.

Various example scenarios illustrate problems that may arise when one does not account for the dielectric constant properties of the earth layers. As explained, a framework may provide for forward modeling and/or inversion that include one or more provisions to include the dielectric properties of the layers.

As explained, a framework may provide for reacting to shale by modifying forward modeling to include the dielectric constant as a layer property. As an example, a framework may provide for solving for layer boundary position, layer resistivity, and layer dielectric constant simultaneously; rather than solving for only layer boundary position and layer resistivity. Such a framework may provide the proper boundary location and layer resistivity. In various scenarios, a framework may set the horizontal and vertical dielectric equal for simplicity or may set these to be different.

As explained, a framework may provide output such that a water bearing formation is to be avoided and steered away from to eliminate the possibility of water encroachment or water entry into a lateral portion of a borehole. As an example, a clay rich shale formation can be approached or steered closely to without the consequences of the water bearing formation.

As explained, a framework may provide output for a scenario where a clean water bearing formation may have the same resistivity as the clay shale formation but the formation dielectric constant values of each will be dramatically different. In such a scenario, the framework may allow for differentiating between the two beds to provide a basis for geosteering.

As an example, initially, the absolute value of formation dielectric constant may be used to distinguish a clay shale bed from a clean zone regardless of the clean zone hydrocarbon saturation. In such an example, a framework may allow for geosteering a lateral portion of a borehole away from bottom water, which may potentially be fracked into, ruining the productive potential of the lateral.

As an example, a framework may provide for determining a petrophysical relationship between clay type, clay volume and formation dielectric constant. As an example, where volume of clay is high, a bed may be positively identified as a shale bed; whereas, if volume of clay is zero or very low, the bed may be a clean formation with little shale.

As an example, a framework may utilize a permittivity parameter that provides a capability to define layers by both resistivity and lithology, allowing for differentiating clean zones from shales (e.g., where both may have similar resistivities). While this may be normally performed utilizing a gamma ray measurement, it may not be available until a lateral is within a shale layer given a shallow DOI of the gamma-ray instrument. As an example, directional measurements may sense approaching layer properties tens of feet away allowing for determination of lithology before entering a layer with the trajectory. In various instances, a deeper symmetrized measurement may give an even earlier indication for a driller and/or a controller to react.

As explained, a framework may provide for geosteering away from a water bearing zone based on absolute values of resistivity and formation dielectric constant. As an example, a framework may provide for computing bulk CEC and clay volumes using a petrophysical model with LWD directional measurements and inversion outputs of bed conductivity and bed dielectric constant. As an example, a method can include geosteering away from a water bearing zone based on absolute values of resistivity and formation dielectric constant. As an example, a method can include computing bulk CEC and clay volumes using a petrophysical model with LWD directional measurements and inversion outputs of bed conductivity and bed dielectric constant.

As explained, a framework may provide for a directional resistivity response to a dielectric boundary or boundaries. As an example, directional symmetrized measurements may be sensitive to a formation dielectric constant and have a unique response. For example, PS and AT may deviate in different directions. As explained, shales and sands tend to have dramatically different dielectric constants and directional responses, which thereby allow for a framework to provide output such as, for example, a lithological geosteering command and/or recommendation. As explained, higher frequency measurements may tend to have greater sensitivity and may be comparable to conductivity sensitivity. As explained, when the conductivity contrast is large, the dielectric effects tend to be greatly reduced, noting that in some instances they may not be detectable regardless of frequency.

As explained, a framework may provide for lithological geosteering via using dielectric constant (e.g., epsilon) to forward model and including dielectric constant (e.g., epsilon) for an inversion. As explained, including dielectric constant (e.g., epsilon) in inversions may improve boundary location accuracy, and layer $R_t$ in many scenarios, and provide the additional ability to steer by lithology in at least some scenarios.

Figure 38:
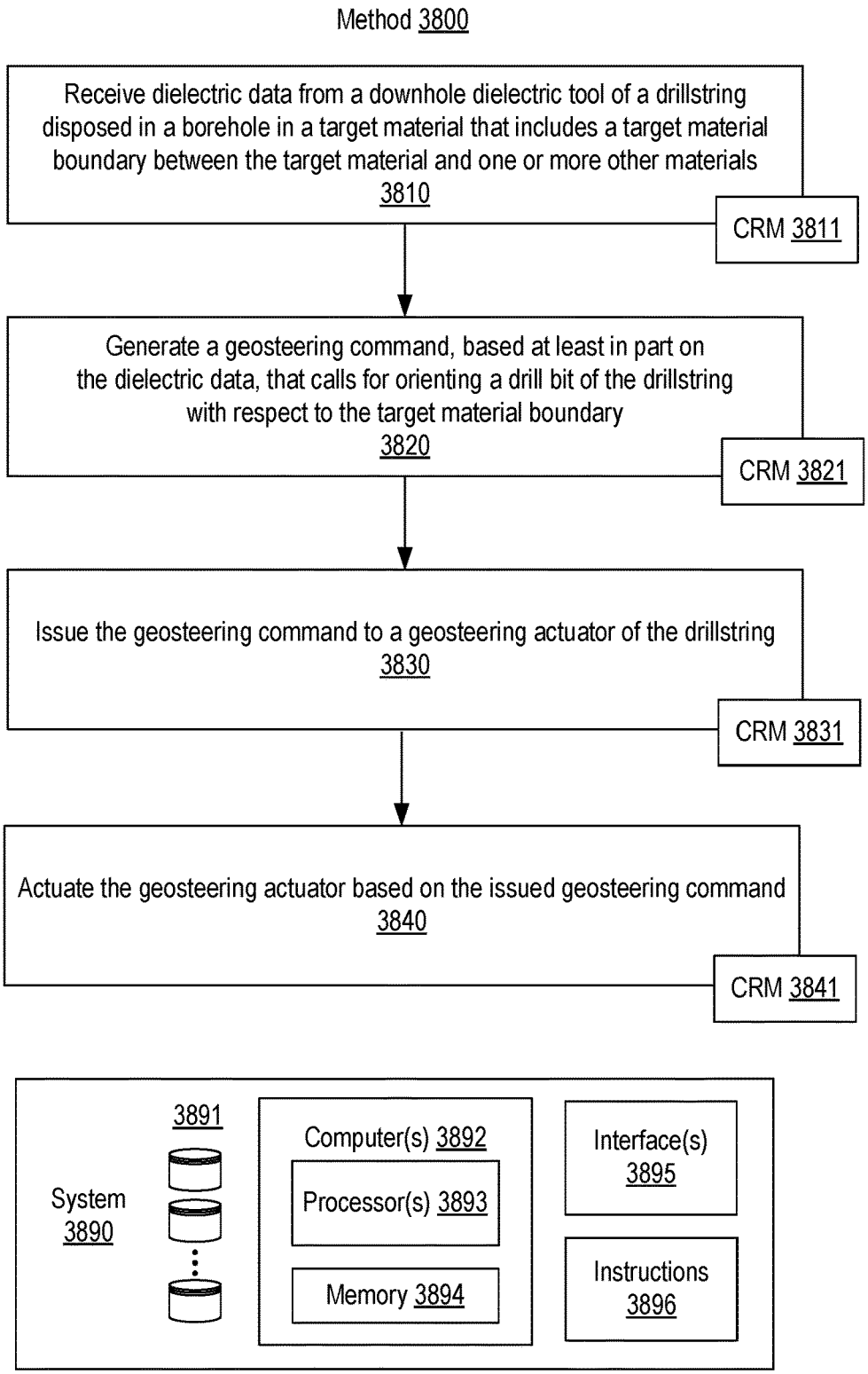
FIG. 38 illustrates an example of a method and an example of a system.

FIG. 38 shows an example of a method 3800 that includes a reception block 3810 for receiving dielectric data from a downhole dielectric tool of a drillstring disposed in a borehole in a target material that includes a target material boundary between the target material and one or more other materials; a generation block 3820 for generating a geosteering command, based at least in part on the dielectric data, that calls for orienting a drill bit of the drillstring with respect to the target material boundary; and an issuance block 3830 for issuing the geosteering command to a geosteering actuator of the drillstring. As shown, the method 3800 can include an actuating block 3840 for actuating the geosteering actuator based on the issued geosteering command.

The method 3800 of FIG. 38 is shown as including various computer-readable storage medium (CRM) blocks 3811, 3821, 3831, and 3841 that can include processor-executable instructions that can instruct a computing system, which can be a control system, to perform one or more of the actions described with respect to the method 3800.

As shown in the example of FIG. 38, the system 3890 can include one or more computers 3892 that include one or more processors 3893, memory 3894 operatively coupled to at least one of the one or more processors 3893, instructions 3896 that can be, for example, stored in the memory 3894, and one or more interfaces 3895 (e.g., one or more network interfaces and/or other interfaces). As an example, the system 3890 can include one or more processor-readable media that include processor-executable instructions executable by at least one of the one or more processors 3893 to cause the system 3890 to perform actions such as, for example, one or more actions of the method 3800. As an example, the instructions 3896 can include instructions of one or more of the CRM blocks 3811, 3821, 3831, and 3841. The memory 3894 can be or include the one or more processor-readable media where the processor-executable instructions can be or include instructions. As an example, a processor-readable medium can be a computer-readable storage medium that is non-transitory that is not a signal and that is not a carrier wave.

As an example, the system 3890 can include subsystems. For example, the system 3890 can include a plurality of subsystems that may operate using equipment that is distributed where a subsystem may be referred to as being a system. For example, consider a downhole tool system and a surface system. As an example, operations of the blocks 3810, 3820, 3830 and 3840 of the method 3800 may be performed using a downhole tool system. The method 3800 may be implemented using, for example, a downhole system and/or a surface system, which may be a cloud-based or cloud-coupled system.

As an example, a method can include receiving dielectric data from a downhole dielectric tool of a drillstring disposed in a borehole in a target material that includes a target material boundary between the target material and one or more other materials; generating a geosteering command, based at least in part on the dielectric data, that calls for orienting a drill bit of the drillstring with respect to the target material boundary; and issuing the geosteering command to a geosteering actuator of the drillstring. In such an example, the method may include generating the geosteering command at least in part by making a determination as to whether one of the one or more other materials includes clay. In such an example, a geosteering command may call for orienting the drill bit away from the target material boundary responsive to the determination indicating that the one of the one or more other materials does not include clay.

As an example, a geosteering command may call for orienting a drill bit away from a target material boundary responsive to making a determination that a dielectric constant of one of one or more other materials is indicative of a water zone.

As an example, a geosteering command may call for orienting a drill bit toward or parallel to a target material boundary responsive to making a determination that a dielectric constant of one of one or more other materials is indicative of a shale zone.

As an example, a method may include receiving, generating and issuing that are performed downhole by equipment of the drillstring. For example, consider a downhole tool that includes circuitry that may perform such actions. As an example, circuitry may include a processor and memory accessible to the processor where the memory stores processor-executable instructions that may be executed to perform receiving, generating and issuing.

As an example, a target material boundary may extend at least 1 meter ahead of a drill bit and dielectric data may include dielectric data that extend at least 1 meter ahead of the drill bit. In such an example, a geosteering command may call for orienting a drill bit at a future time where, for example, issuing may issue the geosteering command at the future time, for example, to control the orientation of the drill bit to drill a borehole in a desired direction (e.g., along a desirable trajectory).

As an example, a method may include receiving gamma data from a downhole gamma tool of a drillstring, where the method may include generating that generates a geosteering command based at least in part on the gamma data. As an example, such a method may include generating the geosteering command based at least in part on gamma data and dielectric data. As an example, a distance range of gamma data may be less than a distance range of dielectric data where a method may include generating a geosteering command in a manner that includes generating an initial geosteering command using the dielectric data and assessing the initial geosteering command using the gamma data. In such an example, a downhole dielectric tool may be at a first distance from a drill bit, where a downhole gamma tool may be at a second distance from the drill bit, and where the second distance is greater than the first distance.

As an example, a method may include performing an inversion using at least dielectric data to determine a cation exchange capacity of at least one of one or more other materials.

As an example, a method may include generating a geosteering command in a manner that includes performing a dielectric comparison of a first dielectric constant of a first one of one or more other materials to a second dielectric constant of a second one of the one or more other materials responsive to a resistivity comparison that determines that a first resistivity of the first one of the one or more other materials and a second resistivity of the second one of the one or more other materials are approximately equal, where the dielectric comparison determines whether the first one of the one or more other materials and the second one of the one or more other materials differ with respect to clay content.

As an example, a system can include a processor; memory accessible to the processor; processor-executable instructions stored in the memory and executable by the processor to instruct the system to: receive dielectric data from a downhole dielectric tool of a drillstring disposed in a borehole in a target material that includes a target material boundary between the target material and one or more other materials; generate a geosteering command, based at least in part on the dielectric data, that calls for orienting a drill bit of the drillstring with respect to the target material boundary; and issue the geosteering command to a geosteering actuator of the drillstring. In such an example, the geosteering actuator may act to control orientation of a drill bit such that geosteering is utilized for drilling at least a portion of a borehole in a subsurface environment.

As an example, a system may be a downhole system. As an example, a system may include a telemetry unit to receive dielectric data and to issue a geosteering command. For example, consider a system that may be at least in part located at a surface location where the telemetry unit may directly or indirectly transmit dielectric data to the surface location (e.g., for receipt by a surface receiver) and where the telemetry unit may directly or indirectly receive a geosteering command generated at the surface location that is transmitted downhole (e.g., by a surface transmitter). As an example, a system may include one or more transceivers that may transmit and/or receive information (e.g., data, commands, etc.).

As an example, one or more non-transitory computer-readable storage media may include processor-executable instructions executable to instruct a processor to: receive dielectric data from a downhole dielectric tool of a drillstring disposed in a borehole in a target material that includes a target material boundary between the target material and one or more other materials; generate a geosteering command, based at least in part on the dielectric data, that calls for orienting a drill bit of the drillstring with respect to the target material boundary; and issue the geosteering command to a geosteering actuator of the drillstring. In such an example, the instructions to generate may include instructions to make a determination as to whether one of the one or more other materials includes clay. In such an example, the geosteering command may call for orienting the drill bit away from the target material boundary responsive to the determination indicating that the one of the one or more other materials does not include clay.

As an example, one or more computer-readable storage media can include processor-executable instructions to instruct a computing system to perform one or more methods. In such an example, the one or more computer-readable storage media can be a program product (e.g., a computer program product, a computer system program product, etc.).

Figure 39:
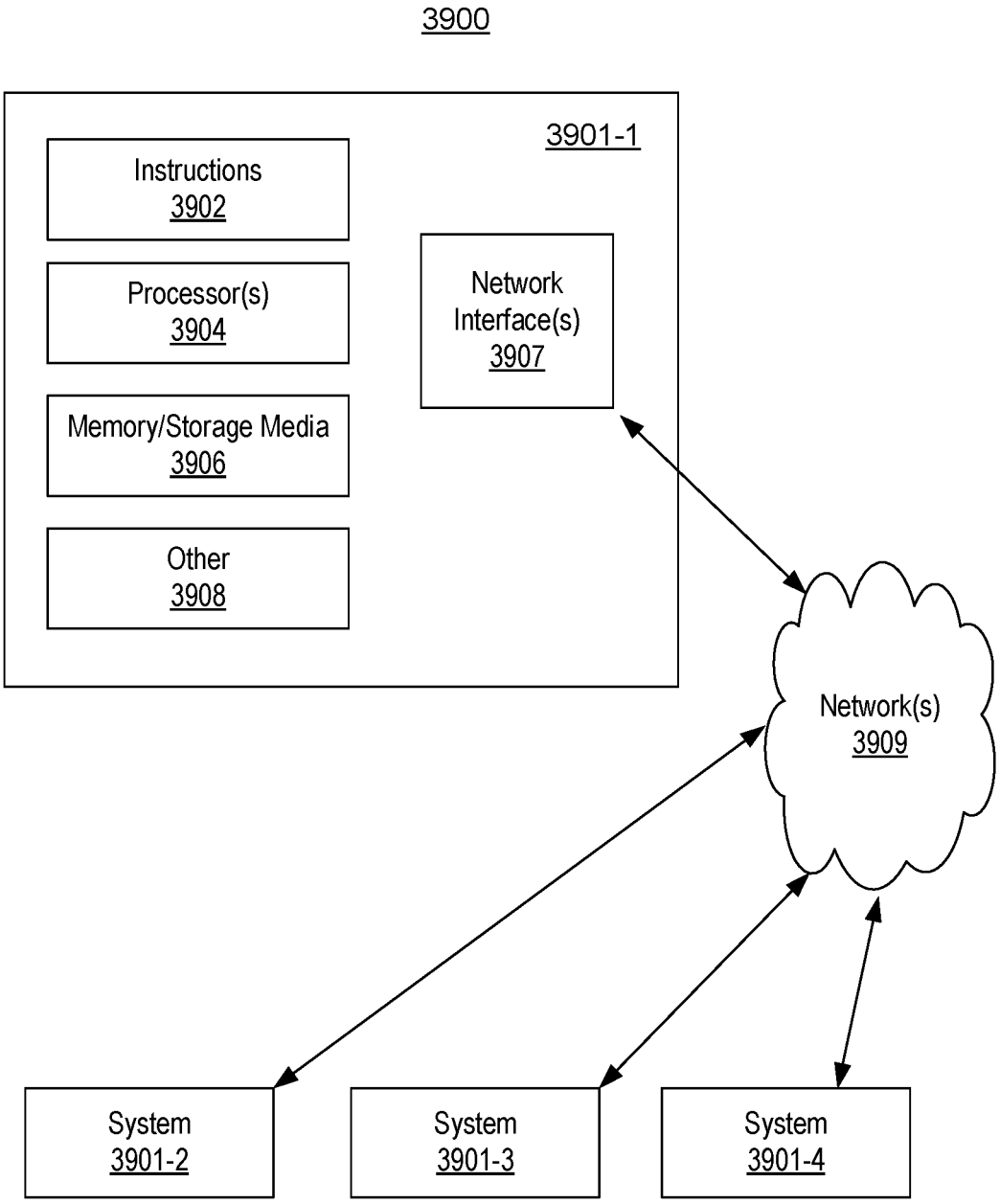
FIG. 39 illustrates examples of computing and networking equipment.

In some embodiments, a method or methods may be executed by a computing system. FIG. 39 shows an example of a system 3900 that can include one or more computing systems 3901-1, 3901-2, 3901-3 and 3901-4, which may be operatively coupled via one or more networks 3909, which may include wired and/or wireless networks.

As an example, a system can include an individual computer system or an arrangement of distributed computer systems. In the example of FIG. 39, the computer system 3901-1 can include one or more sets of instructions 3902, which may be or include processor-executable instructions, for example, executable to perform various tasks (e.g., receiving information, requesting information, processing information, simulation, outputting information, etc.).

As an example, a set of instructions may be executed independently, or in coordination with, one or more processors 3904, which is (or are) operatively coupled to one or more storage media 3906 (e.g., via wire, wirelessly, etc.). As an example, one or more of the one or more processors 3904 can be operatively coupled to at least one of one or more network interface 3907. In such an example, the computer system 3901-1 can transmit and/or receive information, for example, via the one or more networks 3909 (e.g., consider one or more of the Internet, a private network, a cellular network, a satellite network, etc.). As shown, one or more other components 3908 can be included.

As an example, the computer system 3901-1 may receive from and/or transmit information to one or more other devices, which may be or include, for example, one or more of the computer systems 3901-2, etc. A device may be located in a physical location that differs from that of the computer system 3901-1. As an example, a location may be, for example, a processing facility location, a data center location (e.g., server farm, etc.), a rig location, a wellsite location, a downhole location, etc.

As an example, a processor may be or include a microprocessor, microcontroller, processor component or subsystem, programmable integrated circuit, programmable gate array, or another control or computing device.

As an example, the storage media 3906 may be implemented as one or more computer-readable or machine-readable storage media. As an example, storage may be distributed within and/or across multiple internal and/or external enclosures of a computing system and/or additional computing systems.

As an example, a storage medium or storage media may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY disks, or other types of optical storage, or other types of storage devices.

As an example, a storage medium or media may be located in a machine running machine-readable instructions, or located at a remote site from which machine-readable instructions may be downloaded over a network for execution.

As an example, various components of a system such as, for example, a computer system, may be implemented in hardware, software, or a combination of both hardware and software (e.g., including firmware), including one or more signal processing and/or application specific integrated circuits.

As an example, a system may include a processing apparatus that may be or include a general-purpose processors or application specific chips (e.g., or chipsets), such as ASICs, FPGAs, PLDs, or other appropriate devices.

As an example, a device may be a mobile device that includes one or more network interfaces for communication of information. For example, a mobile device may include a wireless network interface (e.g., operable via IEEE 802.11, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that can be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

BIBLIOGRAPHY (DOCUMENTS INCORPORATED BY REFERENCE HEREIN)

Knight, R. J., and Nur, A., "The Dielectric Constant of Sandstones, 60 kHz to 4 MHz", Geophysics, Vol 52, No. 5, pp. 644-654 (1987).

Wu, P. T., Lovell, J. R., Clark, B., Bonner, S. D., and Tabanou, J. R., "Dielectric-Independent 2-MHz Propagation Resistivities" SPE 56448, 1999 SPE Annual Technical Conference and Exhibition, Houston, Texas, 3-6 Oct. 1999.

Taherian, M. R., Kenyon, W. E., and Safinya, K. A., "Measurement of dielectric response of water-saturated rocks", Geophysics, Vol. 55, No. 12, pp. 1530-1541 (1990).

Rasmus, J. C., Homan, D., Wang, G. L., and Uschner, N., "Observations of Induction Dielectric Measurements and Their Role in Determining Thermal Maturity of Organic Mudrocks" 2018, DOI 10.15530/urtec-2018-2900940, Unconventional Resources Technology Conference, Houston, Texas, USA, 23-25 Jul. 2018 (URTeC: 2901940).

Clavier, C., Coates, G., and Dumanoir, J., "Theoretical and Experimental Bases for the Dual-Water Model for Interpretation of Shaly Sands." SPE J. 24 (1984): 153-168. doi: https://doi.org/10.2118/6859-PA.

Waxman, M. H., and Smits, L. J. M., "Electrical Conductivities in Oil-Bearing Shaly Sands", SPE Annual Fall Meeting, Houston TX., Oct. 1-4, 1967, SPE Transactions Volume 243, 1968.

Wang, G. L., Homan, D., Zhang, P., Abdallah, W., and Ma, S., "Model-Based Correction For Dip And Shoulder Bed Effects On Lwd Propagation Dielectric Constant And Resistivity Logs", SPWLA 62nd Annual Logging Symposium held online from May 17-20, 2021.

Revil, A., "Spectral induced polarization of shaly sands: Influence of the electrical double layer", Water Resources Research, 48, W02517 (2012), doi:10.1029/2011WR011260.

Vinegar, H. J. and Waxman, M. H., "Induced polarization of shaly sands", Geophysics 1984; 49 (8): 1267-1287. doi: https://doi.org/10.1190/1.1441755.

What is claimed is:

1. A method comprising:

receiving dielectric data from a downhole dielectric tool of a drillstring disposed in a borehole in a target material that comprises a target material boundary between the target material and one or more other materials;

generating a geosteering command, based at least in part on the dielectric data, that calls for orienting a drill bit of the drillstring with respect to the target material boundary;

determining the target material based on effects of formation conductivity and a formation dielectric as a function of frequency and a material surface area to volume ratio; and issuing the geosteering command to a geosteering actuator of the drillstring.

2. The method of claim 1, wherein generating the geosteering command comprises making a determination as to whether one of the one or more other materials comprises clay.

3. The method of claim 2, wherein the geosteering command calls for orienting the drill bit away from the target material boundary responsive to the determination indicating that the one of the one or more other materials does not comprise clay.

4. The method of claim 1, wherein the geosteering command calls for orienting the drill bit away from the target material boundary responsive to making a determination that the formation dielectric constant of one of the one or more other materials is indicative of a water zone.

5. The method of claim 1, wherein the geosteering command calls for orienting the drill bit toward or parallel to the target material boundary responsive to making a determination that the formation dielectric constant of one of the one or more other materials is indicative of a shale zone.

6. The method of claim 1, wherein the receiving, the generating and the issuing are performed downhole by equipment of the drillstring.

7. The method of claim 1, wherein the target material boundary extends at least 1 meter ahead of the drill bit and wherein the dielectric data comprise dielectric data that extend at least 1 meter ahead of the drill bit.

8. The method of claim 7, wherein the geosteering command calls for orienting the drill bit at a future time.

9. The method of claim 8, wherein the issuing issues the geosteering command at the future time.

10. The method of claim 1, further comprising receiving gamma data from a downhole gamma tool of the drillstring, wherein the generating generates the geosteering command based at least in part on the gamma data.

11. The method of claim 10, wherein a distance range of the gamma data is less than a distance range of the dielectric data, and wherein the generating the geosteering command comprises generating an initial geosteering command using the dielectric data and assessing the initial geosteering command using the gamma data.

12. The method of claim 10, wherein the downhole dielectric tool is at a first distance from the drill bit, wherein the downhole gamma tool is at a second distance from the drill bit, and wherein the second distance is greater than the first distance.

13. The method of claim 1, further comprising performing an inversion using at least the dielectric data to determine a cation exchange capacity of at least one of the one or more other materials.

14. The method of claim 1, wherein the generating the geosteering command comprises performing a dielectric comparison of a first dielectric constant of a first one of the one or more other materials to a second dielectric constant of a second one of the one or more other materials responsive to a resistivity comparison that determines that a first resistivity of the first one of the one or more other materials and a second resistivity of the second one of the one or more other materials are approximately equal, wherein the dielectric comparison determines whether the first one of the one or more other materials and the second one of the one or more other materials differ with respect to clay content.

15. A system comprising:

a processor;

memory accessible to the processor;

processor-executable instructions stored in the memory and executable by the processor to instruct the system to:

receive dielectric data from a downhole dielectric tool of a drillstring disposed in a borehole in a target material that comprises a target material boundary between the target material and one or more other materials;

generate a geosteering command, based at least in part on the dielectric data, that calls for orienting a drill bit of the drillstring with respect to the target material boundary;

determine the target material based on effects of formation conductivity and a formation dielectric as a function of frequency and a material surface area to volume ratio; and issue the geosteering command to a geosteering actuator of the drillstring.

16. The system of claim 15, wherein the system is a downhole system.

17. The system of claim 15, further comprising a telemetry unit to receive the dielectric data and to issue the geosteering command.

18. One or more non-transitory computer-readable storage media comprising processor-executable instructions executable to instruct a processor to:

receive dielectric data from a downhole dielectric tool of a drillstring disposed in a borehole in a target material that comprises a target material boundary between the target material and one or more other materials;

generate a geosteering command, based at least in part on the dielectric data, that calls for orienting a drill bit of the drillstring with respect to the target material boundary;

determine the target material based on effects of formation conductivity and a formation dielectric as a function of frequency and a material surface area to volume ratio; and issue the geosteering command to a geosteering actuator of the drillstring.

19. The one or more computer-readable storage media of claim 18, wherein the instructions to generate comprise instructions to make a determination as to whether one of the one or more other materials comprises clay.

20. The one or more computer-readable storage media of claim 19, wherein the geosteering command calls for orienting the drill bit away from the target material boundary responsive to the determination indicating that the one of the one or more other materials does not comprise clay.

* * * * *